US010480496B2

(12) United States Patent
Huang et al.

(10) Patent No.: US 10,480,496 B2
(45) Date of Patent: Nov. 19, 2019

(54) THREE-STAGE VARIABLE COLOR PASTE PUMP AND OPERATION METHOD THEREOF

(71) Applicant: ZHENGZHOU SANHUA TECHNOLOGY & INDUSTRY CO., LTD., Xingyang, Henan (CN)

(72) Inventors: Song Huang, Henan (CN); Weidan Xue, Henan (CN)

(73) Assignee: ZHENGZHOU SANHUA TECHNOLOGY & INDUSTRY CO., LTD., Xingyang, Henan (CN)

( * ) Notice: Subject to any disclaimer, the term of this patent is extended or adjusted under 35 U.S.C. 154(b) by 0 days.

(21) Appl. No.: 16/329,640

(22) PCT Filed: Aug. 26, 2017

(86) PCT No.: PCT/CN2017/099190
§ 371 (c)(1),
(2) Date: Feb. 28, 2019

(87) PCT Pub. No.: WO2018/041051
PCT Pub. Date: Mar. 8, 2018

(65) Prior Publication Data

US 2019/0195209 A1 Jun. 27, 2019

(30) Foreign Application Priority Data

Aug. 30, 2016 (CN) ..... 2016 1 0786104

(51) Int. Cl.
*A47K 5/12* (2006.01)
*F04B 13/02* (2006.01)
(Continued)

(52) U.S. Cl.
CPC ..... *F04B 13/02* (2013.01); *F04B 23/06* (2013.01); *F04B 37/10* (2013.01); *F04B 49/06* (2013.01);
(Continued)

(58) Field of Classification Search
CPC ..... F04B 13/02; F04B 53/10; F04B 49/22; F04B 23/06; F04B 37/10; F04B 49/06; B01F 15/0247; B01F 15/0416
See application file for complete search history.

(56) References Cited

FOREIGN PATENT DOCUMENTS

CN 1516783 A 7/2004
CN 101576069 A 11/2009
(Continued)

OTHER PUBLICATIONS

International Search Report and Written opinion (English and Chinese) issued in PCT/CN2017/099190, dated Dec. 1, 2017, 13 pages provided.

*Primary Examiner* — Donnell A Long
(74) *Attorney, Agent, or Firm* — Hamre, Schumann, Mueller & Larson, P.C.

(57) ABSTRACT

A three-stage variable color paste pump, comprising: a differential pump, which includes: a rodless cavity, a rod containing cavity, and a piston rod; configuring a control valve, which comprises a valve body and a valve core, wherein the valve body is provided with a rod containing cavity opening which is in communication with the rod containing cavity; configuring a rodless cavity opening as in communication with the rodless cavity, configuring a color paste tank opening as in communication with a color paste tank, and configuring an injection outlet; configuring a channel on the valve core, moving the valve core to different positions may form three communication structures. The pump uses one differential pump to achieve three-stage
(Continued)

injection output, thus ensuring the accuracy of the injection output of the color paste pump. The pump has a simple structure, takes up a small surface area, and is easy to use.

35 Claims, 37 Drawing Sheets

(51) Int. Cl.

| | |
|---|---|
| ***F04B 49/06*** | (2006.01) |
| ***F04B 23/06*** | (2006.01) |
| ***F04B 37/10*** | (2006.01) |
| ***F04B 49/22*** | (2006.01) |
| ***F04B 53/10*** | (2006.01) |
| *B01F 15/02* | (2006.01) |
| *B01F 15/04* | (2006.01) |

(52) U.S. Cl.
CPC ..... *F04B 49/22* (2013.01); *F04B 53/10* (2013.01); *B01F 15/0247* (2013.01); *B01F 15/0416* (2013.01)

(56) References Cited

FOREIGN PATENT DOCUMENTS

| | | | | |
|---|---|---|---|---|
| CN | 202560534 | U | | 11/2012 |
| CN | 104564630 | A | | 4/2015 |
| CN | 205386893 | U | * | 7/2016 |
| CN | 205386893 | U | | 7/2016 |

* cited by examiner

THREE-STAGE VARIABLE COLOR PASTE PUMP AND OPERATION METHOD THEREOF

FIELD OF THE INVENTION

The present invention belongs to the field of toning equipment, and in particular to a three-stage variable color paste pump and an operation method thereof.

BACKGROUND OF THE INVENTION

Toning has strict requirements on the amount of color paste. It is required that the error of the ejection amount of color paste should not exceed a certain percentage when a pump ejects a large amount of color paste, and the error of the ejection amount of color paste should not exceed a certain percentage when a small amount of color paste is ejected as well. However, an existing reciprocating pump for ejecting a large amount of color paste may cause a relatively large ejection deviation when ejecting a small amount of color paste due to the large ejection amount in a unit travel, even if a small deviation occurs on the pump travel, thus causing color abnormality and failing to meet the product demands. Therefore, as to the color paste ejection precision control standard of the toning equipment, the precision requirements of ejecting a small amount of color paste are lower than those of ejecting a large amount of color paste. The current solution is mainly to provide two color mixers at the same time, wherein one color mixer composed of a large pump is mainly responsible for ejecting a large amount of color paste, and the other color mixer composed of a small pump is responsible for ejecting a small amount of color paste. Although this can well solve the problem of controlling the amount of the pumped color paste, as the two color mixers are provided, a lot of money is spent, and a large space is also required, thereby being inconvenient to use, not meeting the needs of modern economic intensive production, and particularly unsuitable for use in storefronts; and another solution is to co-use a large pump with a large section cylinder and a small pump with a small section cylinder in parallel in the same pump and to arrange two pumping systems including one for ejection a large amount of color paste and the other for injecting a small amount of color paste, which also has the problems that the occupied space is relatively large, the structure is complex and the cost is high.

SUMMARY OF THE INVENTION

In order to overcome the shortcomings of the prior art, the present invention provides a three-stage variable color paste pump, which occupies a small space and has a small ejection amount deviation of color paste, and an operation method thereof.

The present invention adopts the following technical solution: a three-stage variable color paste pump includes a differential pump, the differential pump includes a rodless cavity, a rod containing cavity and a piston rod, a control valve is provided, the control valve includes a valve body and a valve core, the valve body is provided with a rod containing cavity opening for communicating with the rod containing cavity, is provided with a rodless cavity opening for communicating with the rodless cavity, is provided with a color paste bucket opening for communicating with a color paste bucket, and is provided with an ejection opening, a channel is arranged on the valve core, and the valve core is moved to different positions to form the following communication structures: at a position 1, the rodless cavity communicates with the ejection opening, and the rodless cavity communicates with the rod containing cavity; at a position 2, the rod containing cavity opening communicates with the ejection opening, and the rodless cavity communicates with the color paste bucket; and at a position 3, the rodless cavity communicates with the ejection opening, and the rod containing cavity communicates with the color paste bucket.

A position 4 of the communication structure is additionally arranged, in which both of the rodless cavity opening and the rod containing cavity opening communicate with the color paste bucket, and the ejection opening is closed.

An operation method of the above pump includes: (1) differentially ejecting a small amount of color paste, wherein at the position 1, during the ejection of the rodless cavity, the rodless cavity communicates with the ejection opening, and the rodless cavity communicates with the rod containing cavity; (2) ejecting a medium amount of color paste, wherein at the position 2, during the ejection of the rod containing cavity, the rod containing cavity opening communicates with the ejection opening, and the rodless cavity communicates with the color paste bucket; and (3) ejecting a large amount of color paste, wherein and at the position 3, during the ejection of the rodless cavity, the rodless cavity communicates with the ejection opening, and the rod containing cavity communicates with the color paste bucket.

An operation method of the above pump includes: (1) differentially ejecting a small amount of color paste, wherein at the position 4, when the second rodless cavity sucks in the color paste, both of the rodless cavity opening and the rod containing cavity opening communicate with the color paste bucket, at the position 1, during the ejection of the rodless cavity, the rodless cavity communicates with the ejection opening, and the rodless cavity communicates with the rod containing cavity; (2) ejecting a medium amount of color paste, wherein at the position 4, when the rod containing cavity sucks in the color paste, both of the rod containing cavity opening and the rodless cavity opening communicate with the color paste bucket, and at the position 2, during the ejection of the rod containing cavity, the rod containing cavity opening communicates with the ejection opening, and the rodless cavity communicates with the color paste bucket; and (3) ejecting a large amount of color paste, wherein at the position 4, when the second rodless cavity sucks in the color paste, both of the rodless cavity opening and the rod containing cavity opening communicate with the color paste bucket, and at the position 3, during the ejection of the rodless cavity, the rodless cavity communicates with the ejection opening, and the rod containing cavity communicates with the color paste bucket.

The control valve includes a first valve body and a first valve core, a first baffle is arranged in the first valve body to divide the first valve body into a first left cavity and a first right cavity, the first valve core is mainly composed of a first left valve piece and a first right valve piece, which are installed on both ends of a first rotating shaft, a first rod containing cavity opening is formed in the first left cavity, a first rodless cavity opening is formed in the first right cavity, a first left valve cover and a first right valve cover are respectively installed on the outer sides of the first left valve piece and the first right valve piece, the first left valve cover is provided with a first ejection opening and a first color paste bucket opening, the first right valve cover is provided with a first channel E and a first channel F, the first valve core is rotated to different angular positions to form the following communication structures: at an angular position 1, the first rodless cavity opening communicates with a first channel C in the first right valve piece, the first channel C communicates with the first channel E, the first channel E communicates with the first ejection opening through a first channel I, the first ejection opening communicates with a first channel B, and the first channel B communicates with the first rod containing cavity opening; at an angular position 2, the first rod containing cavity opening communicates with the first ejection opening through a first channel A, the first rodless cavity opening communicates with the first channel F through a first channel D, and the first channel F communicates with the first color paste bucket opening through a first channel II; at an angular position 3, the first rodless cavity opening communicates with the first channel D, the first channel D communicates with the first channel E, the first channel E communicates with the first ejection opening through the first channel I, and the first rod containing cavity opening communicates with the first color paste bucket opening through the first channel A; and the first channel I and the first channel II are arranged in parallel.

An angular position 4 of the communication structure is additionally arranged, in which the first rodless cavity opening communicates with the first channel C in the first right valve piece, the first channel C communicates with the first channel F, and the first channel F communicates with the first color paste bucket opening through the first channel II; and the first rod containing cavity opening communicates with the first channel B in the first left valve piece and the first color paste bucket opening, and the first ejection opening is closed.

An operation method of the above pump includes: (1) differentially ejecting a small amount of color paste, wherein at the angular position 1, during the ejection of the first rodless cavity, the first rodless cavity opening communicates with the first channel C in the first right valve piece, the first channel C communicates with the first channel E, the first channel E communicates with the first ejection opening through the first channel I, the first ejection opening communicates with the first channel B, and the first channel B communicates with the first rod containing cavity opening; (2) ejecting a medium amount of color paste, wherein at the angular position 2, during the ejection of the first rod containing cavity, the first rod containing cavity opening communicates with the first ejection opening through the first channel A, the first rodless cavity opening communicates with the first channel F through the first channel D, and the first channel F communicates with the first color paste bucket opening through the first channel II; and (3) ejecting a large amount of color paste, wherein at the angular position 3, during the ejection of the first rodless cavity, the first rodless cavity opening communicates with the first channel D, the first channel D communicates with the first channel E, the first channel E communicates with the first ejection opening through the first channel I, and the first rod containing cavity opening communicates with the first color paste bucket opening through the first channel A.

An operation method of the above pump includes: (1) differentially ejecting a small amount of color paste, wherein at the angular position 4, when the first rodless cavity sucks in the color paste, the first rodless cavity opening communicates with the first channel C in the first right valve piece, the first channel C communicates with the first channel F, the first channel F communicates with the first color paste bucket opening through the first channel II, the first rod containing cavity opening communicates with the first channel B in the first left valve piece and the first color paste bucket opening, and the first ejection opening is closed, at the angular position 1, during the ejection of the first rodless cavity, the first rodless cavity opening communicates with the first channel C in the first right valve piece, the first channel C communicates with the first channel E, the first channel E communicates with the first ejection opening through the first channel I, the first ejection opening communicates with the first channel B, and the first channel B communicates with the first rod containing cavity opening; (2) ejecting a medium amount of color paste, wherein at the angular position 4, when the first rod containing cavity sucks in the color paste, the first rodless cavity opening communicates with the first channel C in the first right valve piece, the first channel C communicates with the first channel F, the first channel F communicates with the first color paste bucket opening through the first channel II, the first rod containing cavity opening communicates with the first channel B in the first left valve piece and the first color paste bucket opening, and the first ejection opening is closed, at the angular position 2, during the ejection of the first rod containing cavity, the first rod containing cavity opening communicates with the first ejection opening through the first channel A, the first rodless cavity opening communicates with the first channel F through the first channel D, and the first channel F communicates with the first color paste bucket opening through the first channel II; and (3) ejecting a large amount of color paste, wherein at the angular position 4, when the first rodless cavity sucks in the color paste, the first rodless cavity opening communicates with the first channel C in the first right valve piece, the first channel C communicates with the first channel F, the first channel F communicates with the first color paste bucket opening through the first channel II, the first rod containing cavity opening communicates with the first channel B in the first left valve piece and the first color paste bucket opening, and the first ejection opening is closed, at the angular position 3, during the ejection of the first rodless cavity, the first rodless cavity opening communicates with the first channel D, the first channel D communicates with the first channel E, the first channel E communicates with the first ejection opening through the first channel I, and the first rod containing cavity opening communicates with the first color paste bucket opening through the first channel A.

The control valve includes a second valve body and a second valve core, a second baffle is arranged in the second valve body to divide the second valve body into a second left cavity and a second right cavity, the second valve core is mainly composed of a second left valve piece and a second right valve piece, which are installed on both ends of a second rotating shaft, a second rod containing cavity opening is formed in the second left cavity, a second rodless cavity opening is formed in the second right cavity, a second left valve cover and a second right valve cover are respectively installed on the outer sides of the second left valve piece and the second right valve piece, the second left valve cover is provided with a second ejection opening and a second color paste bucket opening, the second right valve cover is provided with a second channel E and a second channel F, the second valve core is rotated to different angular positions to form the following communication structures: at an angular position 1, the second rodless cavity opening communicates with a second channel C in the second right valve piece, the second channel C communicates with the second channel E, the second channel E communicates with the second ejection opening through a second channel I, the second ejection opening communicates with a second channel B, and the second channel B communicates with the second rod containing cavity opening; at an angular position 2, the second rod containing cavity opening communicates with the second ejection opening through a second channel A, the second rodless cavity opening communicates with the second channel F through a second channel D, and the second channel F communicates with the second color paste bucket opening through a second channel II; at an angular position 3, the second rodless cavity opening communicates with the second channel D, the second channel D communicates with the second channel E, the second channel E communicates with the second ejection opening through the second channel I, and the second rod containing cavity opening communicates with the second color paste bucket opening through the second channel A; and the second channel I and the second channel II are arranged in a crossing manner.

An angular position 4 of the communication structure is additionally arranged, in which the second rodless cavity opening communicates with the second channel C in the second right valve piece, the second channel C communicates with the second channel F, and the second channel F communicates with the second color paste bucket opening through the second channel II; and the second rod containing cavity opening communicates with the second channel B in the second left valve piece and the second color paste bucket opening, and the second ejection opening is closed.

An operation method of the above pump includes: (1) differentially ejecting a small amount of color paste, wherein at the angular position 1, during the ejection of the second rodless cavity, the second rodless cavity opening communicates with the second channel C in the second right valve piece, the second channel C communicates with the second channel E, the second channel E communicates with the second ejection opening through the second channel I, the second ejection opening communicates with the second channel B, and the second channel B communicates with the second rod containing cavity opening; (2) ejecting a medium amount of color paste, wherein at the angular position 2, during the ejection of the second rod containing cavity, the second rod containing cavity opening communicates with the second ejection opening through the second channel A, the second rodless cavity opening communicates with the second channel F through the second channel D, and the second channel F communicates with the second color paste bucket opening through the second channel II; and (3) ejecting a large amount of color paste, wherein at the angular position 3, during the ejection of the second rodless cavity, the second rodless cavity opening communicates with the second channel D, the second channel D communicates with the second channel E, the second channel E communicates with the second ejection opening through the second channel I, and the second rod containing cavity opening communicates with the second color paste bucket opening through the second channel A.

An operation method of the above pump includes: (1) differentially ejecting a small amount of color paste, wherein at the angular position 4, when the second rodless cavity sucks in the color paste, the second rodless cavity opening communicates with the second channel C in the second right valve piece, the second channel C communicates with the second channel F, the second channel F communicates with the second color paste bucket opening through the second channel II, the second rod containing cavity opening communicates with the second channel B in the second left valve piece and the second color paste bucket opening, and the second ejection opening is closed, at the angular position 1, during the ejection of the second rodless cavity, the second rodless cavity opening communicates with the second channel C in the second right valve piece, the second channel C communicates with the second channel E, the second channel E communicates with the second ejection opening through the second channel I, the second ejection opening communicates with the second channel B, and the second channel B communicates with the second rod containing cavity opening; (2) ejecting a medium amount of color paste, wherein at the angular position 4, when the second rod containing cavity sucks in the color paste, the second rodless cavity opening communicates with the second channel C in the second right valve piece, the second channel C communicates with the second channel F, the second channel F communicates with the second color paste bucket opening through the second channel II, the second rod containing cavity opening communicates with the second channel B in the second left valve piece and the second color paste bucket opening, and the second ejection opening is closed, at the angular position 2, during the ejection of the second rod containing cavity, the second rod containing cavity opening communicates with the second ejection opening through the second channel A, the second rodless cavity opening communicates with the second channel F through the second channel D, and the second channel F communicates with the second color paste bucket opening through the second channel II; and (3) ejecting a large amount of color paste, wherein at the angular position 4, when the second rodless cavity sucks in the color paste, the second rodless cavity opening communicates with the second channel C in the second right valve piece, the second channel C communicates with the second channel F, the second channel F communicates with the second color paste bucket opening through the second channel II, the second rod containing cavity opening communicates with the second channel B in the second left valve piece and the second color paste bucket opening, and the second ejection opening is closed, at the angular position 3, during the ejection of the second rodless cavity, the second rodless cavity opening communicates with the second channel D, the second channel D communicates with the second channel E, the second channel E communicates with the second ejection opening through the second channel I, and the second rod containing cavity opening communicates with the second color paste bucket opening through the second channel A.

The control valve includes a third valve body and a third valve core, the third valve body is provided with a third rodless cavity opening A, a third rod containing cavity opening A, a third rod containing cavity opening B, a third rodless cavity opening B and a third ejection opening, a third left cavity and a third right cavity are arranged in the third valve core, the third left cavity communicates with a third color paste bucket opening, and the third valve core is rotated to different angular positions to form the following communication structures: at an angular position 1, the third rodless cavity opening B communicates with a third channel F in the third valve core, the third channel F communicates with the third rod containing cavity opening B through a third channel H in the third valve core, and the third channel F communicates with the third ejection opening through a third channel I in the third valve core; at an angular position 2, the third rodless cavity opening A communicates with the third color paste bucket opening through a third channel D in the third valve core, and the third rod containing cavity opening B communicates with the third ejection opening through a third channel G and a third channel K in the third valve core; and at an angular position 3, the third rod containing cavity opening A communicates with the third color paste bucket opening through a third channel B in the third valve core, and the third rodless cavity opening B communicates with the third ejection opening through a third channel E and a third channel J in the third valve core.

An angular position 4 of the communication structure is additionally arranged, in which the third rod containing cavity opening A communicates with the third color paste bucket opening through a third channel A in the third valve core, the third rodless cavity opening A communicates with the third color paste bucket opening through a third channel C in the third valve core, and the third ejection opening is closed.

An operation method of the above pump includes: (1) differentially ejecting a small amount of color paste, wherein at the angular position 1, during the ejection of the third rodless cavity, the third rodless cavity opening B communicates with the third channel F in the third valve core, the third channel F communicates with the third rod containing cavity opening B through the third channel H in the third valve core, and the third channel F communicates with the third ejection opening through the third channel I in the third valve core; (2) ejecting a medium amount of color paste, wherein at the angular position 2, during the ejection of the third rod containing cavity, the third rodless cavity opening A communicates with the third color paste bucket opening through the third channel D in the third valve core, and the third rod containing cavity opening B communicates with the third ejection opening through the third channel G and the third channel K in the third valve core; and (3) ejecting a large amount of color paste, wherein at the angular position 3, during the ejection of the third rodless cavity, the third rod containing cavity opening A communicates with the third color paste bucket opening through the third channel B in the third valve core, and the third rodless cavity opening B communicates with the third ejection opening through the third channel E and the third channel J in the third valve core.

An operation method of the above pump includes: (1) differentially ejecting a small amount of color paste, wherein at the angular position 4, when the third rodless cavity sucks in the color paste, the third rod containing cavity opening A communicates with the third color paste bucket opening through the third channel A in the third valve core, the third rodless cavity opening A communicates with the third color paste bucket opening through the third channel C in the third valve core, and the third ejection opening is closed, at the angular position 1, during the ejection of the third rodless cavity, the third rodless cavity opening B communicates with the third channel F in the third valve core, the third channel F communicates with the third rod containing cavity opening B through the third channel H in the third valve core, and the third channel F communicates with the third ejection opening through the third channel I in the third valve core; (2) ejecting a medium amount of color paste, wherein at the angular position 4, when the third rod containing cavity sucks in the color paste, the third rod containing cavity opening A communicates with the third color paste bucket opening through the third channel A in the third valve core, the third rodless cavity opening A communicates with the third color paste bucket opening through the third channel C in the third valve core, and the third ejection opening is closed, at the angular position 2, during the ejection of the third rod containing cavity, the third rodless cavity opening A communicates with the third color paste bucket opening through the third channel D in the third valve core, and the third rod containing cavity opening B communicates with the third ejection opening through the third channel G and the third channel K in the third valve core; and (3) ejecting a large amount of color paste, wherein at the angular position 4, when the third rodless cavity sucks in the color paste, the third rod containing cavity opening A communicates with the third color paste bucket opening through the third channel A in the third valve core, the third rodless cavity opening A communicates with the third color paste bucket opening through the third channel C in the third valve core, and the third ejection opening is closed, at the angular position 3, during the ejection of the third rodless cavity, the third rod containing cavity opening A communicates with the third color paste bucket opening through the third channel B in the third valve core, and the third rodless cavity opening B communicates with the third ejection opening through the third channel E and the third channel J in the third valve core.

The control valve includes a fourth valve body and a fourth valve core, the fourth valve body is provided with a fourth rod containing cavity opening, a fourth rodless cavity opening A, a fourth rodless cavity opening B, a fourth rodless cavity opening C and a fourth ejection opening, the fourth rod containing cavity opening communicates with a fourth channel II through a fourth channel I, a fourth left cavity and a fourth right cavity are arranged in the fourth valve core, the fourth left cavity communicates with a fourth color paste bucket opening, and the fourth valve core is rotated to different angular positions to form the following communication structures: at an angular position 1, the fourth rodless cavity opening B communicates with the fourth channel II through a fourth channel D in the fourth valve core, and the fourth rodless cavity opening C communicates with the fourth ejection opening through a fourth channel G and a fourth channel E in the fourth valve core; at an angular position 2, the fourth rodless cavity opening B communicates with the fourth color paste bucket opening through a fourth channel K in the fourth valve core, the fourth rod containing cavity opening communicates with the fourth channel I, the fourth channel I communicates with the fourth channel II, and the fourth channel II communicates with the fourth ejection opening through a fourth channel H; and at an angular position 3, the fourth rod containing cavity opening communicates with the fourth channel I, the fourth channel I communicates with the fourth channel II, the fourth channel II communicates with the fourth color paste bucket opening through a fourth channel C, and the fourth rodless cavity opening C communicates with the fourth ejection opening through a fourth channel F and the fourth channel I in the fourth valve core.

An angular position 4 of the communication structure is additionally arranged, in which the fourth rodless cavity opening A communicates with the fourth color paste bucket opening through a fourth channel A in the fourth valve core, the fourth rod containing cavity opening communicates with the fourth channel I, the fourth channel I communicates with the fourth channel II, the fourth channel II communicates with the fourth color paste bucket opening through a fourth channel B in the fourth valve core, and the fourth ejection opening is closed.

An operation method of the above pump includes: (1) differentially ejecting a small amount of color paste, wherein at the angular position 1, during the ejection of the fourth rodless cavity, the fourth rodless cavity opening B communicates with the fourth channel II through the fourth channel D in the fourth valve core, and the fourth rodless cavity opening C communicates with the fourth ejection opening through the fourth channel G and the fourth channel E in the fourth valve core; (2) ejecting a medium amount of color paste, wherein at the angular position 2, during the ejection of the fourth rod containing cavity, the fourth rodless cavity opening B communicates with the fourth color paste bucket opening through the fourth channel K in the fourth valve core, the fourth rod containing cavity opening communicates with the fourth channel I, the fourth channel I communicates with the fourth channel II, and the fourth channel II communicates with the fourth ejection opening through the fourth channel H; and (3) ejecting a large amount of color paste, wherein at the angular position 3, during the ejection of the fourth rodless cavity, the fourth rod containing cavity opening communicates with the fourth channel I, the fourth channel I communicates with the fourth channel II, the fourth channel II communicates with the fourth color paste bucket opening through the fourth channel C, and the fourth rodless cavity opening C communicates with the fourth ejection opening through the fourth channel F and the fourth channel I in the fourth valve core.

An operation method of the above pump includes: (1) differentially ejecting a small amount of color paste, wherein at the angular position 4, when the fourth rodless cavity sucks in the color paste, the fourth rodless cavity opening A communicates with the fourth color paste bucket opening through the fourth channel A in the fourth valve core, the fourth rod containing cavity opening communicates with the fourth channel I, the fourth channel I communicates with the fourth channel II, the fourth channel II communicates with the fourth color paste bucket opening through the fourth channel B in the fourth valve core, and the fourth ejection opening is closed, at the angular position 1, during the ejection of the fourth rodless cavity, the fourth rodless cavity opening B communicates with the fourth channel II through the fourth channel D in the fourth valve core, and the fourth rodless cavity opening C communicates with the fourth ejection opening through the fourth channel G and the fourth channel E in the fourth valve core; (2) ejecting a medium amount of color paste, wherein at the angular position 4, when the fourth rod containing cavity sucks in the color paste, the fourth rodless cavity opening A communicates with the fourth color paste bucket opening through the fourth channel A in the fourth valve core, the fourth rod containing cavity opening communicates with the fourth channel I, the fourth channel I communicates with the fourth channel II, the fourth channel II communicates with the fourth color paste bucket opening through the fourth channel B in the fourth valve core, and the fourth ejection opening is closed, at the angular position 2, during the ejection of the fourth rod containing cavity, the fourth rodless cavity opening B communicates with the fourth color paste bucket opening through the fourth channel K in the fourth valve core, the fourth rod containing cavity opening communicates with the fourth channel I, the fourth channel I communicates with the fourth channel II, and the fourth channel II communicates with the fourth ejection opening through the fourth channel H; and (3) ejecting a large amount of color paste, wherein at the angular position 4, when the fourth rodless cavity sucks in the color paste, the fourth rodless cavity opening A communicates with the fourth color paste bucket opening through the fourth channel A in the fourth valve core, the fourth rod containing cavity opening communicates with the fourth channel I, the fourth channel I communicates with the fourth channel II, the fourth channel II communicates with the fourth color paste bucket opening through the fourth channel B in the fourth valve core, and the fourth ejection opening is closed, at the angular position 3, during the ejection of the fourth rodless cavity, the fourth rod containing cavity opening communicates with the fourth channel I, the fourth channel I communicates with the fourth channel II, the fourth channel II communicates with the fourth color paste bucket opening through the fourth channel C, and the fourth rodless cavity opening C communicates with the fourth ejection opening through the fourth channel F and the fourth channel I in the fourth valve core.

The control valve includes a fifth valve body, a fifth bonnet and a fifth valve core, the fifth bonnet is fixed on the fifth valve body, the fifth valve core is connected through a rotating shaft, a fifth cavity is formed between the fifth valve core and the fifth bonnet, the fifth valve body is provided with a fifth color paste bucket branch opening a, a fifth color paste bucket branch opening b, a fifth rod containing cavity branch opening b, a fifth rod containing cavity branch opening a and a fifth rodless cavity opening, the fifth color paste bucket branch opening a and the fifth color paste bucket branch opening b communicate with the fifth color paste bucket opening, the fifth rod containing cavity branch opening b communicates with the fifth rod containing cavity through a fifth channel I, the fifth rod containing cavity branch opening a communicates with the fifth rod containing cavity through a fifth channel II, a fifth ejection opening is formed in the fifth bonnet, the fifth cavity communicates with the fifth ejection opening, a channel is arranged on the fifth valve core, and the fifth valve core is rotated to different angular positions to form the following communication structures: at an angular position 1, the fifth rodless cavity opening communicates with the fifth cavity through a fifth channel E in the fifth valve core, the fifth rod containing cavity branch opening b communicates with the fifth cavity through a fifth channel F in the fifth valve core, and the fifth cavity communicates with the fifth ejection opening; at an angular position 2, the fifth rodless cavity opening communicates with the fifth color paste bucket branch opening b through a groove in the fifth valve core, and the fifth rod containing cavity branch opening b communicates with the fifth ejection opening through a fifth channel E in the fifth valve core; and at an angular position 3, the fifth rod containing cavity branch opening a communicates with the fifth color paste bucket branch opening a through the groove in the fifth valve core, and the fifth rodless cavity opening communicates with the fifth ejection opening through the fifth channel F.

A static valve piece is arranged between the fifth valve body and the fifth valve core, a fifth channel a, a fifth channel b, a fifth channel c and a fifth channel d are arranged in the static valve piece, the fifth channel a communicates with the fifth rodless cavity opening, the fifth channel b communicates with the fifth color paste bucket branch opening a and the fifth color paste bucket branch opening b, the fifth channel c communicates with the fifth rod containing cavity branch opening a, and the fifth channel d communicates with the fifth rod containing cavity branch opening b.

An operation method of the above pump includes: (1) differentially ejecting a small amount of color paste, wherein at the angular position 1, during the ejection of the fifth rodless cavity, the fifth rodless cavity opening communicates with the fifth cavity through the fifth channel E in the fifth valve core, the fifth rod containing cavity branch opening b communicates with the fifth cavity through the fifth channel F in the fifth valve core, and the fifth cavity communicates with the fifth ejection opening; (2) ejecting a medium amount of color paste, wherein at the angular position 2, during the ejection of the fifth rod containing cavity, the fifth rodless cavity opening communicates with the fifth color paste bucket branch opening b through the groove in the fifth valve core, and the fifth rod containing cavity branch opening b communicates with the fifth ejection opening through the fifth channel E in the fifth valve core; and (3) ejecting a large amount of color paste, wherein at the angular position 3, during the ejection of the fifth rodless cavity, the fifth rod containing cavity branch opening a communicates with the fifth color paste bucket branch opening a through the groove in the fifth valve core, and the fifth rodless cavity opening communicates with the fifth ejection opening through the fifth channel F.

The control valve includes a sixth valve body and a sixth valve core, the sixth valve body is provided with a sixth color paste bucket opening, a sixth ejection opening, a sixth rod containing cavity opening and a sixth rodless cavity opening, and the sixth valve core is rotated to different angular positions to form the following communication structures: at an angular position 1, the sixth rod containing cavity opening communicates with a sixth channel A, the sixth channel A communicates with a sixth channel B, the sixth channel B communicates with the sixth ejection opening, the sixth rodless cavity opening communicates with the sixth rod containing cavity opening through the sixth channel A, and the sixth rod containing cavity opening communicates with the sixth channel B; at an angular position 2, the sixth rod containing cavity opening communicates with the sixth ejection opening through a sixth channel C, and the sixth rodless cavity opening communicates with the sixth color paste bucket opening through a sixth channel D; and at an angular position 3, the sixth rodless cavity opening communicates with the sixth ejection opening through a sixth channel E, and the sixth rod containing cavity opening communicates with the sixth color paste bucket opening through a sixth channel F.

An angular position 4 of the communication structure is additionally arranged, in which the sixth rodless cavity opening communicates with a sixth channel H, the sixth channel H communicates with the sixth color paste bucket opening through a sixth channel I, and the sixth rod containing cavity opening communicates with the sixth color paste bucket opening through the sixth channel I.

An operation method of the above pump includes: (1) differentially ejecting a small amount of color paste, wherein at the angular position 1, during the ejection of the sixth rodless cavity, the sixth rod containing cavity opening communicates with the sixth channel A, the sixth channel A communicates with the sixth channel B, the sixth channel B communicates with the sixth ejection opening, the sixth rodless cavity opening communicates with the sixth rod containing cavity opening through the sixth channel A, and the sixth rod containing cavity opening communicates with the sixth channel B; (2) ejecting a medium amount of color paste, wherein at the angular position 2, during the ejection of the sixth rod containing cavity, the sixth rod containing cavity opening communicates with the sixth ejection opening through the sixth channel C, and the sixth rodless cavity opening communicates with the sixth color paste bucket opening through the sixth channel D; and (3) ejecting a large amount of color paste, wherein at the angular position 3, during the ejection of the sixth rodless cavity, the sixth rodless cavity opening communicates with the sixth ejection opening through the sixth channel E, and the sixth rod containing cavity opening communicates with the sixth color paste bucket opening through the sixth channel F.

An operation method of the above pump includes: (1) differentially ejecting a small amount of color paste, wherein at the angular position 4, when the sixth rodless cavity sucks in the color paste, the sixth rodless cavity opening communicates with the sixth channel H, the sixth channel H communicates with the sixth color paste bucket opening through the sixth channel I, and the sixth rod containing cavity opening communicates with the sixth color paste bucket opening through the sixth channel I, at the angular position 1, during the ejection of the sixth rodless cavity, the sixth rod containing cavity opening communicates with the sixth channel A, the sixth channel A communicates with the sixth channel B, the sixth channel B communicates with the sixth ejection opening, the sixth rodless cavity opening communicates with the sixth rod containing cavity opening through the sixth channel A, and the sixth rod containing cavity opening communicates with the sixth channel B; (2) ejecting a medium amount of color paste, wherein at the angular position 4, when the sixth rod containing cavity sucks in the color paste, and when the sixth rodless cavity sucks in the color paste, the sixth rodless cavity opening communicates with the sixth channel H, the sixth channel H communicates with the sixth color paste bucket opening through the sixth channel I, and the sixth rod containing cavity opening communicates with the sixth color paste bucket opening through the sixth channel I, at the angular position 2, during the ejection of the sixth rod containing cavity, the sixth rod containing cavity opening communicates with the sixth ejection opening through the sixth channel C, and the sixth rodless cavity opening communicates with the sixth color paste bucket opening through the sixth channel D; and (3) ejecting a large amount of color paste, wherein at the angular position 4, when the sixth rodless cavity sucks in the color paste, the sixth rodless cavity opening communicates with the sixth channel H, the sixth channel H communicates with the sixth color paste bucket opening through the sixth channel I, and the sixth rod containing cavity opening communicates with the sixth color paste bucket opening through the sixth channel I, at the angular position 3, during the ejection of the sixth rodless cavity, the sixth rodless cavity opening communicates with the sixth ejection opening through the sixth channel E, and the sixth rod containing cavity opening communicates with the sixth color paste bucket opening through the sixth channel F.

The control valve includes a seventh valve body and a seventh valve core, the seventh valve body is provided with a seventh rod containing cavity opening, a seventh rodless cavity opening, a seventh color paste bucket opening and a seventh ejection opening, and the seventh valve core is rotated to different positions to form the following communication structures: at the position 1, the seventh rod containing cavity opening communicates with a seventh channel B through a seventh channel A, and the seventh rodless cavity opening communicates with the seventh ejection opening through the seventh channel B; at the position 2, the seventh rodless cavity opening communicates with the seventh color paste bucket opening through a seventh channel E, and the seventh rod containing cavity opening communicates with the seventh ejection opening through a seventh channel F; and at the position 3, the seventh rod containing cavity opening communicates with the seventh color paste bucket opening through a seventh channel G, and the seventh rodless cavity opening communicates with the seventh ejection opening through a seventh channel H.

A position 4 of the communication structure is additionally arranged, in which the seventh rod containing cavity opening communicates with the seventh color paste bucket opening through a seventh channel C, and the seventh rodless cavity opening communicates with the seventh color paste bucket opening through a seventh channel D.

An operation method of the above pump includes: (1) differentially ejecting a small amount of color paste, wherein at the position 1, during the ejection of the seventh rodless cavity, the seventh rod containing cavity opening communicates with the seventh channel B through the seventh channel A, and the seventh rodless cavity opening communicates with the seventh ejection opening through the seventh channel B; (2) ejecting a medium amount of color paste, wherein at the position 2, during the ejection of the seventh rod containing cavity, the seventh rodless cavity opening communicates with the seventh color paste bucket opening through the seventh channel E, and the seventh rod containing cavity opening communicates with the seventh ejection opening through the seventh channel F; and (3) ejecting a large amount of color paste, wherein at the position 3, during the ejection of the seventh rodless cavity, the seventh rod containing cavity opening communicates with the seventh color paste bucket opening through the seventh channel G, and the seventh rodless cavity opening communicates with the seventh ejection opening through the seventh channel H.

An operation method of the above pump includes: (1) differentially ejecting a small amount of color paste, wherein at the position 4, when the seventh rodless cavity sucks in the color paste, the seventh rod containing cavity opening communicates with the seventh color paste bucket opening through the seventh channel C, and the seventh rodless cavity opening communicates with the seventh color paste bucket opening through the seventh channel D, at the position 1, during the ejection of the seventh rodless cavity, the seventh rod containing cavity opening communicates with the seventh channel B through the seventh channel A, and the seventh rodless cavity opening communicates with the seventh ejection opening through the seventh channel B; (2) ejecting a medium amount of color paste, wherein at the position 4, when the seventh rod containing cavity sucks in the color paste, the seventh rod containing cavity opening communicates with the seventh color paste bucket opening through the seventh channel C, and the seventh rodless cavity opening communicates with the seventh color paste bucket opening through the seventh channel D, at the position 2, during the ejection of the seventh rod containing cavity, the seventh rodless cavity opening communicates with the seventh color paste bucket opening through the seventh channel E, and the seventh rod containing cavity opening communicates with the seventh ejection opening through the seventh channel F; and (3) ejecting a large amount of color paste, wherein at the position 4, when the seventh rodless cavity sucks in the color paste, the seventh rod containing cavity opening communicates with the seventh color paste bucket opening through the seventh channel C, and the seventh rodless cavity opening communicates with the seventh color paste bucket opening through the seventh channel D, at the position 3, during the ejection of the seventh rodless cavity, the seventh rod containing cavity opening communicates with the seventh color paste bucket opening through the seventh channel G, and the seventh rodless cavity opening communicates with the seventh ejection opening through the seventh channel H.

The control valve includes an eighth valve body and an eighth valve core, the eighth valve body is provided with an eighth rod containing cavity opening, an eighth rodless cavity opening, an eighth color paste bucket opening and an eighth ejection opening, and the eighth valve core is rotated to different angular positions to form the following communication structures: at an angular position 1, the eighth rod containing cavity opening communicates with an eighth channel B through an eighth channel A, and the eighth rodless cavity opening communicates with the eighth ejection opening through the eighth channel B; at an angular position 2, the eighth rodless cavity opening communicates with the eighth color paste bucket opening through an eighth channel E, and the eighth rod containing cavity opening communicates with the eighth ejection opening through an eighth channel F; and at an angular position 3, the eighth rod containing cavity opening communicates with the eighth color paste bucket opening through an eighth channel G, and the eighth rodless cavity opening communicates with the eighth ejection opening through an eighth channel H.

An angular position 4 of the communication structure is additionally arranged, in which the eighth rod containing cavity opening communicates with the eighth color paste bucket opening through an eighth channel C, and the eighth rodless cavity opening communicates with the eighth color paste bucket opening through an eighth channel D.

An operation method of the above pump includes: (1) differentially ejecting a small amount of color paste, wherein at the angular position 1, the eighth rod containing cavity opening communicates with the eighth channel B through the eighth channel A, and the eighth rodless cavity opening communicates with the eighth ejection opening through the eighth channel B; (2) ejecting a medium amount of color paste, wherein at the angular position 2, during the ejection of the eighth rod containing cavity, the eighth rodless cavity opening communicates with the eighth color paste bucket opening through the eighth channel E, and the eighth rod containing cavity opening communicates with the eighth ejection opening through the eighth channel F; and (3) ejecting a large amount of color paste, wherein at the angular position 3, during the ejection of the eighth rodless cavity, the eighth rod containing cavity opening communicates with the eighth color paste bucket opening through the eighth channel G, and the eighth rodless cavity opening communicates with the eighth ejection opening through the eighth channel H.

An operation method of the above pump includes: (1) differentially ejecting a small amount of color paste, wherein at the angular position 4, when the eighth rodless cavity sucks in the color paste, the eighth rod containing cavity opening communicates with the eighth color paste bucket opening through the eighth channel C, and the eighth rodless cavity opening communicates with the eighth color paste bucket opening through the eighth channel D, at the angular position 1, the eighth rod containing cavity opening communicates with the eighth channel B through the eighth channel A, and the eighth rodless cavity opening communicates with the eighth ejection opening through the eighth channel B; (2) ejecting a medium amount of color paste, wherein at the angular position 4, when the eighth rod containing cavity sucks in the color paste, the eighth rod containing cavity opening communicates with the eighth color paste bucket opening through the eighth channel C, and the eighth rodless cavity opening communicates with the eighth color paste bucket opening through the eighth channel D, at the angular position 2, during the ejection of the eighth rod containing cavity, the eighth rodless cavity opening communicates with the eighth color paste bucket opening through the eighth channel E, and the eighth rod containing cavity opening communicates with the eighth ejection opening through the eighth channel F; and (3) ejecting a large amount of color paste, wherein at the angular position 4, when the eighth rodless cavity sucks in the color paste, the eighth rod containing cavity opening communicates with the eighth color paste bucket opening through the eighth channel C, and the eighth rodless cavity opening communicates with the eighth color paste bucket opening through the eighth channel D, at the angular position 3, during the ejection of the eighth rodless cavity, the eighth rod containing cavity opening communicates with the eighth color paste bucket opening through the eighth channel G, and the eighth rodless cavity opening communicates with the eighth ejection opening through the eighth channel H.

The present invention has the beneficial effects that three-stage ejection, that is, a large amount of ejection, a medium amount of ejection and a small amount of ejection, can be achieved by one differential pump, thereby ensuring the precision of the ejection amount of the color paste and particularly ensuring the ejection precision of a small amount of color paste, the precision is high, the structure is simple, the floor space is small, and the use is convenient; and a color mixer made by the pump is convenient to use and is small in floor space.

BRIEF DESCRIPTION OF THE DRAWINGS

FIG. 2-1 is a schematic diagram of a sectional structure of the second control valve.

FIG. 3-1 is a schematic diagram of a sectional structure of the third control valve.

FIG. 5-1 is a structural schematic diagram of the fifth control valve with a fifth bonnet removed.

FIG. 5-2 is a structural schematic diagram of a fifth valve body.

FIG. 5-3 is a structural schematic diagram of the fifth bonnet.

FIG. 5-4 is a structural schematic diagram of a static valve piece.

FIG. 5-5 is a structural schematic diagram of a fifth valve core.

FIG. 5*d* is a working schematic diagram when the fifth valve core is located at an angular position 4.

DETAILED DESCRIPTION OF THE EMBODIMENTS

Figure 1:
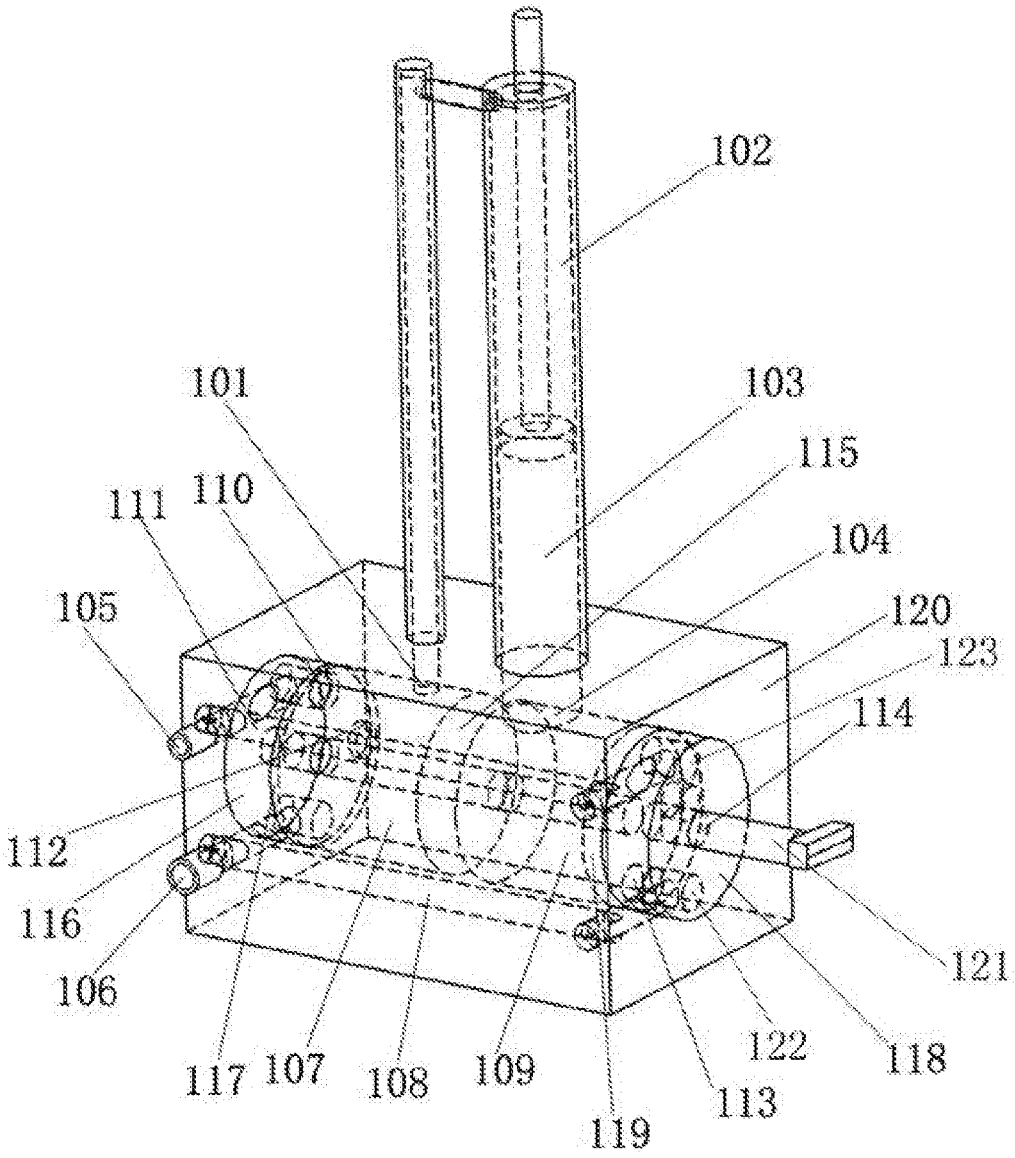
FIG. 1 is a structural schematic diagram of a first control valve.

A three-stage variable color paste pump includes a differential pump, the differential pump includes a rodless cavity, a rod containing cavity and a piston rod, a control valve is provided, the control valve includes a valve body and a valve core, the valve body is provided with a rod containing cavity opening for communicating with the rod containing cavity, is provided with a rodless cavity opening for communicating with the rodless cavity, is provided with a color paste bucket opening for communicating with a color paste bucket, and is provided with an ejection opening, a channel is arranged on the valve core, and the valve core is moved to different positions to form the following communication structures: at a position 1, the rodless cavity communicates with the ejection opening, and the rodless cavity communicates with the rod containing cavity; at a position 2, the rod containing cavity opening communicates with the ejection opening, and the rodless cavity communicates with the color paste bucket; and at a position 3, the rodless cavity communicates with the ejection opening, and the rod containing cavity communicates with the color paste bucket.

An operation method of the three-stage variable color paste pump includes: (1) differentially ejecting a small amount of color paste, wherein at the position 1, during the ejection of the rodless cavity, the rodless cavity communicates with the ejection opening, and the rodless cavity communicates with the rod containing cavity; (2) ejecting a medium amount of color paste, wherein at the position 2, during the ejection of the rod containing cavity, the rod containing cavity opening communicates with the ejection opening, and the rodless cavity communicates with the color paste bucket; and (3) ejecting a large amount of color paste, wherein and at the position 3, during the ejection of the rodless cavity, the rodless cavity communicates with the ejection opening, and the rod containing cavity communicates with the color paste bucket.

A position 4 of the communication structure is additionally arranged, in which both of the rodless cavity opening and the rod containing cavity opening communicate with the color paste bucket, and the ejection opening is closed.

An operation method of the three-stage variable color paste pump includes: (1) differentially ejecting a small amount of color paste, wherein at the position 4, when the second rodless cavity 203 sucks in the color paste, both of the rodless cavity opening and the rod containing cavity opening communicate with the color paste bucket, at the position 1, during the ejection of the rodless cavity, the rodless cavity communicates with the ejection opening, and the rodless cavity communicates with the rod containing cavity; (2) ejecting a medium amount of color paste, wherein at the position 4, when the rod containing cavity sucks in the color paste, both of the rod containing cavity opening and the rodless cavity opening communicate with the color paste bucket, and at the position 2, during the ejection of the rod containing cavity, the rod containing cavity opening communicates with the ejection opening, and the rodless cavity communicates with the color paste bucket; and (3) ejecting a large amount of color paste, wherein at the position 4, when the second rodless cavity sucks in the color paste, both of the rodless cavity opening and the rod containing cavity opening communicate with the color paste bucket, and at the position 3, during the ejection of the rodless cavity, the rodless cavity communicates with the ejection opening, and the rod containing cavity communicates with the color paste bucket.

The control valve achieves the above functions in a variety of forms.

Figure 1A:
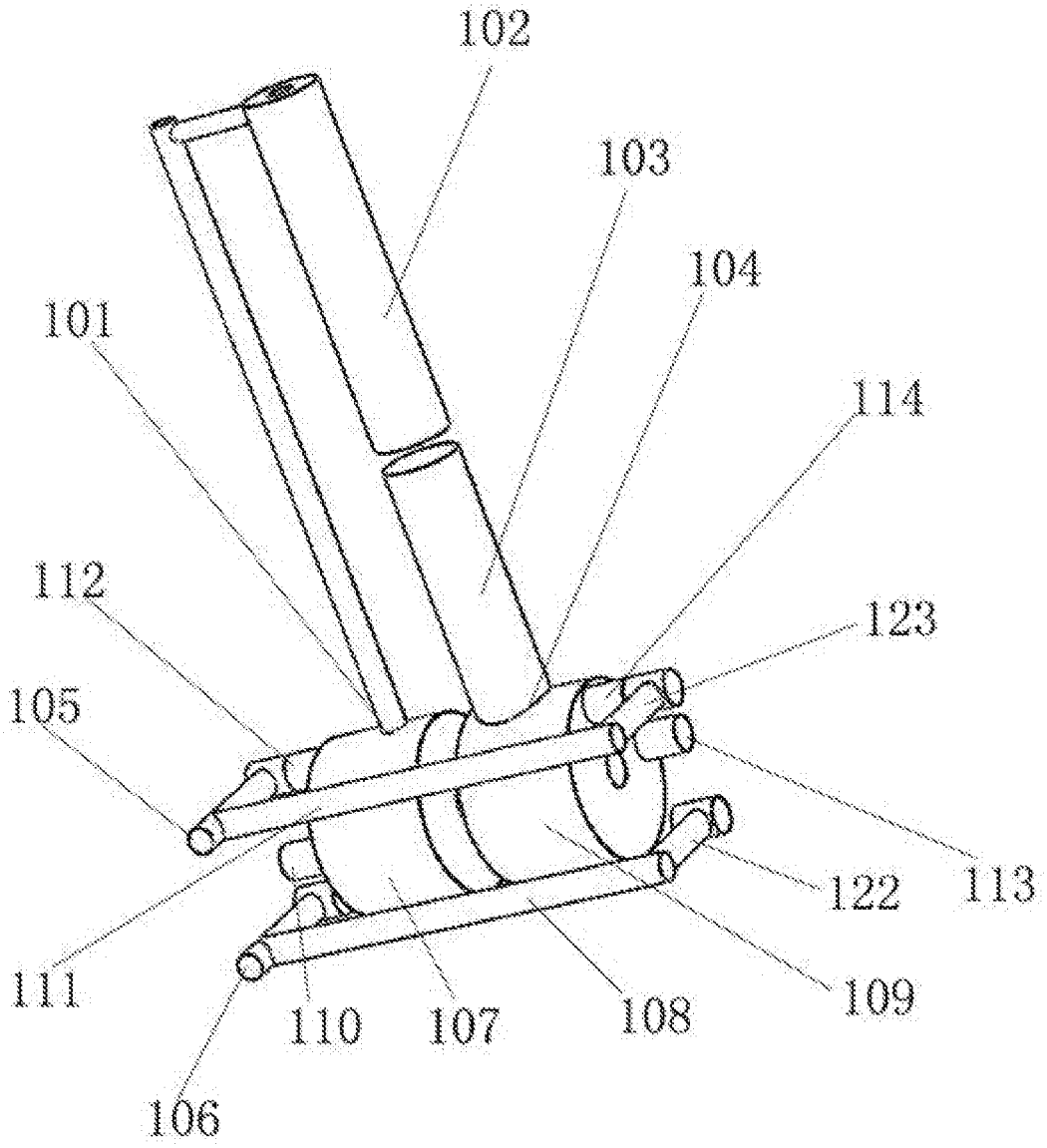
FIG. 1*a* is a working schematic diagram when a first valve core is located at an angular position 1.
Figure 1B:
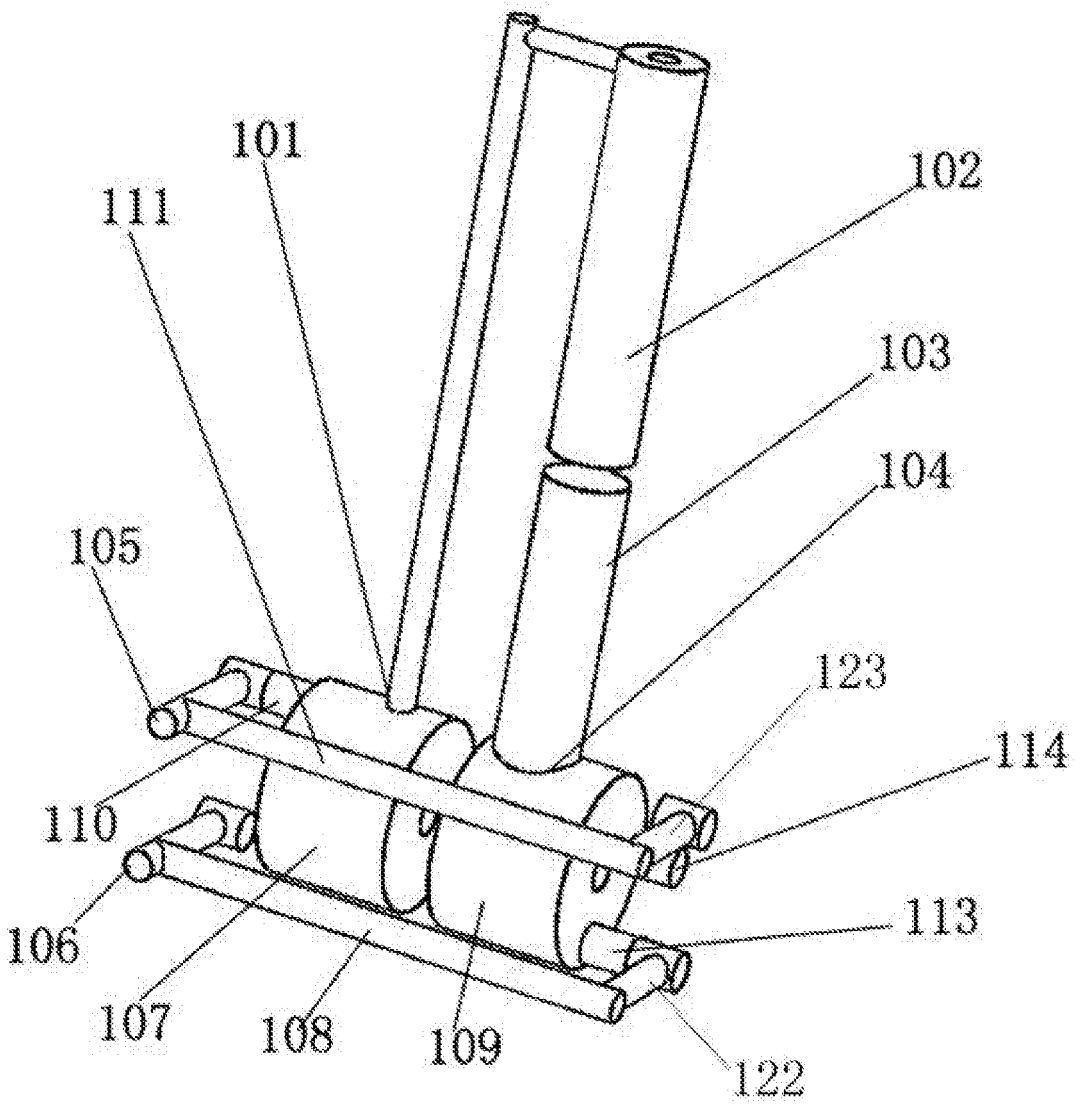
FIG. 1*b* is a working schematic diagram when the first valve core is located at an angular position 2.
Figure 1C:
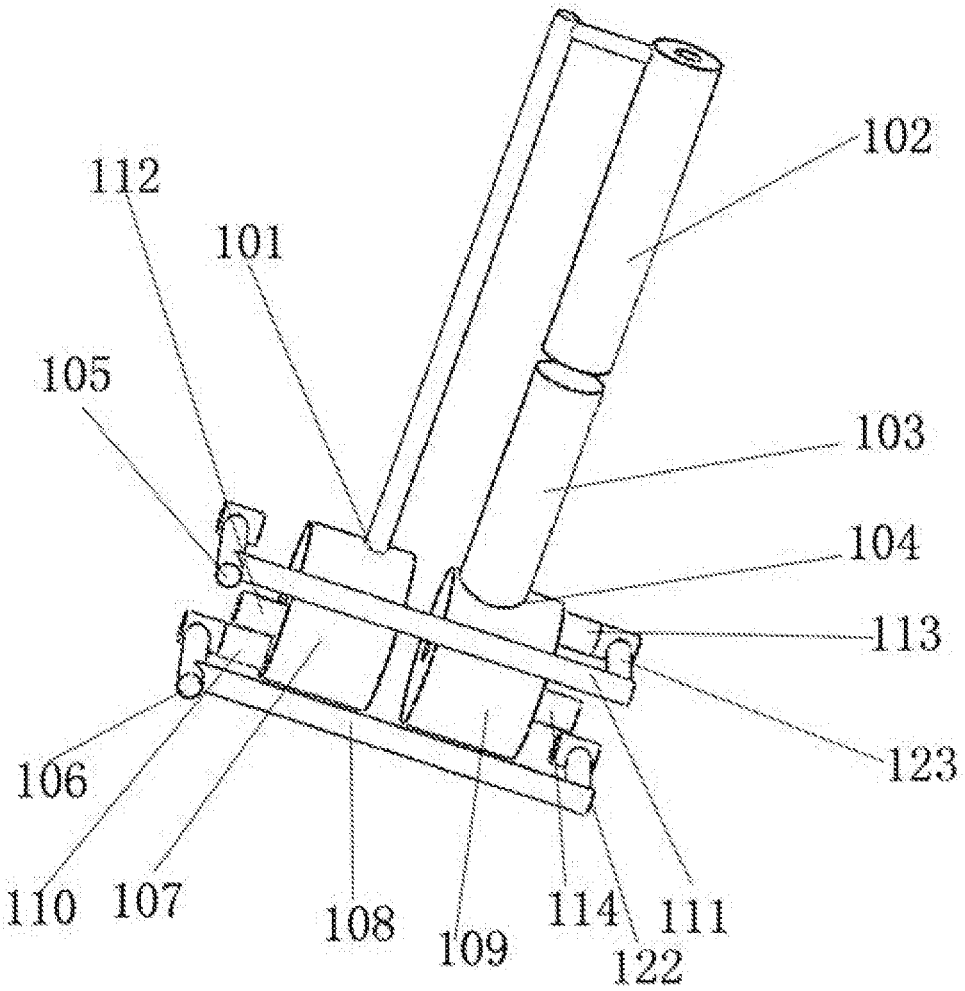
FIG. 1*c* is a working schematic diagram when the first valve core is located at an angular position 3.

As shown in FIG. 1, the control valve includes a first valve body 120 and a first valve core, a first baffle 115 is arranged in the first valve body 120 to divide the first valve body 120 into a first left cavity 107 and a first right cavity 109, the first valve core is mainly composed of a first left valve piece 117 and a first right valve piece 119, which are installed on both ends of a first rotating shaft 12, a first rod containing cavity opening 101 is formed in the first left cavity 107, a first rodless cavity opening 104 is formed in the first right cavity 109, a first left valve cover 116 and a first right valve cover 118 are respectively installed on the outer sides of the first left valve piece 117 and the first right valve piece 119, the first left valve cover 116 is provided with a first ejection opening 105 and a first color paste bucket opening 106, the first right valve cover 118 is provided with a first channel E 123 and a first channel F 122, the first valve core is rotated to different angular positions to form the following communication structures: a first channel I 111 and a first channel II are arranged in the first valve body 120, the first channel I 111 and the first channel II are arranged in parallel, the first channel I 111 always communicates with the first ejection opening 105, the first channel II always communicates with the first color paste bucket opening 106, the first rodless cavity opening 104 always communicates with the first right cavity 109, and the first rod containing cavity opening 101 always communicates with the first left cavity 107; as shown in FIG. 1*a*, at the angular position 1, the first rodless cavity opening 104 communicates with a first channel C 114 in the first right valve piece 119, the first channel C 114 communicates with the first channel E 123, the first channel E 123 communicates with the first ejection opening 105 through the first channel I 111, the first ejection opening 105 communicates with a first channel B 112, and the first channel B 112 communicates with the first rod containing cavity opening 101; as shown in FIG. 1*b*, at the angular position 2, the first rod containing cavity opening 101 communicates with the first ejection opening 105 through a first channel A 110, the first rodless cavity opening 104 communicates with the first channel F 122 through a first channel D 113, and the first channel F 122 communicates with the first color paste bucket opening 106 through the first channel II 108; and as shown in FIG. 1*c*, at the angular position 3, the first rodless cavity opening 104 communicates with the first channel D 113, the first channel D 113 communicates with the first channel E 123, the first channel E 123 communicates with the first ejection opening 105 through the first channel I 111, and the first rod containing cavity opening 101 communicates with the first color paste bucket opening 106 through the first channel A 110.

An operation method of the three-stage variable color paste pump includes: (1) differentially ejecting a small amount of color paste, wherein at the angular position 1, during the ejection of the first rodless cavity 103, the first rodless cavity opening 104 communicates with the first channel C 114 in the first right valve piece 119, the first channel C 114 communicates with the first channel E 123, the first channel E 123 communicates with the first ejection opening 105 through the first channel I 111, the first ejection opening 105 communicates with the first channel B 112, and the first channel B 112 communicates with the first rod containing cavity opening 101; (2) ejecting a medium amount of color paste, wherein at the angular position 2, during the ejection of the first rod containing cavity 102, the first rod containing cavity opening 101 communicates with the first ejection opening 105 through the first channel A 110, the first rodless cavity opening 104 communicates with the first channel F 122 through the first channel D 113, and the first channel F 122 communicates with the first color paste bucket opening 106 through the first channel II 108; and (3) ejecting a large amount of color paste, wherein at the angular position 3, during the ejection of the first rodless cavity 103, the first rodless cavity opening 104 communicates with the first channel D 113, the first channel D 113 communicates with the first channel E 123, the first channel E 123 communicates with the first ejection opening 105 through the first channel I 111, and the first rod containing cavity opening 101 communicates with the first color paste bucket opening 106 through the first channel A 110.

Figure 1D:
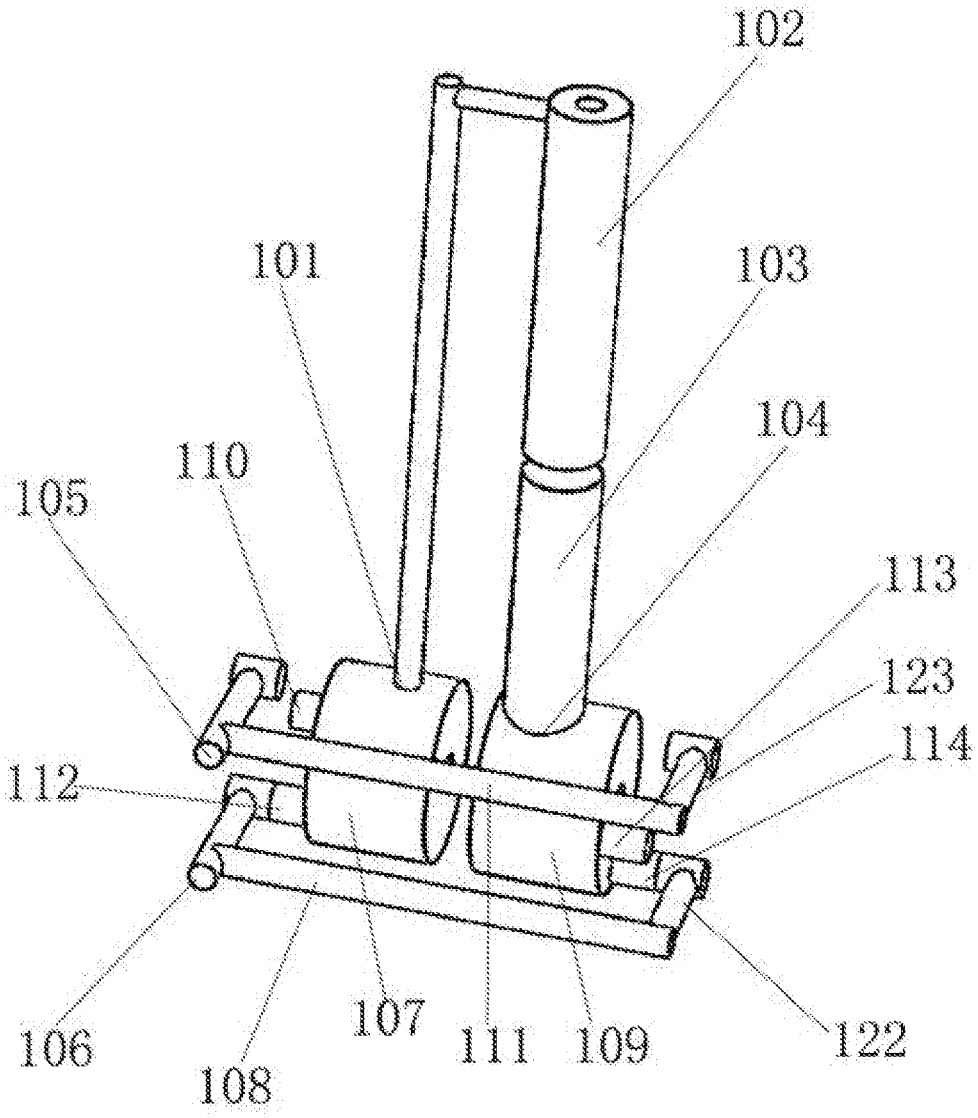
FIG. 1*d* is a working schematic diagram when the first valve core is located at an angular position 4.

As shown in FIG. 1*d*, an angular position 4 of the communication structure is additionally arranged, in which the first rodless cavity opening 104 communicates with the first channel C 114 in the first right valve piece 119, the first channel C 114 communicates with the first channel F 122, and the first channel F 122 communicates with the first color paste bucket opening 106 through the first channel II 108; and the first rod containing cavity opening 101 communicates with the first channel B 112 in the first left valve piece 117 and the first color paste bucket opening 106, and the first ejection opening 105 is closed.

An operation method of the three-stage variable color paste pump includes: (1) differentially ejecting a small amount of color paste, wherein at the angular position 4, when the first rodless cavity 103 sucks in the color paste, the first rodless cavity opening 14 communicates with the first channel C 114 in the first right valve piece 119, the first channel C 114 communicates with the first channel F 122, the first channel F 122 communicates with the first color paste bucket opening 106 through the first channel II 108, the first rod containing cavity opening 101 communicates with the first channel B 112 in the first left valve piece 117 and the first color paste bucket opening 106, and the first ejection opening 105 is closed, at the angular position 1, during the ejection of the first rodless cavity 103, the first rodless cavity opening 104 communicates with the first channel C 114 in the first right valve piece 119, the first channel C 114 communicates with the first channel E 123, the first channel E 123 communicates with the first ejection opening 105 through the first channel I 111, the first ejection opening 105 communicates with the first channel B 112, and the first channel B 112 communicates with the first rod containing cavity opening 101; (2) ejecting a medium amount of color paste, wherein at the angular position 4, when the first rod containing cavity 102 sucks in the color paste, the first rodless cavity opening 104 communicates with the first channel C 114 in the first right valve piece 119, the first channel C 114 communicates with the first channel F 122, the first channel F 122 communicates with the first color paste bucket opening 106 through the first channel II 108, the first rod containing cavity opening 101 communicates with the first channel B 112 in the first left valve piece 117 and the first color paste bucket opening 106, and the first ejection opening 105 is closed, at the angular position 2, during the ejection of the first rod containing cavity 102, the first rod containing cavity opening 101 communicates with the first ejection opening 105 through the first channel A 110, the first rodless cavity opening 104 communicates with the first channel F 122 through the first channel D 113, and the first channel F 122 communicates with the first color paste bucket opening 106 through the first channel II 108; and (3) ejecting a large amount of color paste, wherein at the angular position 4, when the first rodless cavity 103 sucks in the color paste, the first rodless cavity opening 104 communicates with the first channel C 114 in the first right valve piece 119, the first channel C 114 communicates with the first channel F 122, the first channel F 122 communicates with the first color paste bucket opening 106 through the first channel II 108, the first rod containing cavity opening 101 communicates with the first channel B 112 in the first left valve piece 117 and the first color paste bucket opening 106, and the first ejection opening 105 is closed, at the angular position 3, during the ejection of the first rodless cavity 103, the first rodless cavity opening 104 communicates with the first channel D 113, the first channel D 113 communicates with the first channel E 123, the first channel E 123 communicates with the first ejection opening 105 through the first channel I 111, and the first rod containing cavity opening 101 communicates with the first color paste bucket opening 106 through the first channel A 110.

Figure 2:
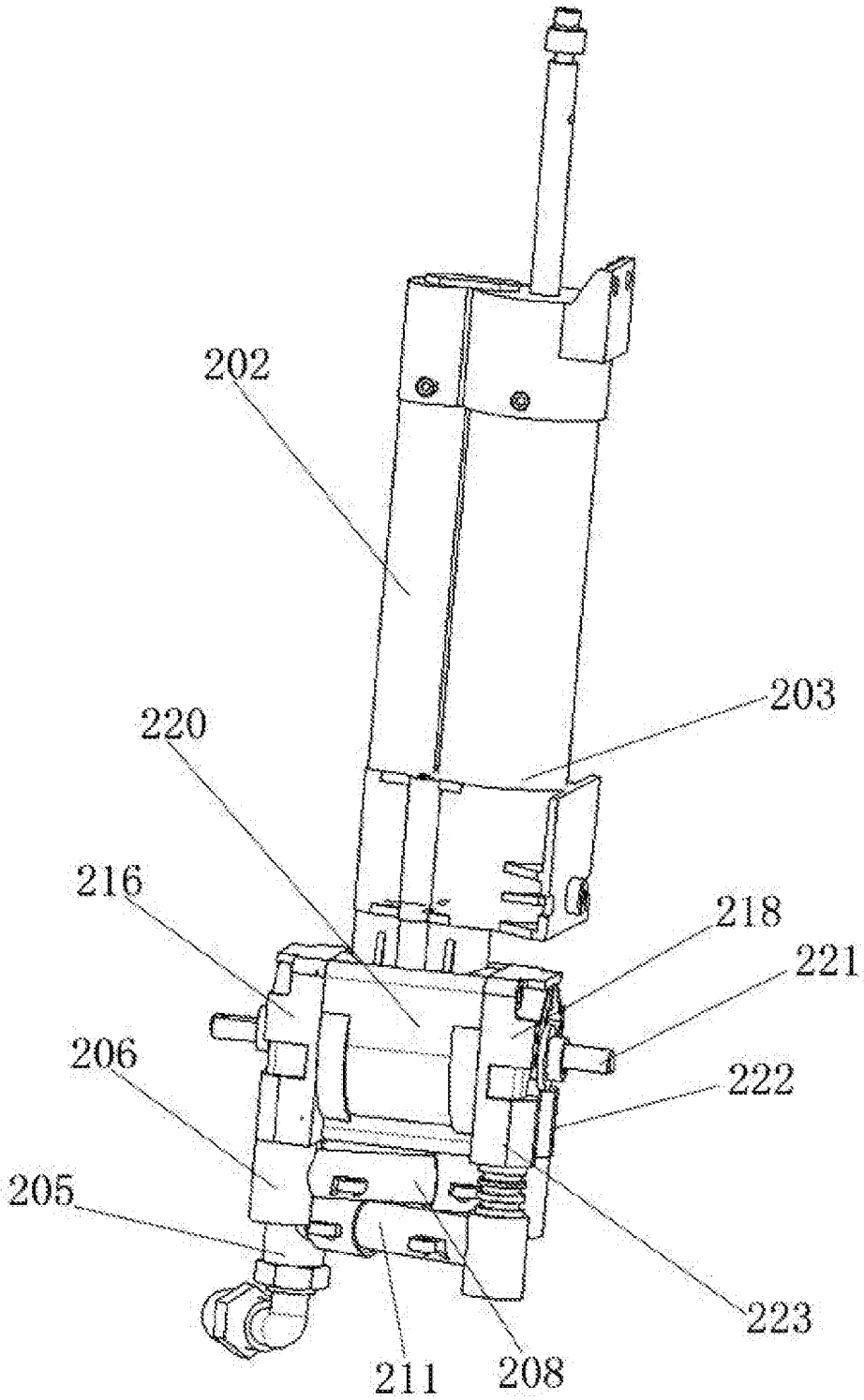
FIG. 2 is a structural schematic diagram of a second control valve.
Figures 1, 2:
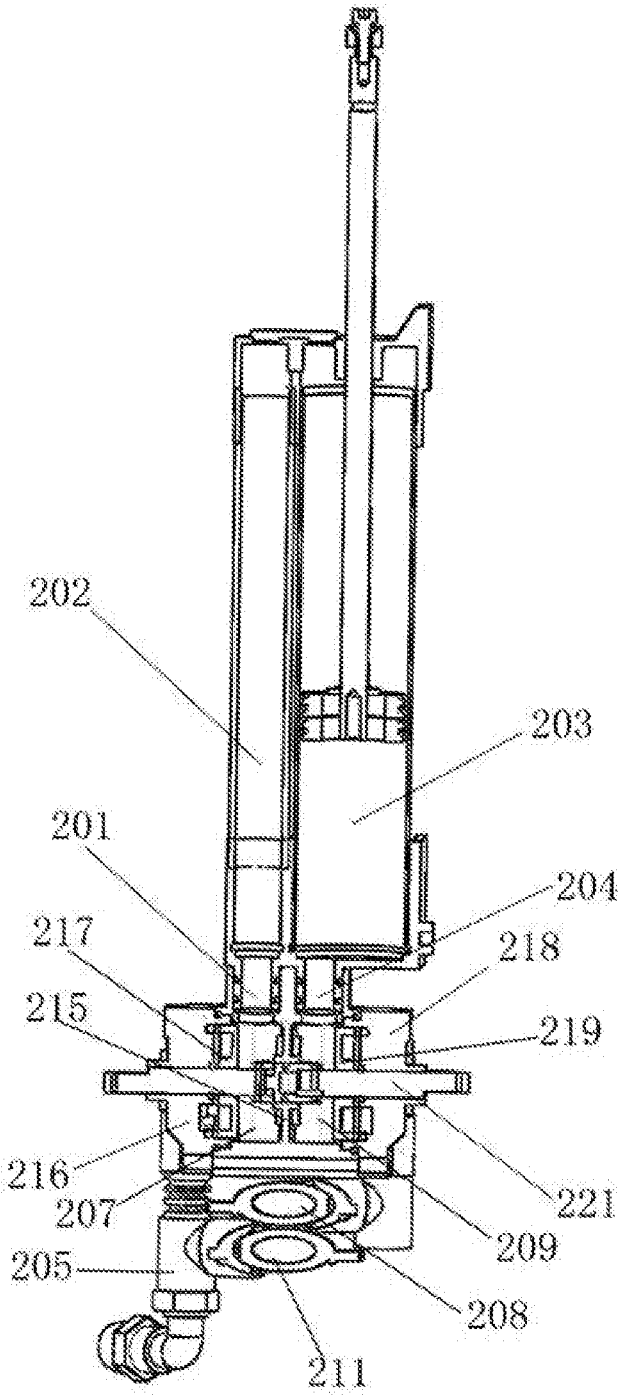
Figure 2A:
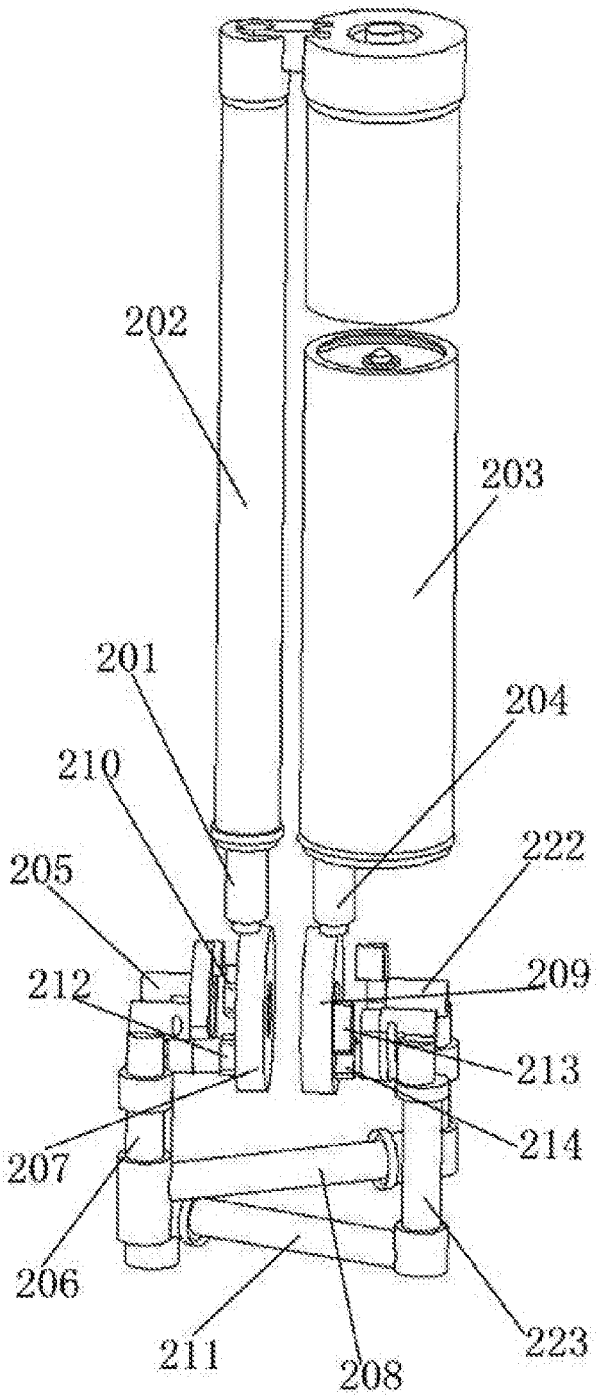
FIG. 2*a* is a working schematic diagram when a second valve core is located at an angular position 1.
Figure 2B:
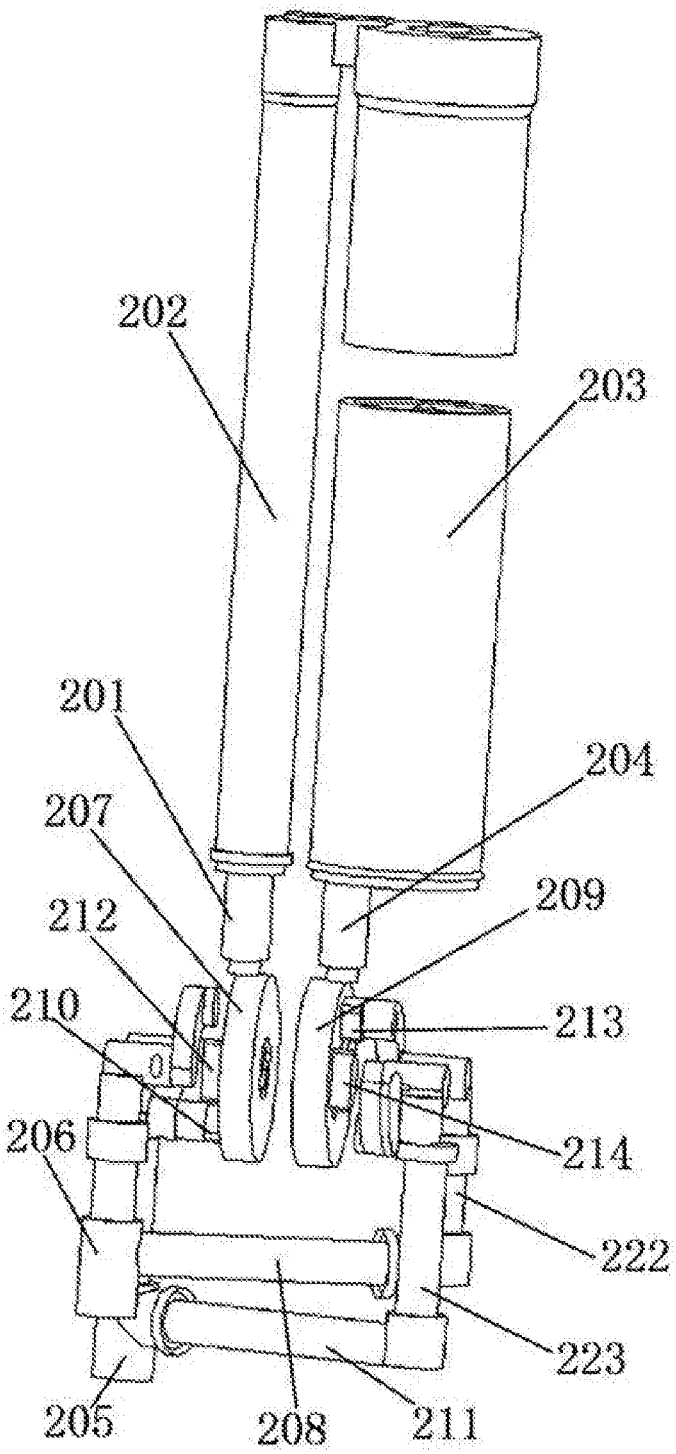
FIG. 2*b* is a working schematic diagram when the second valve core is located at an angular position 2.
Figure 2C:
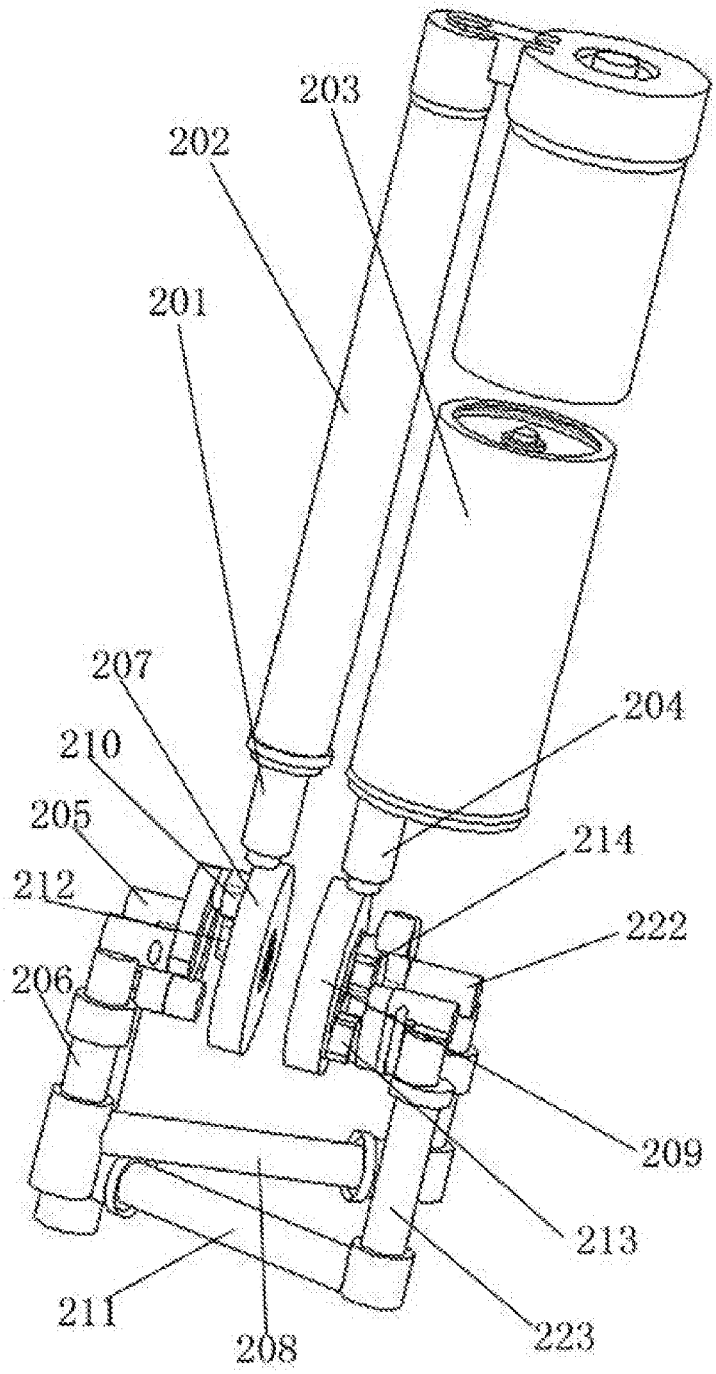
FIG. 2*c* is a working schematic diagram when the second valve core is located at an angular position 3.

As shown in FIG. 2 and FIG. 2-1, the control valve includes a second valve body 220 and a second valve core, a second baffle 215 is arranged in the second valve body 220 to divide the second valve body 220 into a second left cavity 207 and a second right cavity 209, the second valve core is mainly composed of a second left valve piece 217 and a second right valve piece 219, which are installed on both ends of a second rotating shaft 221, a second rod containing cavity opening 201 is formed in the second left cavity 207, a second rodless cavity opening 204 is formed in the second right cavity 209, a second left valve cover 216 and a second right valve cover 218 are respectively installed on the outer sides of the second left valve piece 217 and the second right valve piece 219, the second left valve cover 216 is provided with a second ejection opening 205 and a second color paste bucket opening 206, the second right valve cover 218 is provided with a second channel E 223 and a second channel F 222, the second valve core is rotated to different angular positions to form the following communication structures: a second channel I 211 and a second channel II 208 are arranged in a crossing manner, the second channel I 211 always communicates with the second ejection opening 205 and the second channel E 223, the second channel II 208 always communicates with the second color paste bucket opening 206 and the second channel F 222, and the second channel I 211 and the second channel II 208 are located at the outside of the second valve body 220; as shown in FIG. 2*a*, at the angular position 1, the second rodless cavity opening 204 communicates with a second channel C 214 in the second right valve piece 219, the second channel C 214 communicates with the second channel E 223, the second channel E 223 communicates with the second ejection opening 205 through the second channel I 211, the second ejection opening 205 communicates with a second channel B 212, and the second channel B 212 communicates with the second rod containing cavity opening 201; as shown in FIG. 2*b*, at the angular position 2, the second rod containing cavity opening 201 communicates with the second ejection opening 205 through a second channel A 210, the second rodless cavity opening 204 communicates with the second channel F 222 through a second channel D 213, and the second channel F 222 communicates with the second color paste bucket opening 206 through the second channel II 208; and as shown in FIG. 2*c*, at the angular position 3, the second rodless cavity opening 204 communicates with the second channel D 213, the second channel D 213 communicates with the second channel E 223, the second channel E 223 communicates with the second ejection opening 205 through the second channel I 211, and the second rod containing cavity opening 201 communicates with the second color paste bucket opening 206 through the second channel A 210.

An operation method of the three-stage variable color paste pump includes: (1) differentially ejecting a small amount of color paste, wherein at the angular position 1, during the ejection of the second rodless cavity 203, the second rodless cavity opening 24 communicates with the second channel C 214 in the second right valve piece 219, the second channel C 214 communicates with the second channel E 223, the second channel E 223 communicates with the second ejection opening 205 through the second channel I 211, the second ejection opening 205 communicates with the second channel B 212, and the second channel B 212 communicates with the second rod containing cavity opening 201; (2) ejecting a medium amount of color paste, wherein at the angular position 2, during the ejection of the second rod containing cavity 202, the second rod containing cavity opening 201 communicates with the second ejection opening 205 through the second channel A 210, the second rodless cavity opening 204 communicates with the second channel F 222 through the second channel D 213, and the second channel F 222 communicates with the second color paste bucket opening 206 through the second channel II 208; and (3) ejecting a large amount of color paste, wherein at the angular position 3, during the ejection of the second rodless cavity 203, the second rodless cavity opening 204 communicates with the second channel D 213, the second channel D 213 communicates with the second channel E 223, the second channel E 223 communicates with the second ejection opening 205 through the second channel I 2111, and the second rod containing cavity opening 201 communicates with the second color paste bucket opening 206 through the second channel A 210.

Figure 2D:
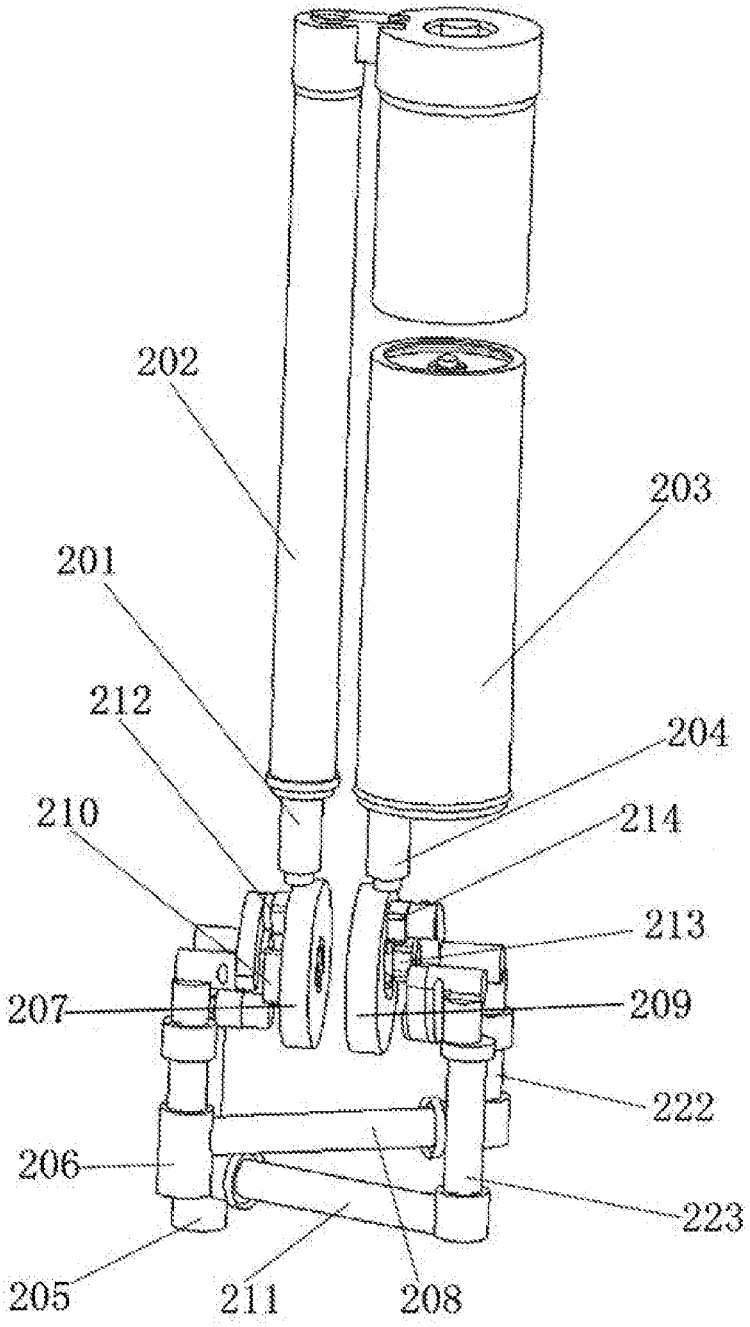
FIG. 2*d* is a working schematic diagram when the second valve core is located at an angular position 4.

As shown in FIG. 2*d*, an angular position 4 of the communication structure is additionally arranged, in which the second rodless cavity opening 204 communicates with the second channel C 214 in the second right valve piece 219, the second channel C 214 communicates with the second channel F 222, and the second channel F 222 communicates with the second color paste bucket opening 206 through the second channel II 208; and the second rod containing cavity opening 201 communicates with the second channel B 212 in the second left valve piece 217 and the second color paste bucket opening 206, and the second ejection opening 205 is closed.

An operation method of the three-stage variable color paste pump includes: (1) differentially ejecting a small amount of color paste, wherein at the angular position 4, when the second rodless cavity 203 sucks in the color paste, the second rodless cavity opening 204 communicates with the second channel C 214 in the second right valve piece 219, the second channel C 214 communicates with the second channel F 222, the second channel F 222 communicates with the second color paste bucket opening 206 through the second channel II 208, the second rod containing cavity opening 201 communicates with the second channel B 212 in the second left valve piece 217 and the second color paste bucket opening 206, and the second ejection opening 205 is closed, at the angular position 1, during the ejection of the second rodless cavity 203, the second rodless cavity opening 204 communicates with the second channel C 214 in the second right valve piece 219, the second channel C 214 communicates with the second channel E 223, the second channel E 223 communicates with the second ejection opening 205 through the second channel I 211, the second ejection opening 205 communicates with the second channel B 212, and the second channel B 212 communicates with the second rod containing cavity opening 201; (2) ejecting a medium amount of color paste, wherein at the angular position 4, when the second rod containing cavity 202 sucks in the color paste, the second rodless cavity opening 204 communicates with the second channel C 214 in the second right valve piece 219, the second channel C 214 communicates with the second channel F 222, the second channel F 222 communicates with the second color paste bucket opening 206 through the second channel II 208, the second rod containing cavity opening 201 communicates with the second channel B 212 in the second left valve piece 217 and the second color paste bucket opening 206, and the second ejection opening 205 is closed, at the angular position 2, during the ejection of the second rod containing cavity 202, the second rod containing cavity opening 201 communicates with the second ejection opening 205 through the second channel A 210, the second rodless cavity opening 204 communicates with the second channel F 222 through the second channel D 213, and the second channel F 222 communicates with the second color paste bucket opening 206 through the second channel II 208; and (3) ejecting a large amount of color paste, wherein at the angular position 4, when the second rodless cavity 203 sucks in the color paste, the second rodless cavity opening 204 communicates with the second channel C 214 in the second right valve piece 219, the second channel C 214 communicates with the second channel F 222, the second channel F 222 communicates with the second color paste bucket opening 206 through the second channel II 208, the second rod containing cavity opening 201 communicates with the second channel B 212 in the second left valve piece 217 and the second color paste bucket opening 206, and the second ejection opening 205 is closed, at the angular position 3, during the ejection of the second rodless cavity 203, the second rodless cavity opening 204 communicates with the second channel D 213, the second channel D 213 communicates with the second channel E 223, the second channel E 223 communicates with the second ejection opening 205 through the second channel I 211, and the second rod containing cavity opening 201 communicates with the second color paste bucket opening 206 through the second channel A 210.

Figure 3:
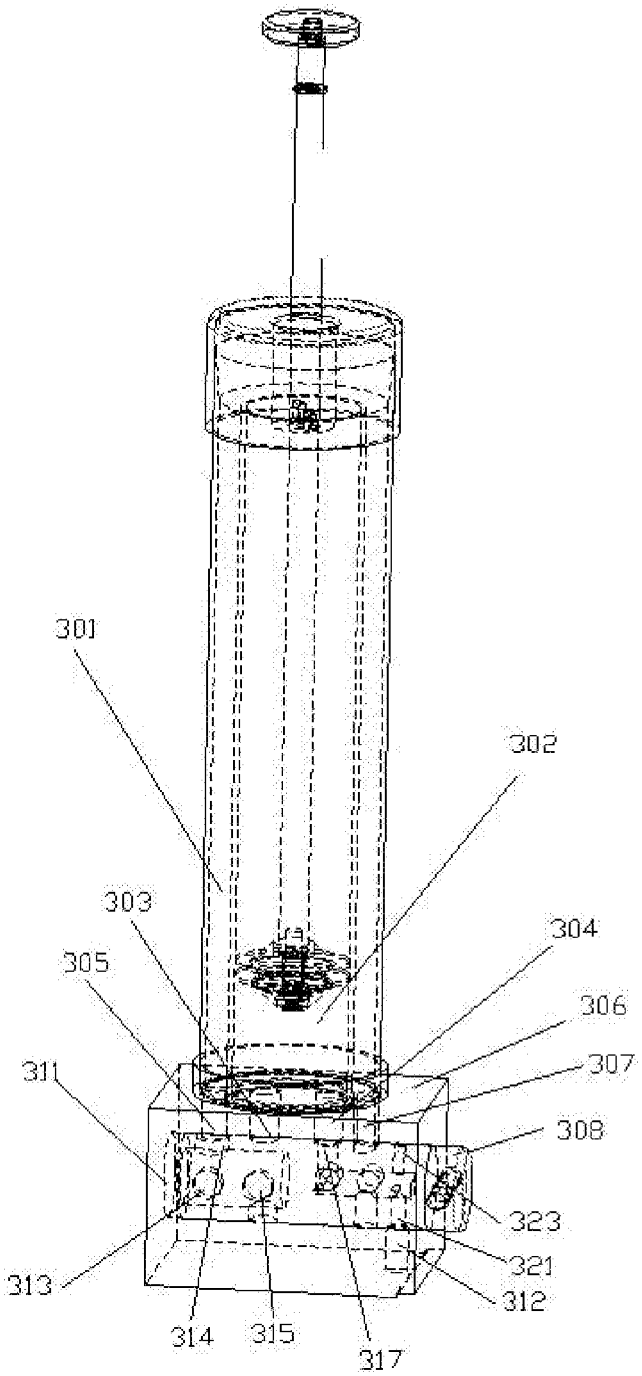
FIG. 3 is a structural schematic diagram of a third control valve.
Figures 1, 3:
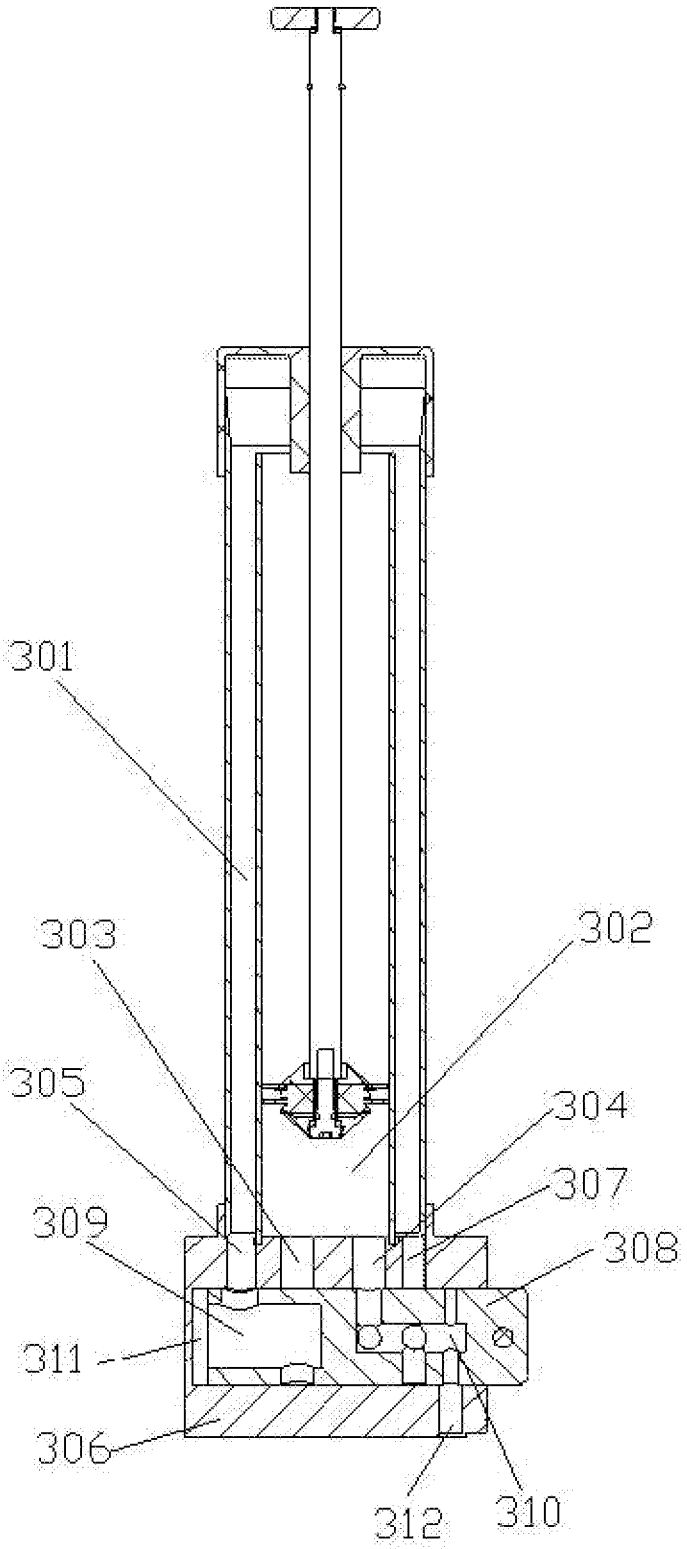
Figure 3A:
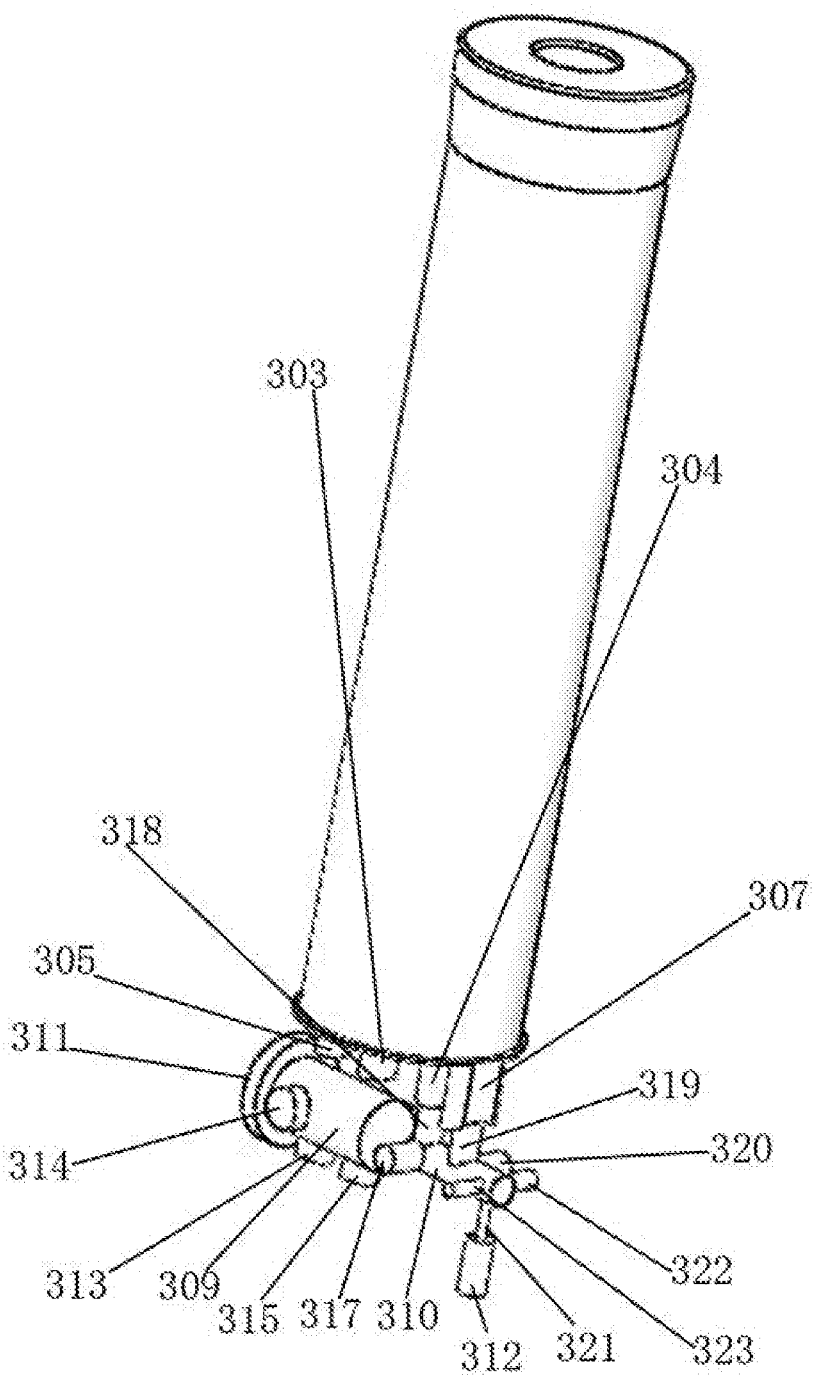
FIG. 3*a* is a working schematic diagram when a third valve core is located at an angular position 1.
Figure 3B:
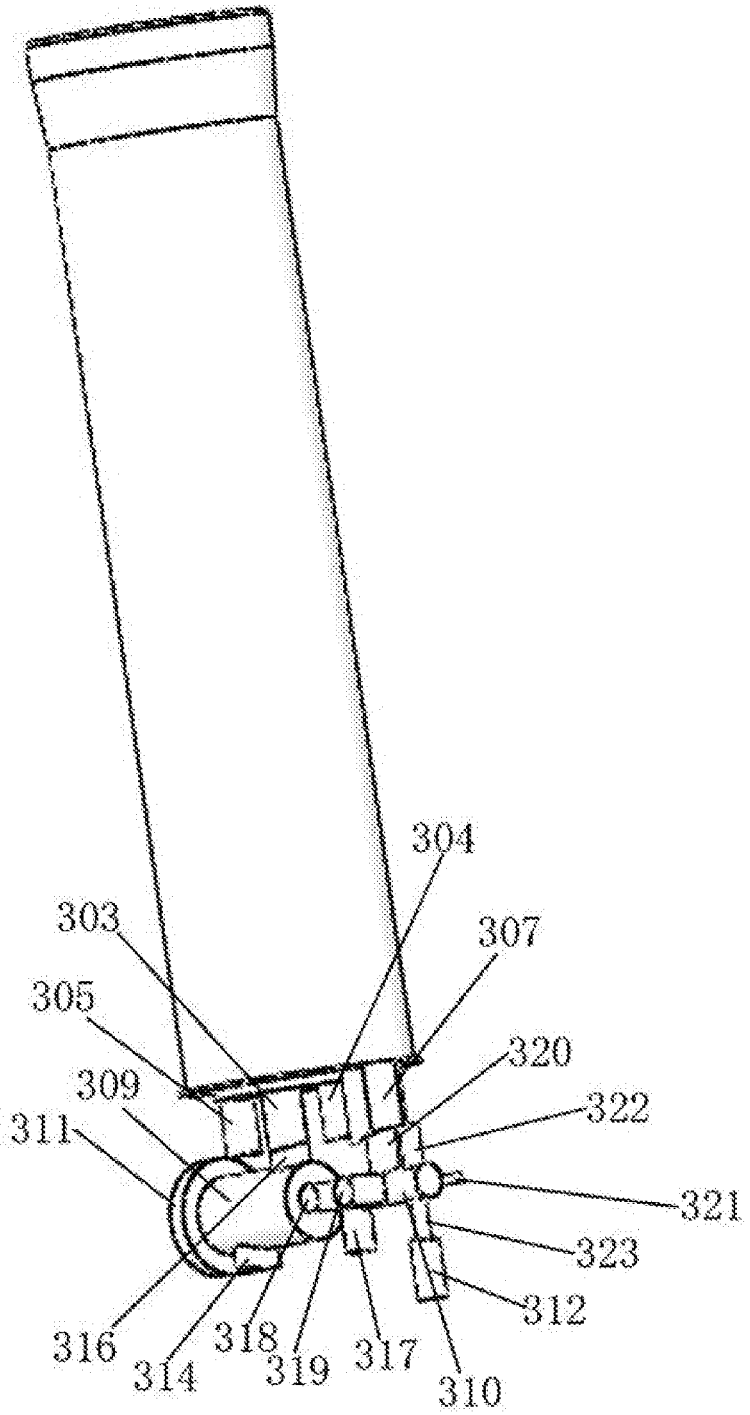
FIG. 3*b* is a working schematic diagram when the third valve core is located at an angular position 2.
Figure 3C:
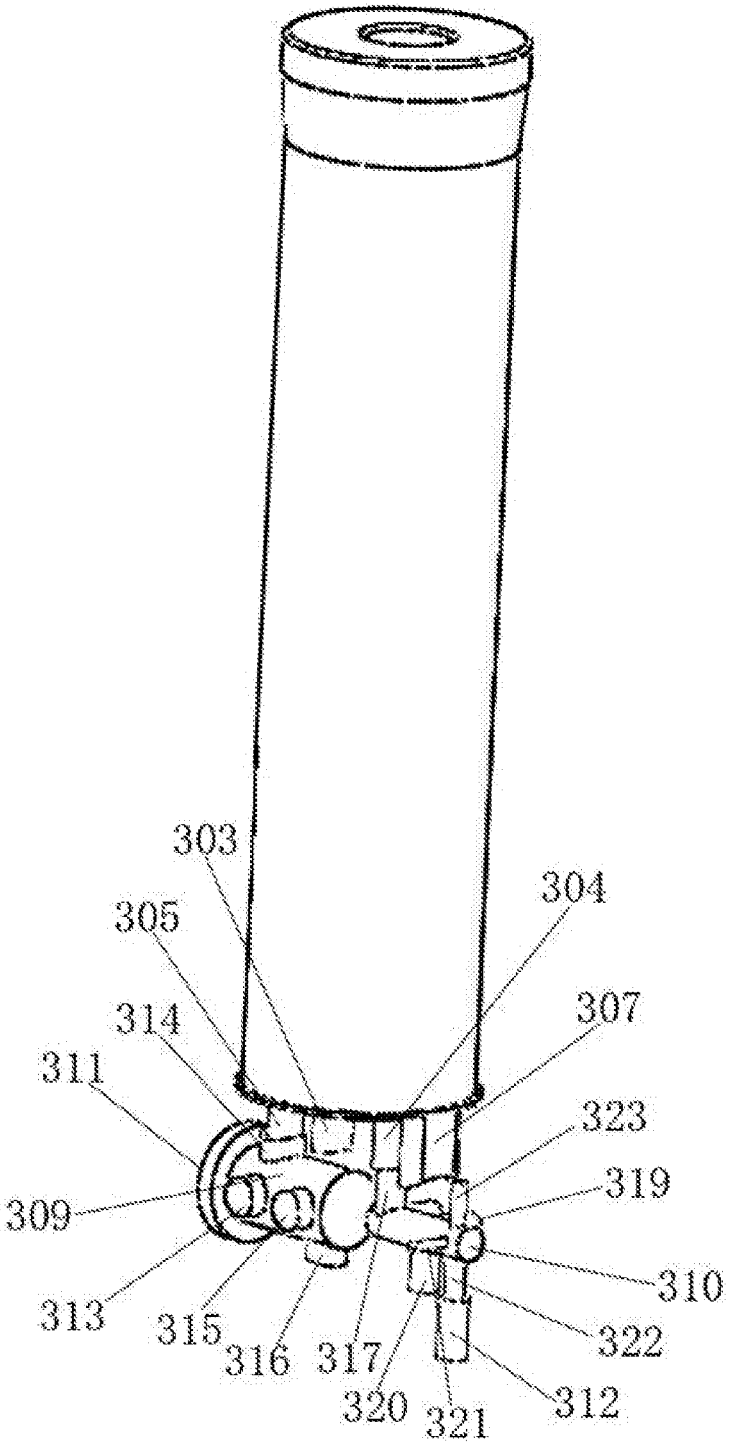
FIG. 3*c* is a working schematic diagram when the third valve core is located at an angular position 3.

As shown in FIG. 3 and FIG. 3-1, the control valve includes a third valve body 306 and a third valve core 308, the third valve core 308 is a drum valve core, the third valve body 306 is provided with a third rodless cavity opening A 303, a third rod containing cavity opening A 305, a third rod containing cavity opening B 307, a third rodless cavity opening B 304 and a third ejection opening 312, a third left cavity 309 and a third right cavity 310 are arranged in the third valve core 308, the third left cavity 309 communicates with a third color paste bucket opening 311, a third channel A 313, a third channel B 314, a third channel C 315 and a third channel D 316 communicating with the third left cavity 309 and a third channel E 317, a third channel F 318, a third channel G 320, a third channel H 319, a third channel I 321, a third channel J 322 and a third channel K 323 communicating with the third right cavity 310 are arranged in the third valve core 308, and the third valve core 308 is rotated to different angular positions to form the following communication structures: as shown in FIG. 3*a*, at the angular position 1, the third rodless cavity opening B 304 communicates with the third channel F 318 in the third valve core 308, the third channel F 318 communicates with the third rod containing cavity opening B 307 through the third channel H 319 in the third valve core 308, and the third channel F 318 communicates with the third ejection opening 312 through the third channel I 321 in the third valve core 308; as shown in FIG. 3*b*, at the angular position 2, the third rodless cavity opening A 303 communicates with the third color paste bucket opening 311 through the third channel D 316 in the third valve core 308, and the third rod containing cavity opening B 307 communicates with the third ejection opening 312 through the third channel G 320 and the third channel K 323 in the third valve core 308; and as shown in FIG. 3*c*, at the angular position 3, the third rod containing cavity opening A 305 communicates with the third color paste bucket opening 311 through the third channel B 314 in the third valve core 308, and the third rodless cavity opening B 304 communicates with the third ejection opening 312 through the third channel E 317 and the third channel J 322 in the third valve core 308.

An operation method of the above pump includes: (1) differentially ejecting a small amount of color paste, wherein at the angular position 1, during the ejection of the third rodless cavity 302, the third rodless cavity opening B 304 communicates with the third channel F 318 in the third valve core 308, the third channel F 318 communicates with the third rod containing cavity opening B 307 through the third channel H 319 in the third valve core 308, and the third channel F 318 communicates with the third ejection opening 312 through the third channel I 321 in the third valve core 308; (2) ejecting a medium amount of color paste, wherein at the angular position 2, during the ejection of the third rod containing cavity 301, the third rodless cavity opening A 303 communicates with the third color paste bucket opening 311 through the third channel D 316 in the third valve core 308, and the third rod containing cavity opening B 307 communicates with the third ejection opening 312 through the third channel G 320 and the third channel K 323 in the third valve core 308; and (3) ejecting a large amount of color paste, wherein at the angular position 3, during the ejection of the third rodless cavity 302, the third rod containing cavity opening A 305 communicates with the third color paste bucket opening 311 through the third channel B 314 in the third valve core 308, and the third rodless cavity opening B 304 communicates with the third ejection opening 312 through the third channel E 317 and the third channel J 322 in the third valve core 308.

Figure 3D:
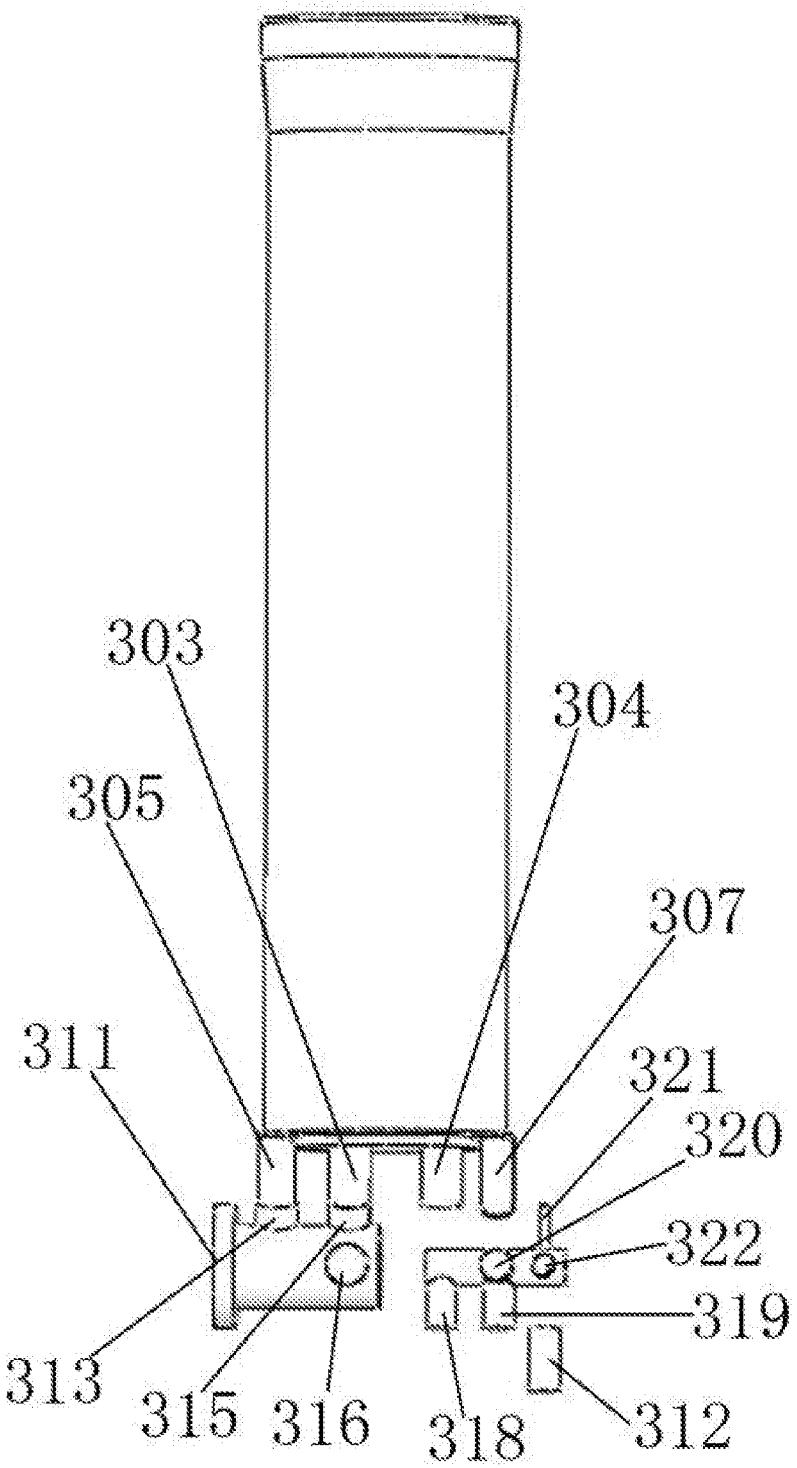
FIG. 3*d* is a working schematic diagram when the third valve core is located at an angular position 4.

As shown in FIG. 3*d*, an angular position 4 of the communication structure is additionally arranged, in which the third rod containing cavity opening A 305 communicates with the third color paste bucket opening 312 through a third channel A 313 in the third valve core 308, the third rodless cavity opening A 303 communicates with the third color paste bucket opening 311 through a third channel C 315 in the third valve core 308, and the third ejection opening 312 is closed.

An operation method of the three-stage variable color paste pump includes: (1) differentially ejecting a small amount of color paste, wherein at the angular position 4, when the third rodless cavity 302 sucks in the color paste, the third rod containing cavity opening A 305 communicates with the third color paste bucket opening 311 through the third channel A 313 in the third valve core 308, the third rodless cavity opening A 303 communicates with the third color paste bucket opening 311 through the third channel C 315 in the third valve core 308, and the third ejection opening 312 is closed, at the angular position 1, during the ejection of the third rodless cavity 302, the third rodless cavity opening B 304 communicates with the third channel F 318 in the third valve core 308, the third channel F 318 communicates with the third rod containing cavity opening B 307 through the third channel H 319 in the third valve core 308, and the third channel F 318 communicates with the third ejection opening 312 through the third channel I 321 in the third valve core 308; (2) ejecting a medium amount of color paste, wherein at the angular position 4, when the third rod containing cavity 301 sucks in the color paste, the third rod containing cavity opening A 305 communicates with the third color paste bucket opening 311 through the third channel A 313 in the third valve core 308, the third rodless cavity opening A 303 communicates with the third color paste bucket opening 311 through the third channel C 315 in the third valve core 308, and the third ejection opening 312 is closed, at the angular position 2, during the ejection of the third rod containing cavity 301, the third rodless cavity opening A 303 communicates with the third color paste bucket opening 311 through the third channel D 316 in the third valve core 308, and the third rod containing cavity opening B 307 communicates with the third ejection opening 312 through the third channel G 320 and the third channel K 323 in the third valve core 308; and (3) ejecting a large amount of color paste, wherein at the angular position 4, when the third rodless cavity 302 sucks in the color paste, the third rod containing cavity opening A 305 communicates with the third color paste bucket opening 311 through the third channel A 313 in the third valve core 308, the third rodless cavity opening A 303 communicates with the third color paste bucket opening 311 through the third channel C 315 in the third valve core 308, and the third ejection opening 312 is closed, at the angular position 3, during the ejection of the third rodless cavity 302, the third rod containing cavity opening A 305 communicates with the third color paste bucket opening 311 through the third channel B 314 in the third valve core 308, and the third rodless cavity opening B 304 communicates with the third ejection opening 312 through the third channel E 317 and the third channel J 322 in the third valve core 308.

Figure 4:
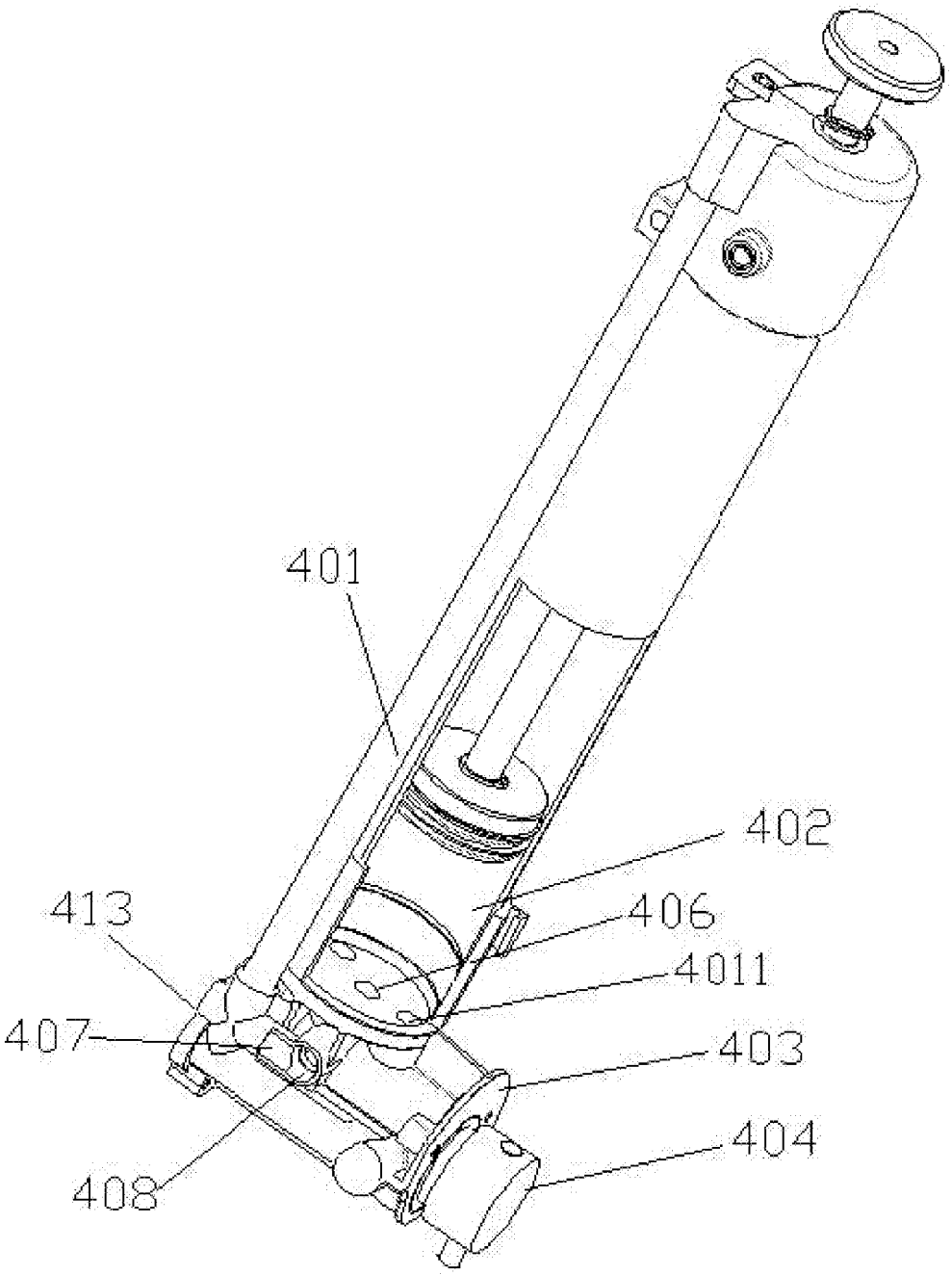
FIG. 4 is a structural schematic diagram of a fourth control valve.
Figure 4A:
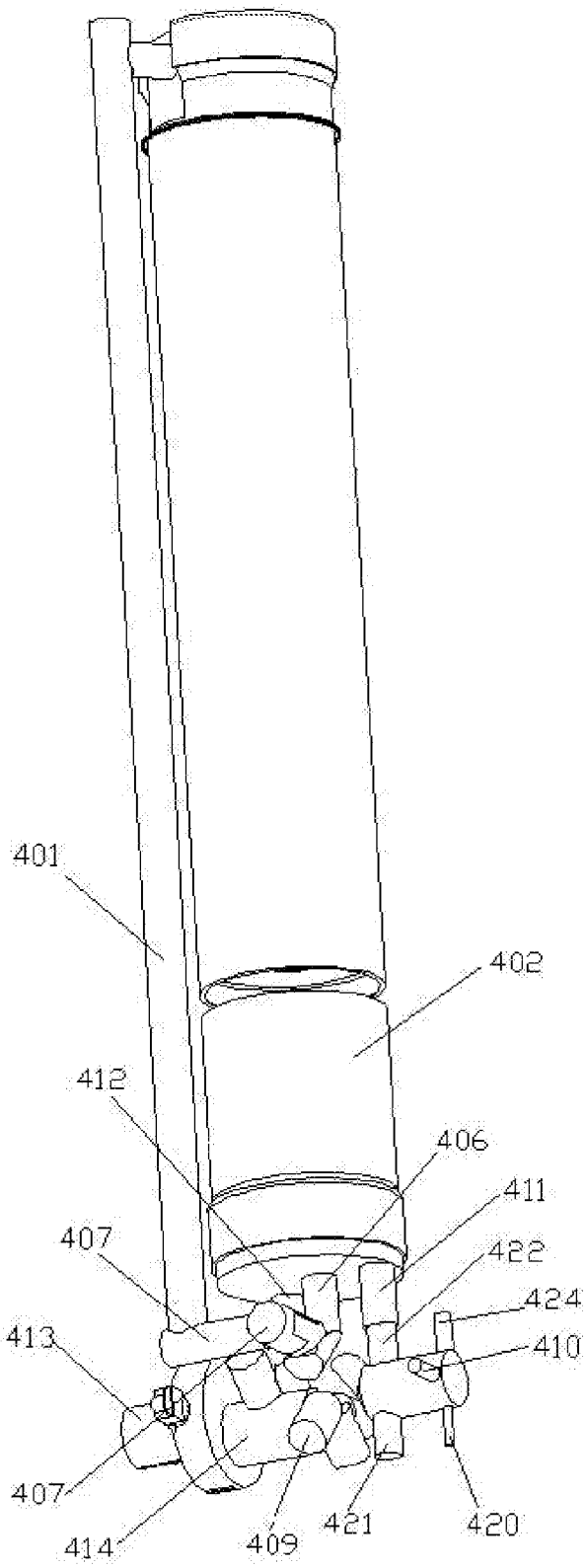
FIG. 4*a* is a working schematic diagram when a fourth valve core is located at an angular position 1.
Figure 4B:
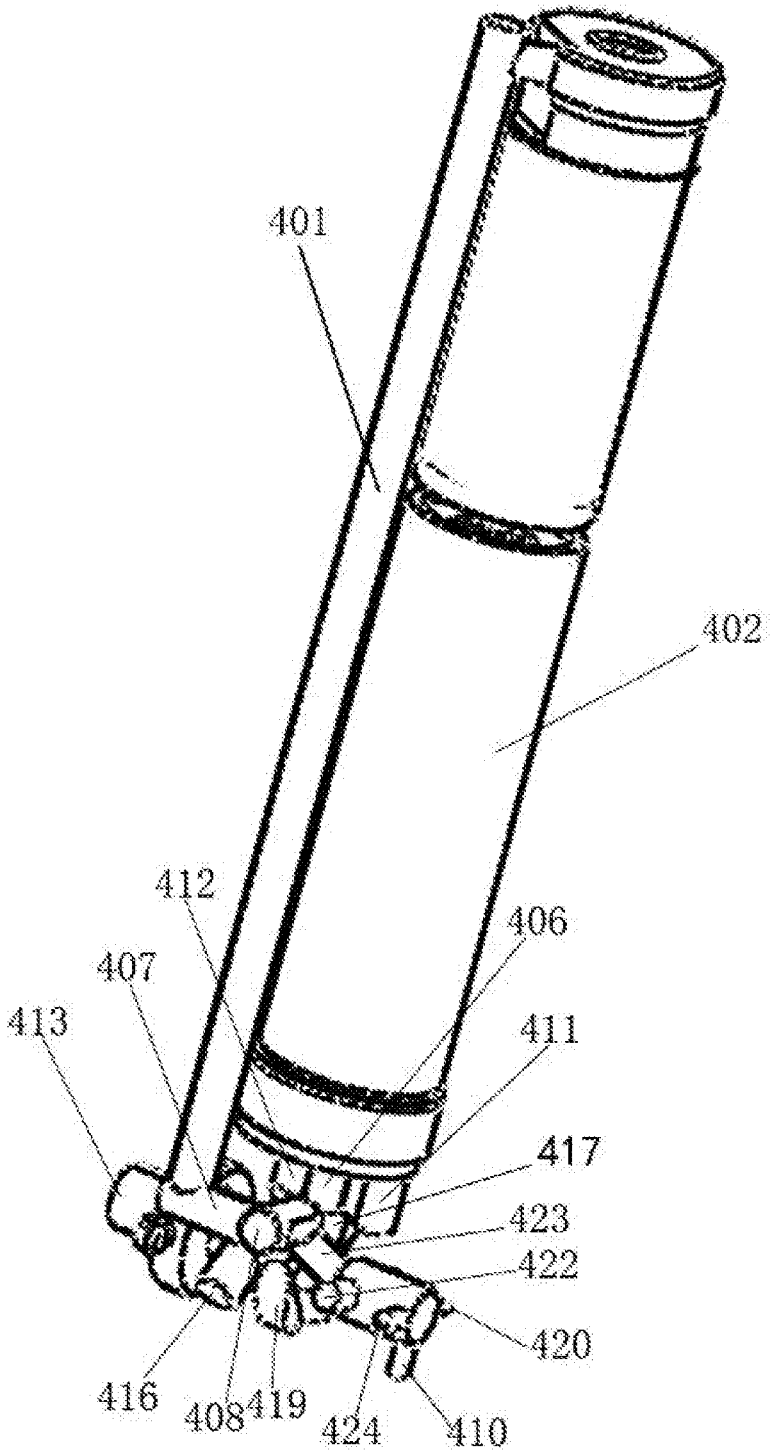
FIG. 4*b* is a working schematic diagram when the fourth valve core is located at an angular position 2.
Figure 4C:
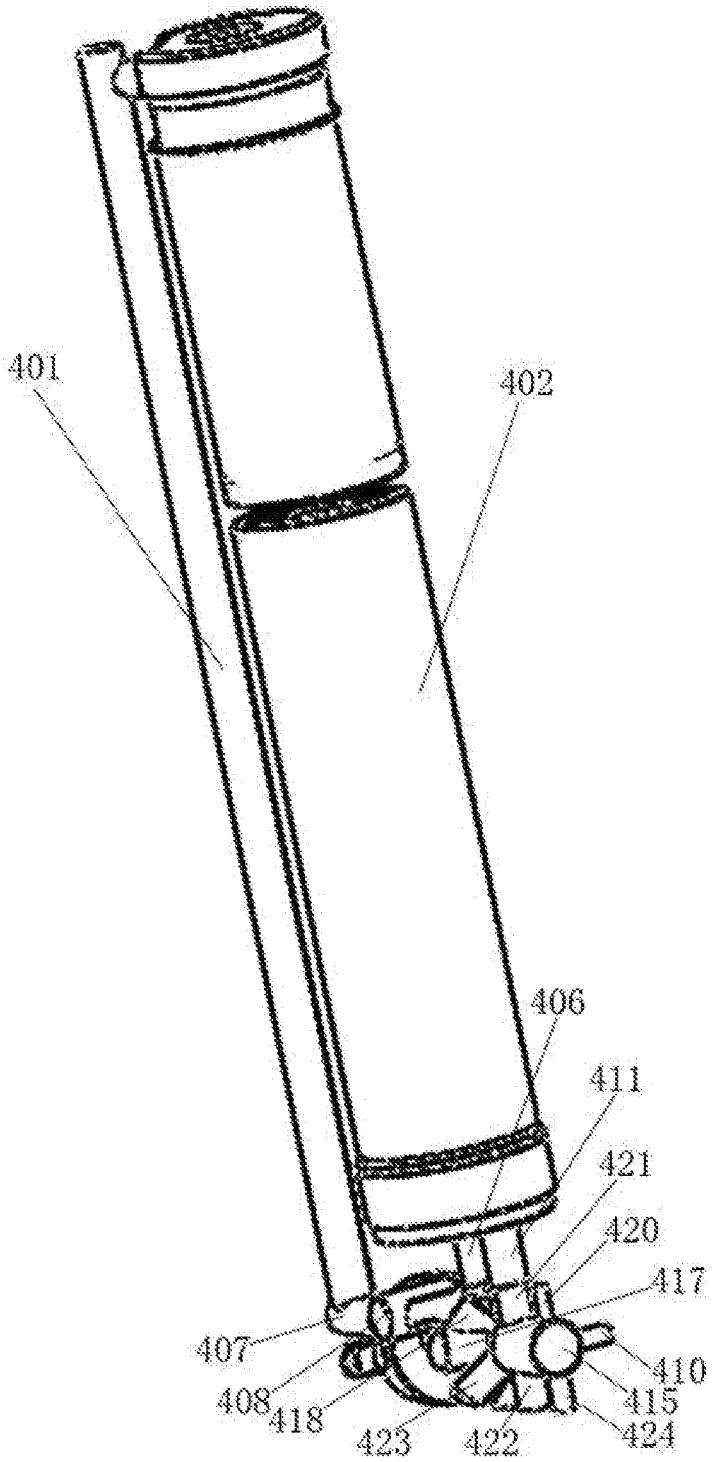
FIG. 4*c* is a working schematic diagram when the fourth valve core is located at an angular position 3.

As shown in FIG. 4, the control valve includes a fourth valve body 403 and a fourth valve core 404, the fourth valve body 403 is provided with a fourth rod containing cavity opening 405, a fourth rodless cavity opening A 412, a fourth rodless cavity opening B 406, a fourth rodless cavity opening C 411 and a fourth ejection opening, the fourth rod containing cavity opening 405 communicates with a fourth channel II 408 through a fourth channel I 407, a fourth left cavity 414 and a fourth right cavity 415 are arranged in the fourth valve core 404, the fourth left cavity 414 communicates with a fourth color paste bucket opening 413, a fourth channel A 416, a fourth channel B 409, a fourth channel C 418, a fourth channel H 423 and a fourth channel K 417 communicating with the fourth left cavity 414, and a fourth channel G 422, a fourth channel F 421, a fourth channel E 420, a fourth channel I 424 and a fourth channel J 410 communicating with the fourth right cavity 415 are arranged in the fourth valve core 404, and the fourth valve core 404 is rotated to different angular positions to form the following communication structures: as shown in FIG. 4*a*, at an angular position 1, the fourth rodless cavity opening B 406 communicates with the fourth channel II 408 through the fourth channel D 419 in the fourth valve core 404, and the fourth rodless cavity opening C 411 communicates with the fourth ejection opening through the fourth channel G 422 and the fourth channel E 420 in the fourth valve core 404; as shown in FIG. 4*b*, at an angular position 2, the fourth rodless cavity opening B 406 communicates with the fourth color paste bucket opening 413 through the fourth channel K 417 in the fourth valve core 404, the fourth rod containing cavity opening 405 communicates with the fourth channel I 407, the fourth channel I 407 communicates with the fourth channel II 408, and the fourth channel II 408 communicates with the fourth ejection opening through the fourth channel H 423; and as shown in FIG. 4*c*, at an angular position 3, the fourth rod containing cavity opening 405 communicates with the fourth channel I 407, the fourth channel I 407 communicates with the fourth channel II 408, the fourth channel II 408 communicates with the fourth color paste bucket opening 413 through the fourth channel C 418, and the fourth rodless cavity opening C 411 communicates with the fourth ejection opening through the fourth channel F 421 and the fourth channel I 424 in the fourth valve core 404.

An operation method of the three-stage variable color paste pump includes: (1) differentially ejecting a small amount of color paste, wherein at the angular position 1, during the ejection of the fourth rodless cavity 402, the fourth rodless cavity opening B 406 communicates with the fourth channel II 408 through the fourth channel D 419 in the fourth valve core 404, and the fourth rodless cavity opening C 411 communicates with the fourth ejection opening through the fourth channel G 422 and the fourth channel E 420 in the fourth valve core 404; (2) ejecting a medium amount of color paste, wherein at the angular position 2, during the ejection of the fourth rod containing cavity 401, the fourth rodless cavity opening B 406 communicates with the fourth color paste bucket opening 413 through the fourth channel K 417 in the fourth valve core 404, the fourth rod containing cavity opening 405 communicates with the fourth channel I 407, the fourth channel I 407 communicates with the fourth channel II 408, and the fourth channel II 408 communicates with the fourth ejection opening through the fourth channel H 423; and (3) ejecting a large amount of color paste, wherein at the angular position 3, during the ejection of the fourth rodless cavity 402, the fourth rod containing cavity opening 405 communicates with the fourth channel I 407, the fourth channel I 407 communicates with the fourth channel II 408, the fourth channel II 408 communicates with the fourth color paste bucket opening 413 through the fourth channel C 418, and the fourth rodless cavity opening C 411 communicates with the fourth ejection opening through the fourth channel F 421 and the fourth channel I 424 in the fourth valve core 404.

Figure 4D:
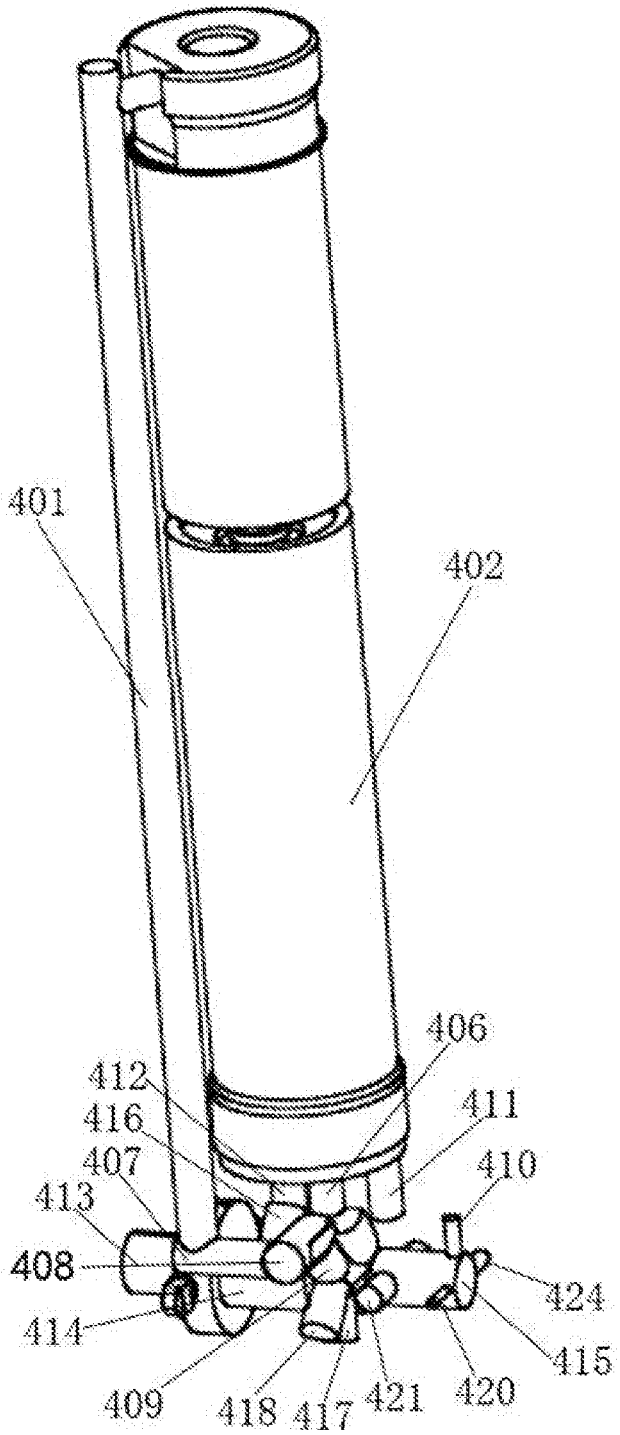
FIG. 4*d* is a working schematic diagram when the fourth valve core is located at an angular position 4.

As shown in FIG. 4*d*, an angular position 4 of the communication structure is additionally arranged, in which the fourth rodless cavity opening A 412 communicates with the fourth color paste bucket opening 413 through a fourth channel A 416 in the fourth valve core 404, the fourth rod containing cavity opening 405 communicates with the fourth channel I 407, the fourth channel I 407 communicates with the fourth channel II 408, the fourth channel II 408 communicates with the fourth color paste bucket opening 413 through a fourth channel B 409 in the fourth valve core 404, and the fourth ejection opening is closed.

An operation method of the three-stage variable color paste pump includes: (1) differentially ejecting a small amount of color paste, wherein at the angular position 4, when the fourth rodless cavity 402 sucks in the color paste, the fourth rodless cavity opening A 412 communicates with the fourth color paste bucket opening 413 through the fourth channel A 416 in the fourth valve core 404, the fourth rod containing cavity opening 405 communicates with the fourth channel I 407, the fourth channel I 407 communicates with the fourth channel II 408, the fourth channel II 408 communicates with the fourth color paste bucket opening 413 through the fourth channel B 409 in the fourth valve core 404, and the fourth ejection opening is closed, at the angular position 1, during the ejection of the fourth rodless cavity 402, the fourth rodless cavity opening B 406 communicates with the fourth channel II 408 through the fourth channel D 419 in the fourth valve core 404, and the fourth rodless cavity opening C 411 communicates with the fourth ejection opening through the fourth channel G 422 and the fourth channel E 420 in the fourth valve core 404; (2) ejecting a medium amount of color paste, wherein at the angular position 4, when the fourth rod containing cavity 401 sucks in the color paste, the fourth rodless cavity opening A 412 communicates with the fourth color paste bucket opening 413 through the fourth channel A 416 in the fourth valve core 404, the fourth rod containing cavity opening 405 communicates with the fourth channel I 407, the fourth channel I 407 communicates with the fourth channel II 408, the fourth channel II 408 communicates with the fourth color paste bucket opening 413 through the fourth channel B 409 in the fourth valve core 404, and the fourth ejection opening is closed, at the angular position 2, during the ejection of the fourth rod containing cavity 401, the fourth rodless cavity opening B 406 communicates with the fourth color paste bucket opening 413 through the fourth channel K 417 in the fourth valve core 404, the fourth rod containing cavity opening 405 communicates with the fourth channel I 407, the fourth channel I 407 communicates with the fourth channel II 408, and the fourth channel II 408 communicates with the fourth ejection opening through the fourth channel H 423; and (3) ejecting a large amount of color paste, wherein at the angular position 4, when the fourth rodless cavity 402 sucks in the color paste, the fourth rodless cavity opening A 412 communicates with the fourth color paste bucket opening 413 through the fourth channel A 416 in the fourth valve core 404, the fourth rod containing cavity opening 405 communicates with the fourth channel I 407, the fourth channel I 407 communicates with the fourth channel II 408, the fourth channel II 408 communicates with the fourth color paste bucket opening 413 through the fourth channel B 409 in the fourth valve core 404, and the fourth ejection opening is closed, at the angular position 3, during the ejection of the fourth rodless cavity 402, the fourth rod containing cavity opening 405 communicates with the fourth channel I 407, the fourth channel I 407 communicates with the fourth channel II 408, the fourth channel II 408 communicates with the fourth color paste bucket opening 413 through the fourth channel C 418, and the fourth rodless cavity opening C 411 communicates with the fourth ejection opening through the fourth channel F 421 and the fourth channel I 424 in the fourth valve core 404.

Figure 5:
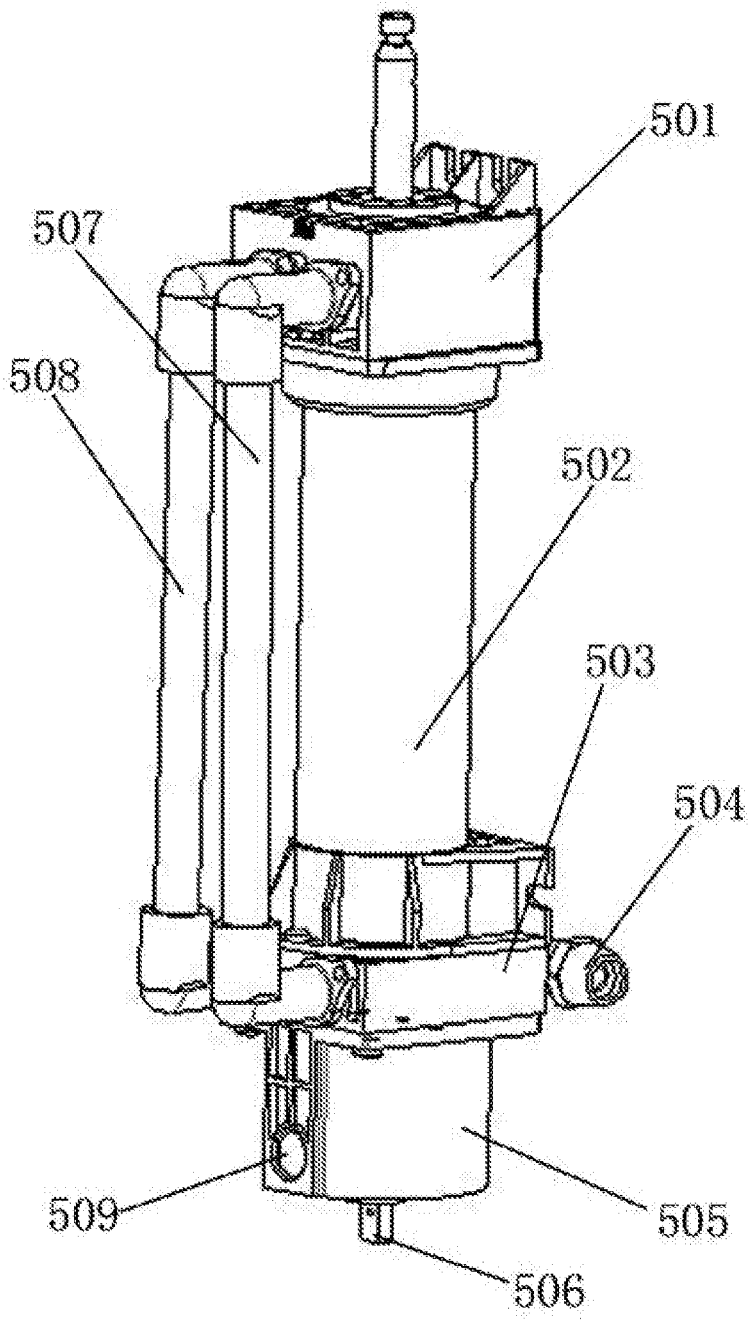
FIG. 5 is a structural schematic diagram of a fifth control valve.
Figures 1, 5:
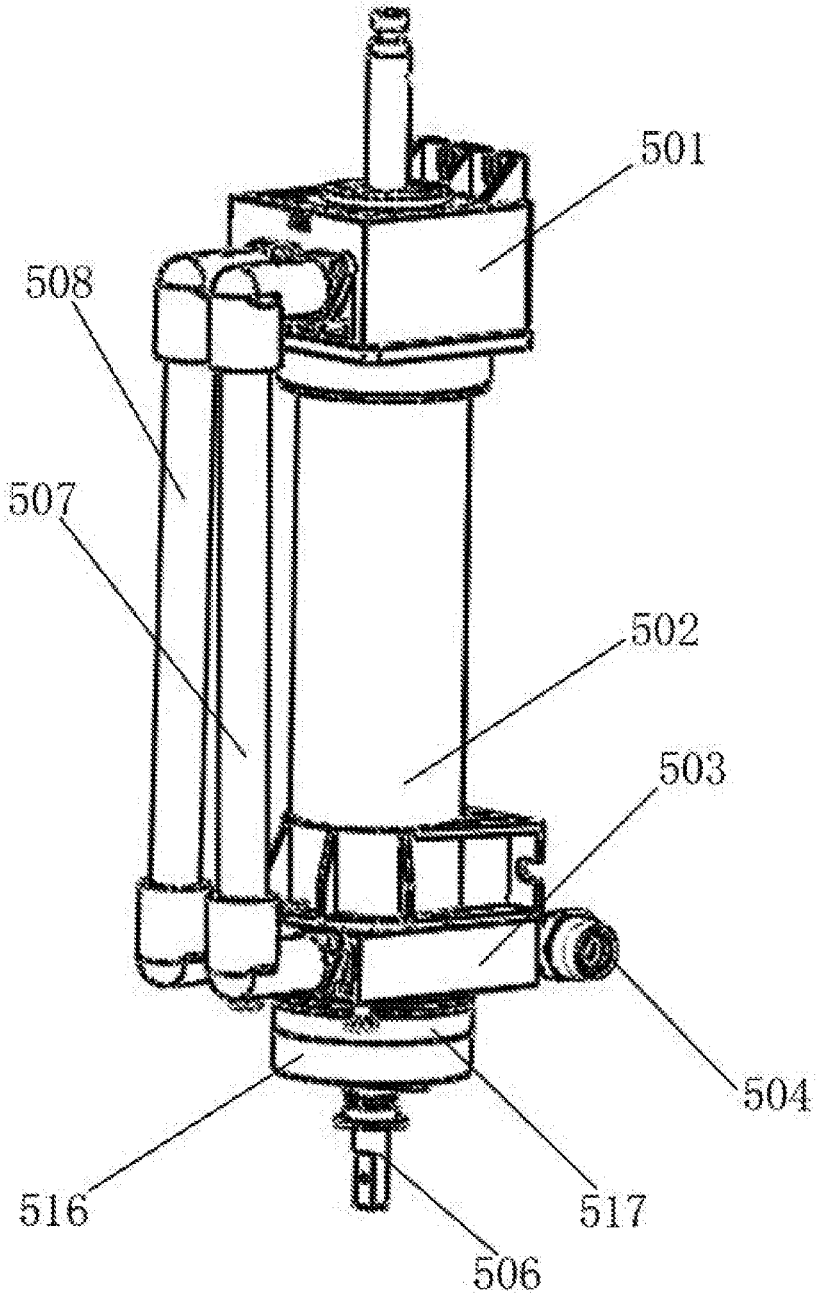
Figures 2, 5:
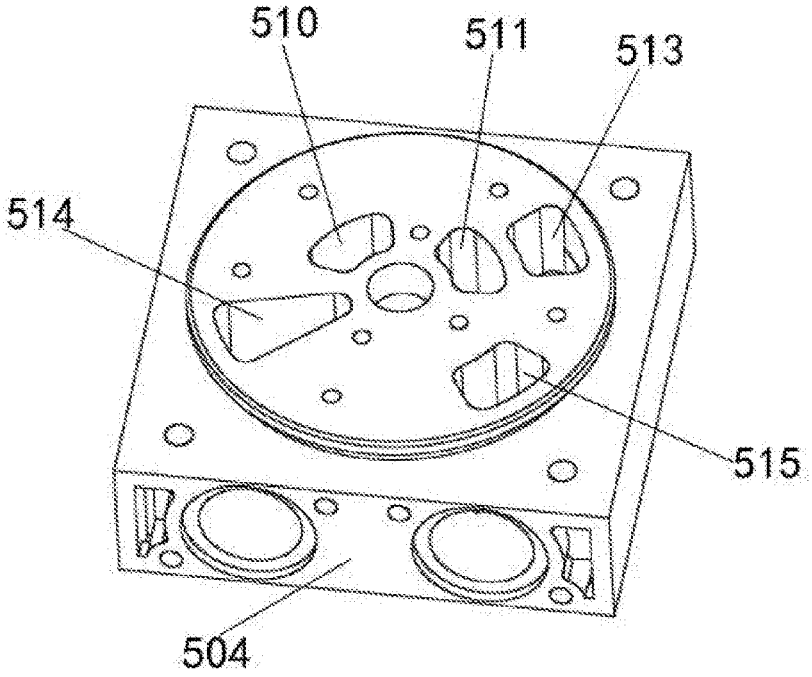
Figures 3, 5:
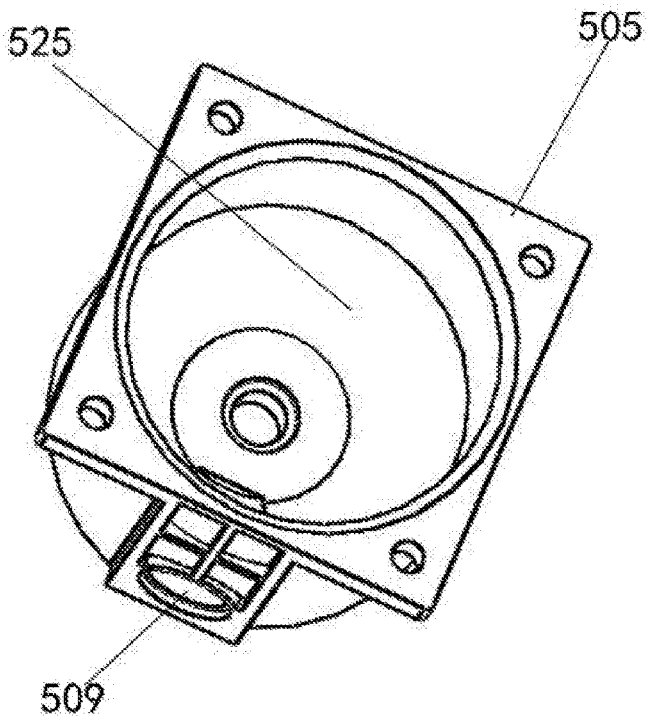
Figures 4, 5:
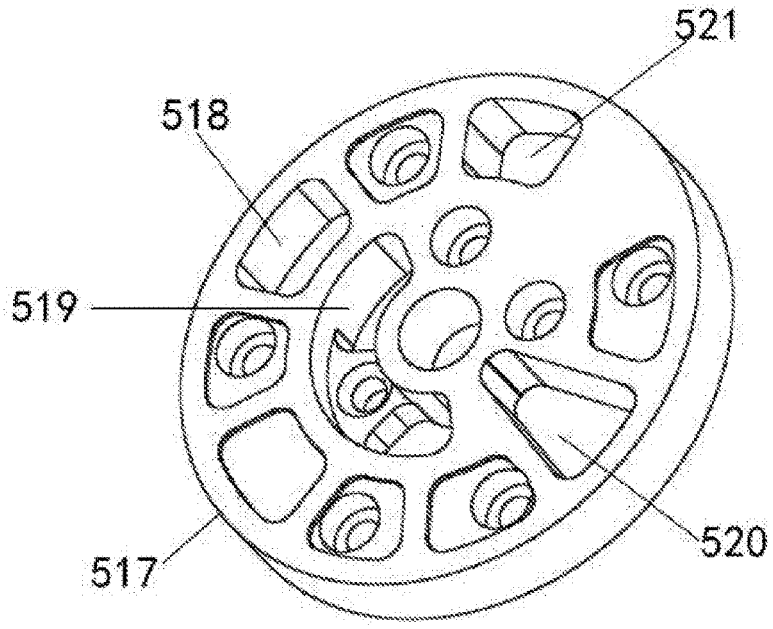
Figure 5:
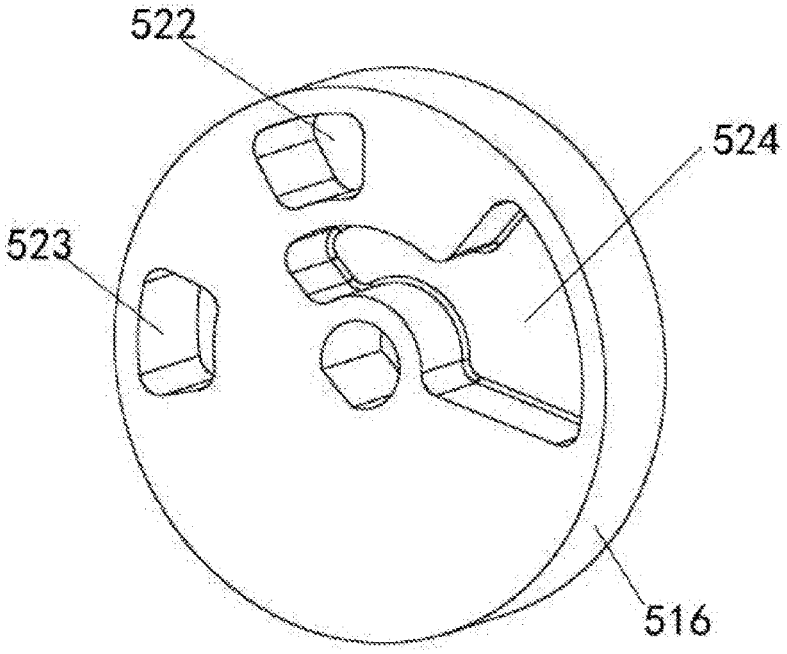
Figure 5A:
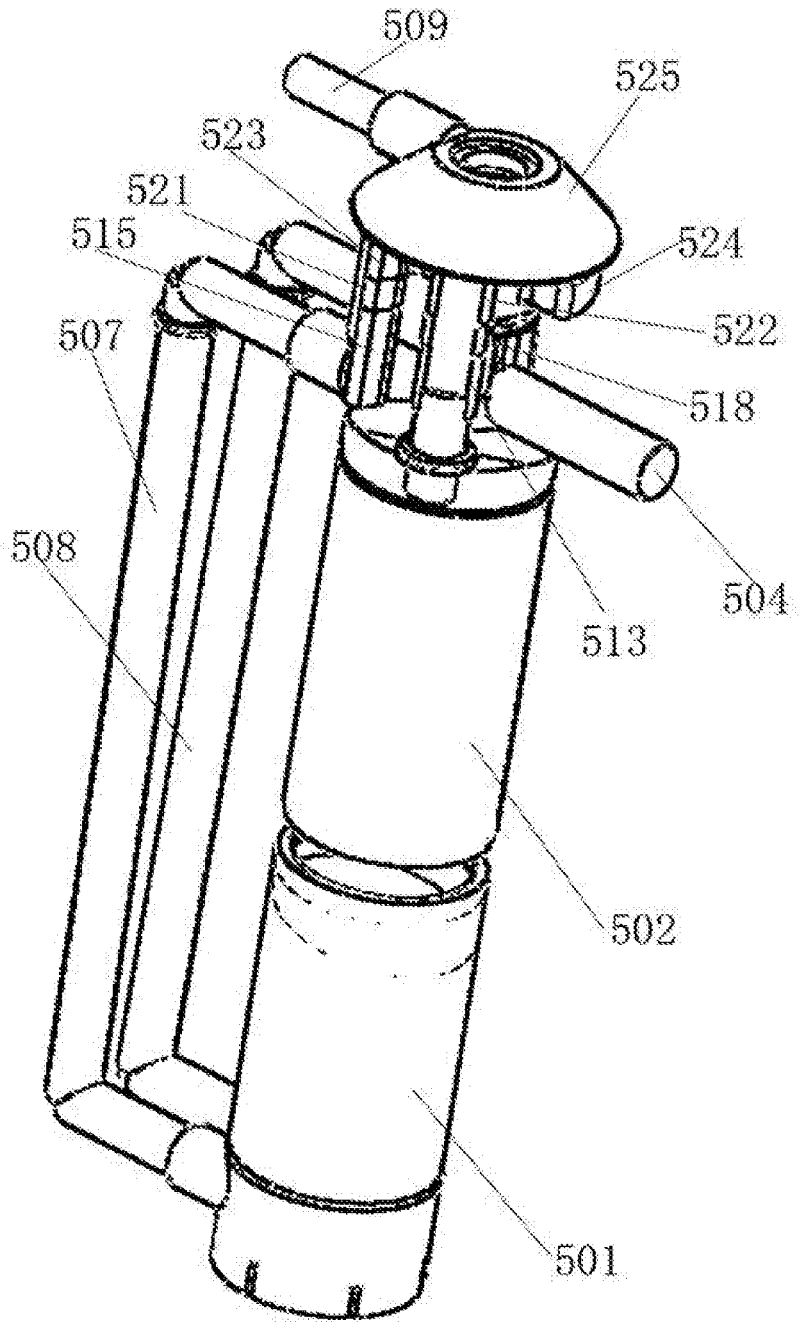
FIG. 5*a* is a working schematic diagram when the fifth valve core is located at an angular position 1.
Figure 5B:
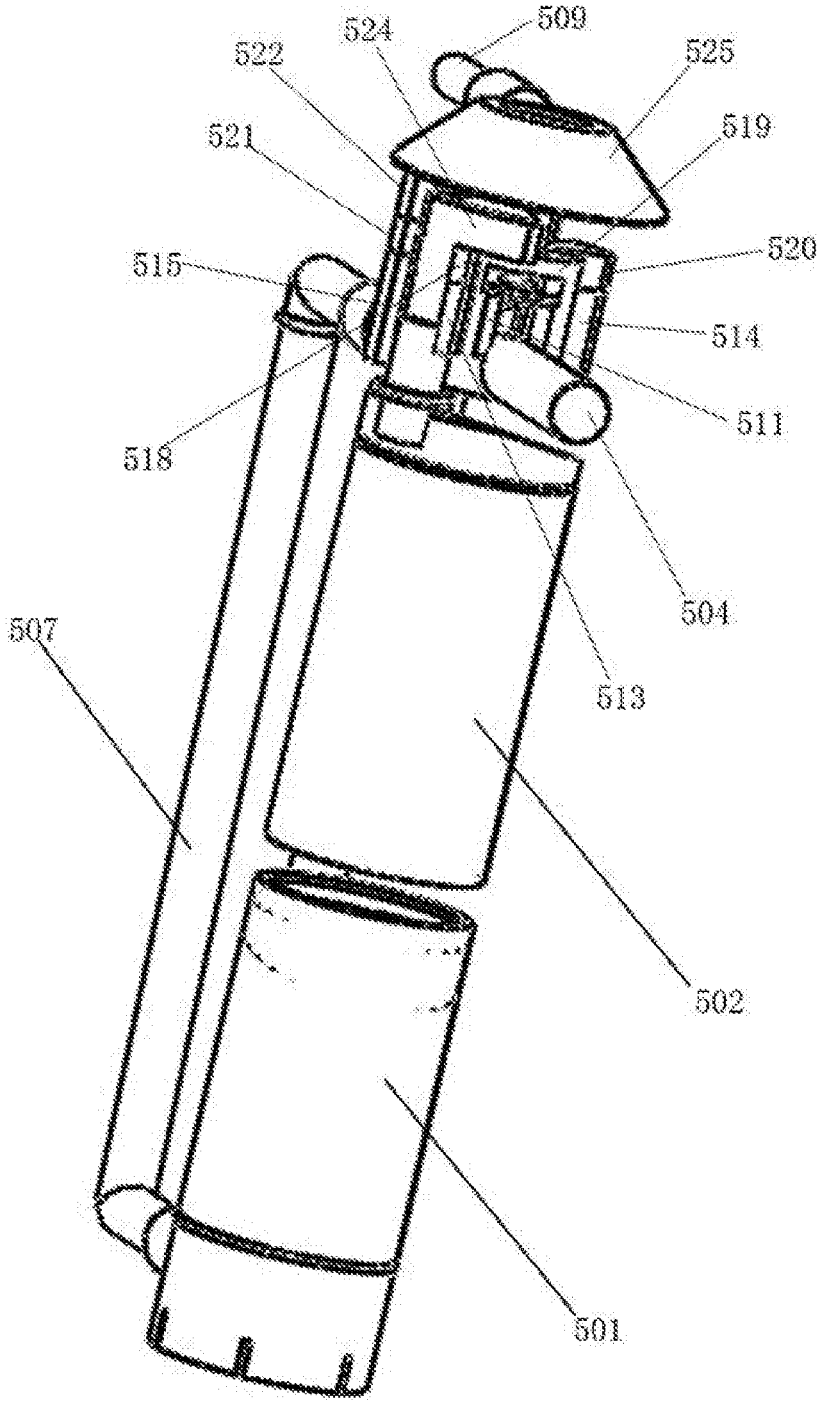
FIG. 5*b* is a working schematic diagram when the fifth valve core is located at an angular position 2.
Figure 5C:
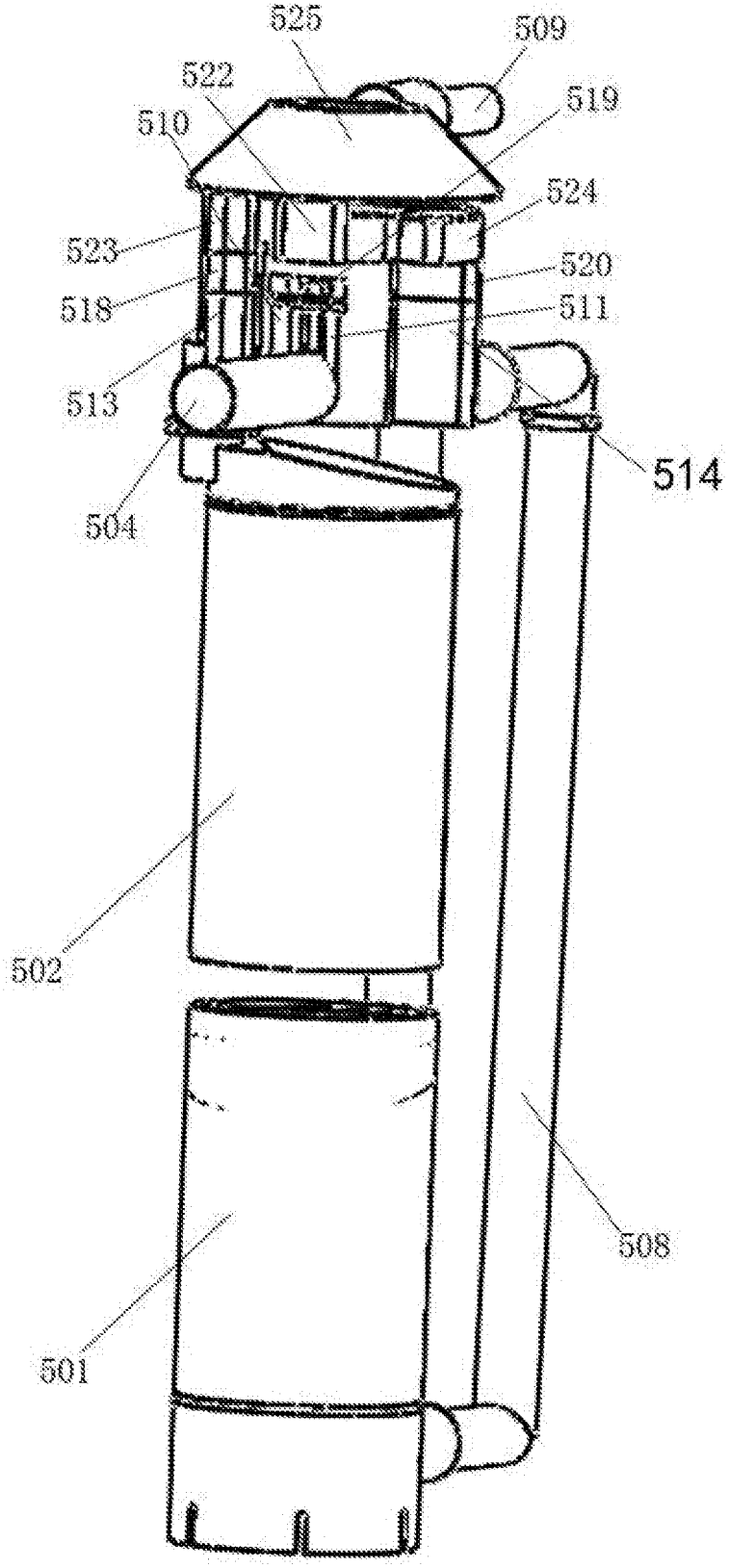
FIG. 5*c* is a working schematic diagram when the fifth valve core is located at an angular position 3.

As shown in FIG. 5, FIG. 5-1, FIG. 5-2, FIG. 5-3, FIG. 5-4 and FIG. 5-5, the control valve includes a fifth valve body 503, a fifth bonnet 505 and a fifth valve core 516, the fifth bonnet 505 is fixed on the fifth valve body 503, the fifth valve core 516 is connected through a rotating shaft, a fifth cavity 525 is formed between the fifth valve core 516 and the fifth bonnet 505, the fifth valve body 503 is provided with a fifth color paste bucket branch opening a 510, a fifth color paste bucket branch opening b 511, a fifth rod containing cavity branch opening b 515, a fifth rod containing cavity branch opening a 514 and a fifth rodless cavity opening 513, the fifth color paste bucket branch opening a 510 and the fifth color paste bucket branch opening b 511 communicate with the fifth color paste bucket opening 504, the fifth rod containing cavity branch opening b 515 communicates with the fifth rod containing cavity 501 through a fifth channel I 507, the fifth rod containing cavity branch opening a 514 communicates with the fifth rod containing cavity 501 through a fifth channel II 508, a fifth ejection opening 509 is formed in the fifth bonnet 505, the fifth cavity 525 communicates with the fifth ejection opening 509, a channel is arranged on the fifth valve core 516, a static valve piece 517 is arranged between the fifth valve body 503 and the fifth valve core 516, a fifth channel a 518, a fifth channel b 519, a fifth channel c 520 and a fifth channel d 521 are arranged in the static valve piece 517, the fifth channel a 518 communicates with the fifth rodless cavity opening 513, the fifth channel b 519 communicates with the fifth color paste bucket branch opening a 510 and the fifth color paste bucket branch opening b 511, the fifth channel c 520 communicates with the fifth rod containing cavity branch opening a 514, and the fifth channel d 521 communicates with the fifth rod containing cavity branch opening b 515. The fifth valve core 516 is rotated to different angular positions to form the following communication structures: as shown in FIG. 5*a*, at an angular position 1, the fifth rodless cavity opening 513 communicates with the fifth cavity 525 through a fifth channel E 522 in the fifth valve core 516, the fifth rod containing cavity branch opening b 515 communicates with the fifth cavity 525 through a fifth channel F 523 in the fifth valve core 516, and the fifth cavity 525 communicates with the fifth ejection opening 509; as shown in FIG. 5*b*, at an angular position 2, the fifth rodless cavity opening 513 communicates with the fifth color paste bucket branch opening b 511 through a groove 524 in the fifth valve core 516, and the fifth rod containing cavity branch opening b 515 communicates with the fifth ejection opening 509 through a fifth channel E 522 in the fifth valve core 516; and as shown in FIG. 5*c*, at an angular position 3, the fifth rod containing cavity branch opening a 514 communicates with the fifth color paste bucket branch opening a 510 through the groove 524 in the fifth valve core 516, and the fifth rodless cavity opening 513 communicates with the fifth ejection opening 509 through the fifth channel F 523.

An operation method of the three-stage variable color paste pump includes: (1) differentially ejecting a small amount of color paste, wherein at the angular position 1, during the ejection of the fifth rodless cavity 502, the fifth rodless cavity opening 513 communicates with the fifth cavity 525 through the fifth channel E 522 in the fifth valve core 516, the fifth rod containing cavity branch opening b 515 communicates with the fifth cavity 525 through the fifth channel F 523 in the fifth valve core 516, and the fifth cavity 525 communicates with the fifth ejection opening 509; (2) ejecting a medium amount of color paste, wherein at the angular position 2, during the ejection of the fifth rod containing cavity 501, the fifth rodless cavity opening 513 communicates with the fifth color paste bucket branch opening b 511 through the groove 524 in the fifth valve core 516, and the fifth rod containing cavity branch opening b 515 communicates with the fifth ejection opening 509 through the fifth channel E 522 in the fifth valve core 516; and (3) ejecting a large amount of color paste, wherein at the angular position 3, during the ejection of the fifth rodless cavity 502, the fifth rod containing cavity branch opening a 514 communicates with the fifth color paste bucket branch opening a 510 through the groove 524 in the fifth valve core 516, and the fifth rodless cavity opening 513 communicates with the fifth ejection opening 509 through the fifth channel F 523.

Figure 6:
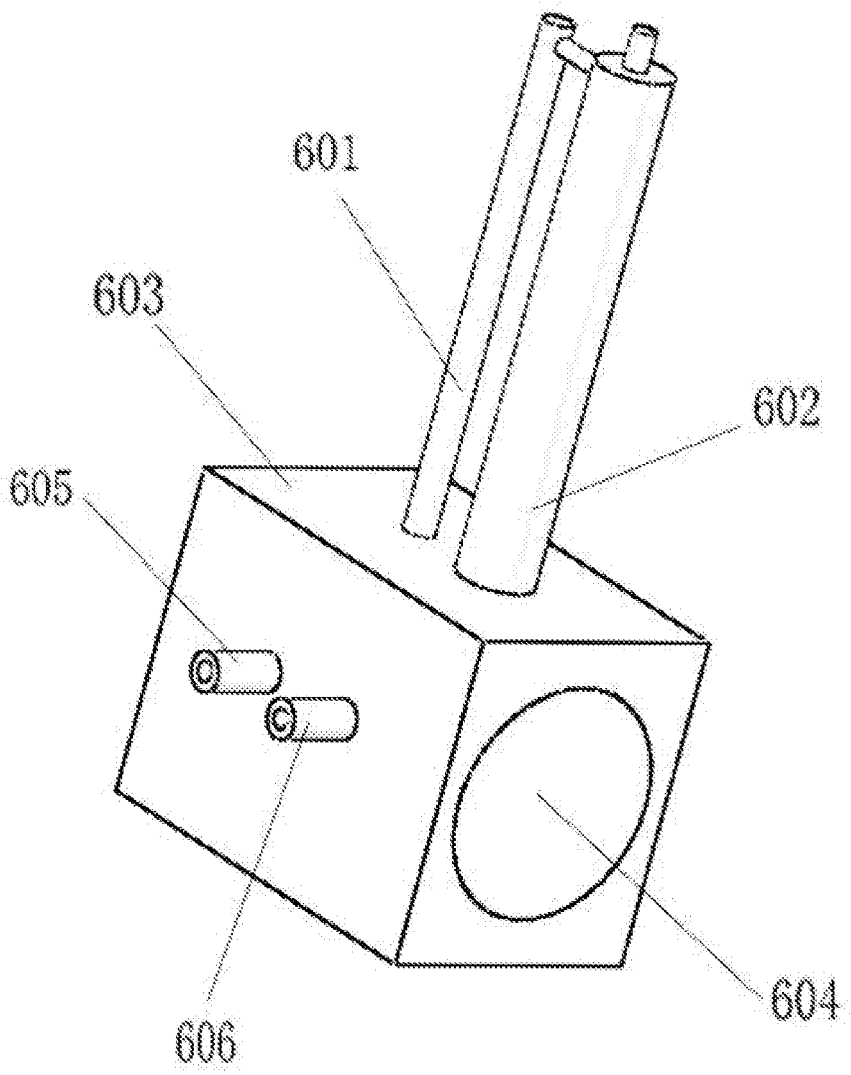
FIG. 6 is a structural schematic diagram of a sixth control valve.
Figure 6A:
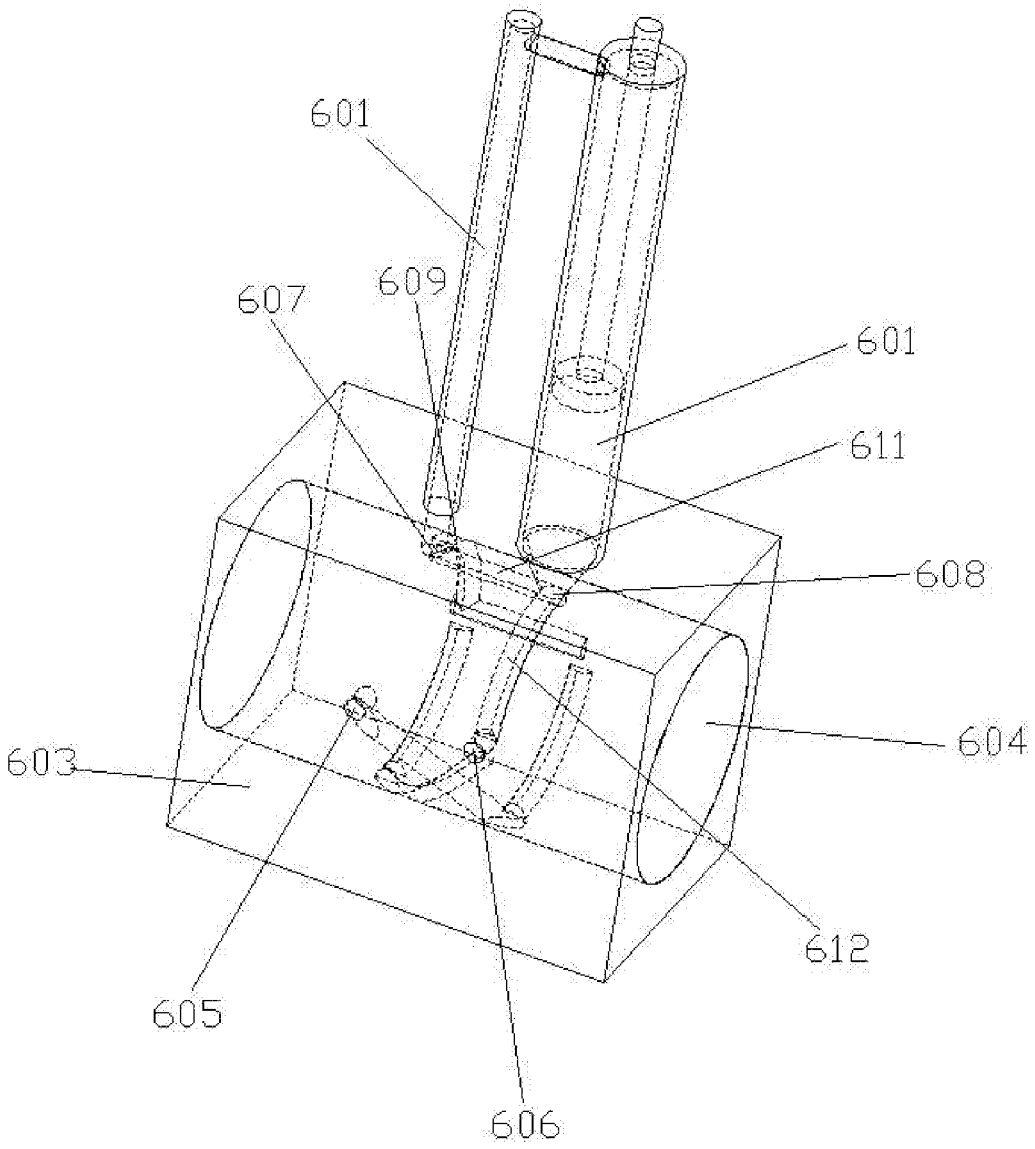
FIG. 6*a* is a working schematic diagram when a sixth valve core is located at an angular position 1.
Figure 6B:
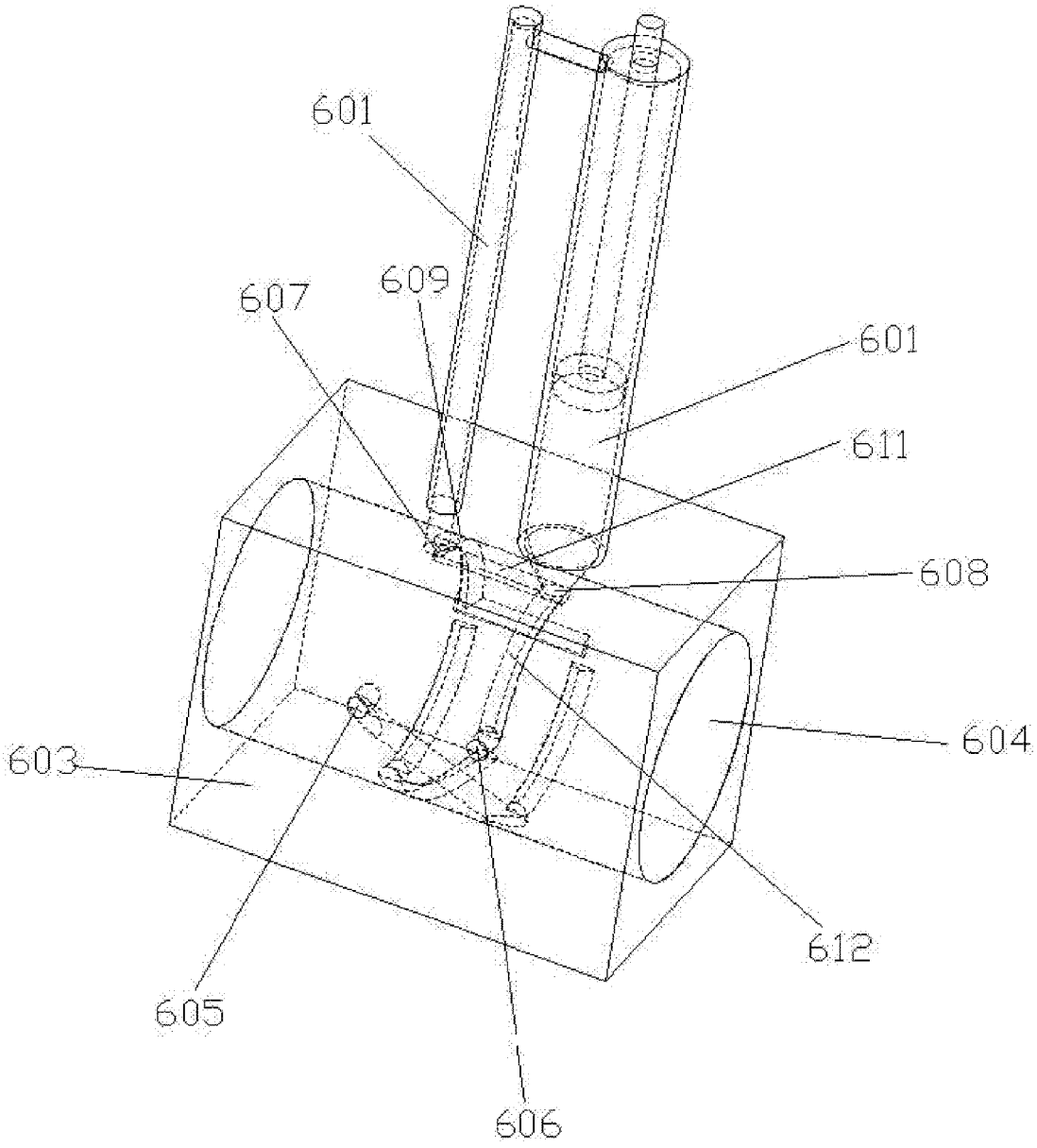
FIG. 6*b* is a working schematic diagram when the sixth valve core is located at an angular position 2.
Figure 6C:
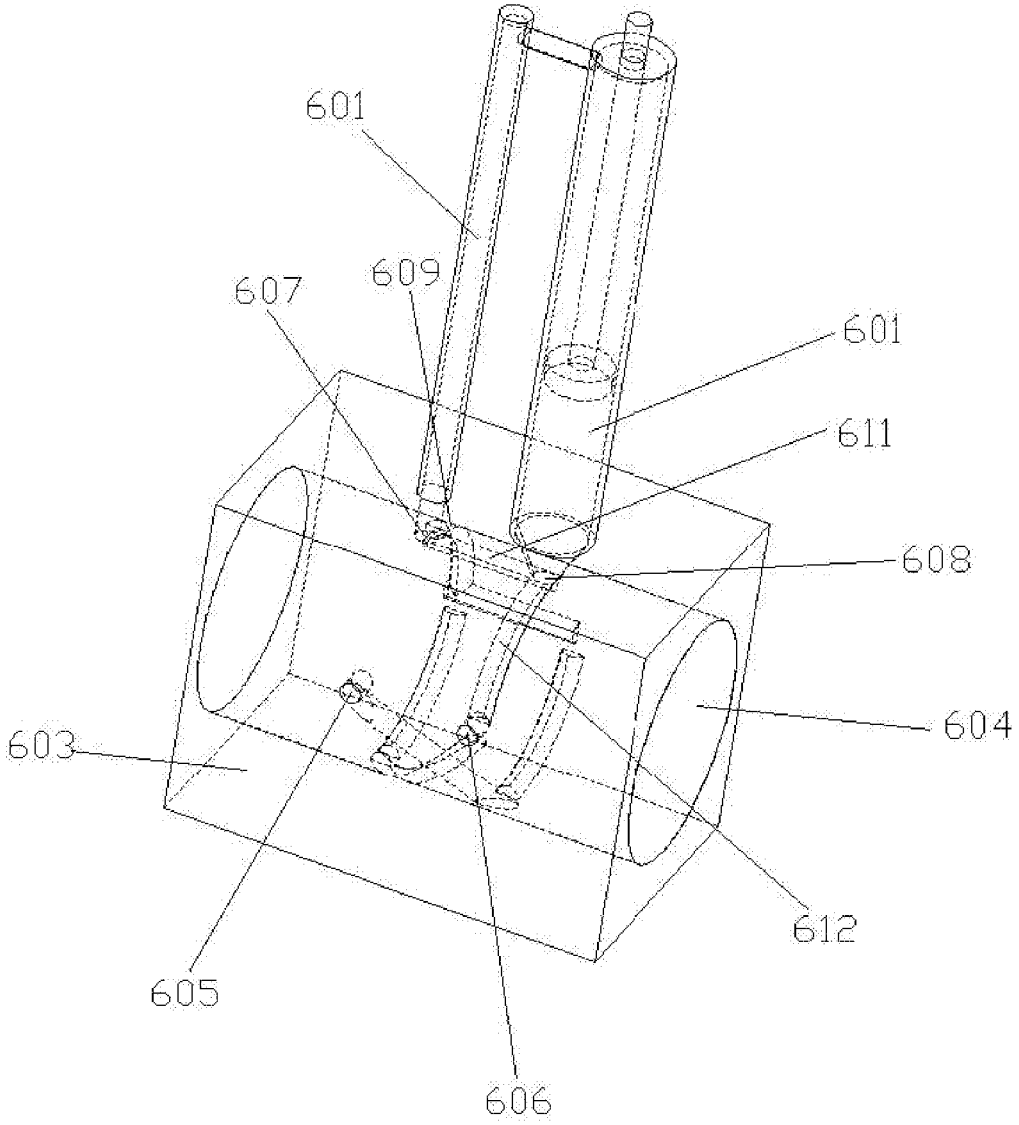
FIG. 6*c* is a working schematic diagram when the sixth valve core is located at an angular position 3.

As shown in FIG. 6, the control valve includes a sixth valve body 603 and a sixth valve core 604, the sixth valve body 603 is provided with a sixth color paste bucket opening 605, a sixth ejection opening 606, a sixth rod containing cavity opening 607 and a sixth rodless cavity opening 608, and the sixth valve core 604 is rotated to different angular positions to form the following communication structures: as shown in FIG. 6*a*, at an angular position 1, the sixth rod containing cavity opening 607 communicates with a sixth channel A 611, the sixth channel A 611 communicates with a sixth channel B 612, the sixth channel B 612 communicates with the sixth ejection opening 606, the sixth rodless cavity opening 608 communicates with the sixth rod containing cavity opening 607 through the sixth channel A 611, and the sixth rod containing cavity opening 607 communicates with the sixth channel B 612; as shown in FIG. 6*b*, at an angular position 2, the sixth rod containing cavity opening 607 communicates with the sixth ejection opening 606 through a sixth channel C 616, and the sixth rodless cavity opening 608 communicates with the sixth color paste bucket opening 605 through a sixth channel D 615; and as shown in FIG. 6*c*, at an angular position 3, the sixth rodless cavity opening 608 communicates with the sixth ejection opening 606 through a sixth channel E 614, and the sixth rod containing cavity opening 607 communicates with the sixth color paste bucket opening 605 through a sixth channel F 613.

The sixth channel A 611, the sixth channel B 612, a sixth channel C 616, a sixth channel D 615, a sixth channel E 614, a sixth channel F 613, a sixth channel H 610 ad a sixth channel I 609 can be arranged in the sixth valve core 604 and can also be arranged on the surface of the sixth valve core 604.

An operation method of the three-stage variable color paste pump includes: (1) differentially ejecting a small amount of color paste, wherein at the angular position 1, during the ejection of the sixth rodless cavity 602, the sixth rod containing cavity opening 607 communicates with the sixth channel A 611, the sixth channel A 611 communicates with the sixth channel B 612, the sixth channel B 612 communicates with the sixth ejection opening 606, the sixth rodless cavity opening 608 communicates with the sixth rod containing cavity opening 607 through the sixth channel A 611, and the sixth rod containing cavity opening 607 communicates with the sixth channel B 612; (2) ejecting a medium amount of color paste, wherein at the angular position 2, during the ejection of the sixth rod containing cavity 601, the sixth rod containing cavity opening 607 communicates with the sixth ejection opening 606 through the sixth channel C 616, and the sixth rodless cavity opening 608 communicates with the sixth color paste bucket opening 605 through the sixth channel D 615; and (3) ejecting a large amount of color paste, wherein at the angular position 3, during the ejection of the sixth rodless cavity 602, the sixth rodless cavity opening 608 communicates with the sixth ejection opening 606 through the sixth channel E 614, and the sixth rod containing cavity opening 607 communicates with the sixth color paste bucket opening 605 through the sixth channel F 613.

Figure 6D:
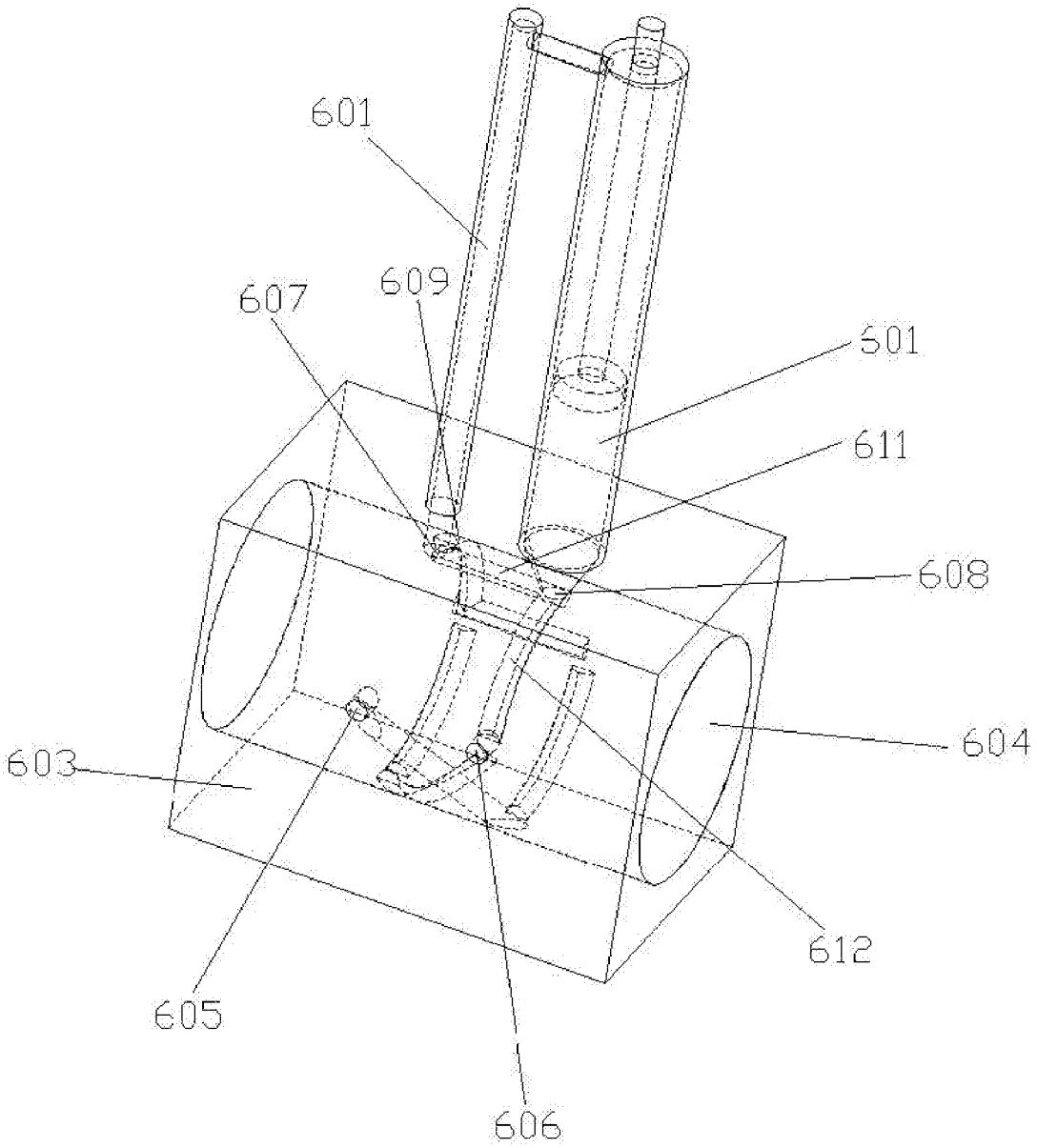
FIG. 6*d* is a working schematic diagram when the sixth valve core is located at an angular position 4.

As shown in FIG. 6*d*, an angular position 4 of the communication structure is additionally arranged, in which the sixth rodless cavity opening 608 communicates with the sixth channel H 610, the sixth channel H 610 communicates with the sixth color paste bucket opening 605 through the sixth channel I 609, and the sixth rod containing cavity opening 607 communicates with the sixth color paste bucket opening 605 through the sixth channel I 609.

An operation method of the three-stage variable color paste pump includes: (1) differentially ejecting a small amount of color paste, wherein at the angular position 4, when the sixth rodless cavity 602 sucks in the color paste, the sixth rodless cavity opening 608 communicates with the sixth channel H 610, the sixth channel H 610 communicates with the sixth color paste bucket opening 605 through the sixth channel I 609, and the sixth rod containing cavity opening 607 communicates with the sixth color paste bucket opening 605 through the sixth channel I 609, at the angular position 1, during the ejection of the sixth rodless cavity 602, the sixth rod containing cavity opening 607 communicates with the sixth channel A 611, the sixth channel A 611 communicates with the sixth channel B 612, the sixth channel B 612 communicates with the sixth ejection opening 606, the sixth rodless cavity opening 608 communicates with the sixth rod containing cavity opening 607 through the sixth channel A 611, and the sixth rod containing cavity opening 607 communicates with the sixth channel B 612; (2) ejecting a medium amount of color paste, wherein at the angular position 4, when the sixth rod containing cavity 601 sucks in the color paste, and when the sixth rodless cavity 602 sucks in the color paste, the sixth rodless cavity opening 608 communicates with the sixth channel H 610, the sixth channel H 610 communicates with the sixth color paste bucket opening 605 through the sixth channel I 609, and the sixth rod containing cavity opening 607 communicates with the sixth color paste bucket opening 605 through the sixth channel I 609, at the angular position 2, during the ejection of the sixth rod containing cavity 601, the sixth rod containing cavity opening 607 communicates with the sixth ejection opening 606 through the sixth channel C 616, and the sixth rodless cavity opening 608 communicates with the sixth color paste bucket opening 605 through the sixth channel D 615; and (3) ejecting a large amount of color paste, wherein at the angular position 4, when the sixth rodless cavity 602 sucks in the color paste, the sixth rodless cavity opening 608 communicates with the sixth channel H 610, the sixth channel H 610 communicates with the sixth color paste bucket opening 605 through the sixth channel I 609, and the sixth rod containing cavity opening 607 communicates with the sixth color paste bucket opening 605 through the sixth channel I 609, at the angular position 3, during the ejection of the sixth rodless cavity 602, the sixth rodless cavity opening 608 communicates with the sixth ejection opening 606 through the sixth channel E 614, and the sixth rod containing cavity opening 607 communicates with the sixth color paste bucket opening 605 through the sixth channel F 613.

Figure 7:
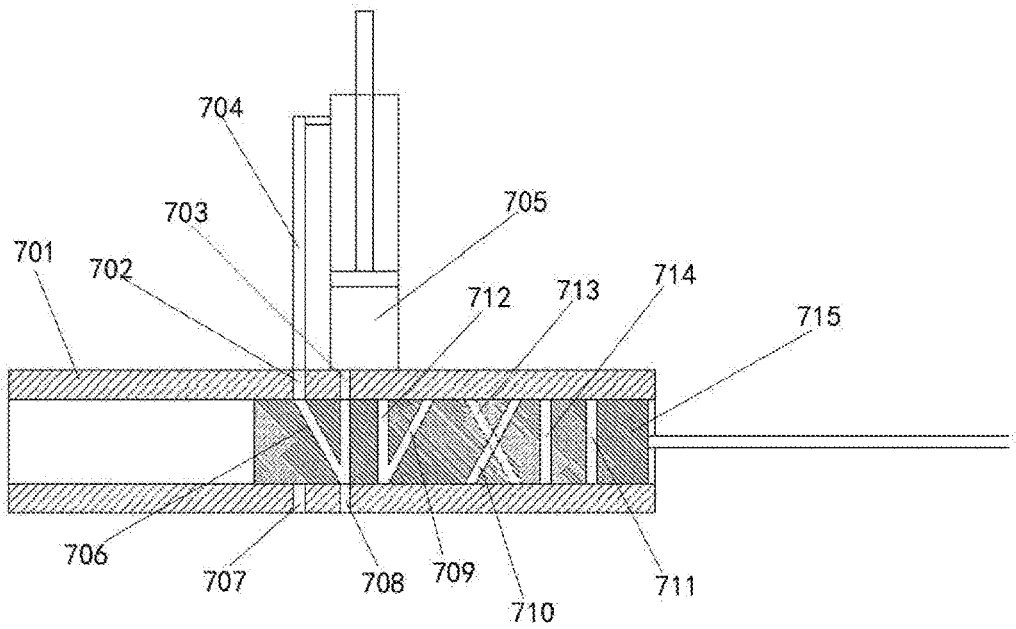
FIG. 7 is a structural schematic diagram of a seventh control valve.

As shown in FIG. 7, the control valve includes a seventh valve body 701 and a seventh valve core 715, the seventh valve core 715 slides in the seventh valve body 701, the seventh valve body 701 is provided with a seventh rod containing cavity opening 702, a seventh rodless cavity opening 703, a seventh color paste bucket opening 707 and a seventh ejection opening 708, and the seventh valve core 715 is rotated to different positions to form the following communication structures: at the position 1, the seventh rod containing cavity opening 702 communicates with a seventh channel B 716 through a seventh channel A 706, and the seventh rodless cavity opening 703 communicates with the seventh ejection opening 708 through the seventh channel B 716; at the position 2, the seventh rodless cavity opening 703 communicates with the seventh color paste bucket opening 707 through a seventh channel E 710, and the seventh rod containing cavity opening 702 communicates with the seventh ejection opening 708 through a seventh channel F 713; and at the position 3, the seventh rod containing cavity opening 702 communicates with the seventh color paste bucket opening 707 through a seventh channel G 714, and the seventh rodless cavity opening 703 communicates with the seventh ejection opening 708 through a seventh channel H 711, and the seventh channel F 713 and the seventh channel E 710 intersect with each other but do not communicate with each other.

An operation method of the three-stage variable color paste pump includes: (1) differentially ejecting a small amount of color paste, wherein at the position 1, during the ejection of the seventh rodless cavity 705, the seventh rod containing cavity opening 702 communicates with the seventh channel B 716 through the seventh channel A 706, and the seventh rodless cavity opening 703 communicates with the seventh ejection opening 708 through the seventh channel B 716; (2) ejecting a medium amount of color paste, wherein at the position 2, during the ejection of the seventh rod containing cavity 704, the seventh rodless cavity opening 703 communicates with the seventh color paste bucket opening 707 through the seventh channel E 710, and the seventh rod containing cavity opening 702 communicates with the seventh ejection opening 708 through the seventh channel F 713; and (3) ejecting a large amount of color paste, wherein at the position 3, during the ejection of the seventh rodless cavity 705, the seventh rod containing cavity opening 702 communicates with the seventh color paste bucket opening 707 through the seventh channel G 714, and the seventh rodless cavity opening 703 communicates with the seventh ejection opening 708 through the seventh channel H 711.

A position 4 of the communication structure is additionally arranged, in which the seventh rod containing cavity opening 702 communicates with the seventh color paste bucket opening 707 through a seventh channel C 712, and the seventh rodless cavity opening 703 communicates with the seventh color paste bucket opening 707 through a seventh channel D 709.

An operation method of the three-stage variable color paste pump includes: (1) differentially ejecting a small amount of color paste, wherein at the position 4, when the seventh rodless cavity 705 sucks in the color paste, the seventh rod containing cavity opening 702 communicates with the seventh color paste bucket opening 707 through the seventh channel C 712, and the seventh rodless cavity opening 703 communicates with the seventh color paste bucket opening 707 through the seventh channel D 709, at the position 1, during the ejection of the seventh rodless cavity 705, the seventh rod containing cavity opening 702 communicates with the seventh channel B 716 through the seventh channel A 706, and the seventh rodless cavity opening 703 communicates with the seventh ejection opening 708 through the seventh channel B 716; (2) ejecting a medium amount of color paste, wherein at the position 4, when the seventh rod containing cavity 704 sucks in the color paste, the seventh rod containing cavity opening 702 communicates with the seventh color paste bucket opening 707 through the seventh channel C 712, and the seventh rodless cavity opening 703 communicates with the seventh color paste bucket opening 707 through the seventh channel D 709, at the position 2, during the ejection of the seventh rod containing cavity 704, the seventh rodless cavity opening 703 communicates with the seventh color paste bucket opening 707 through the seventh channel E 710, and the seventh rod containing cavity opening 702 communicates with the seventh ejection opening 708 through the seventh channel F 713; and (3) ejecting a large amount of color paste, wherein at the position 4, when the seventh rodless cavity 705 sucks in the color paste, the seventh rod containing cavity opening 702 communicates with the seventh color paste bucket opening 707 through the seventh channel C 712, and the seventh rodless cavity opening 703 communicates with the seventh color paste bucket opening 707 through the seventh channel D 709, at the position 3, during the ejection of the seventh rodless cavity 705, the seventh rod containing cavity opening 702 communicates with the seventh color paste bucket opening 707 through the seventh channel G 714, and the seventh rodless cavity opening 703 communicates with the seventh ejection opening 708 through the seventh channel H 711.

Figure 8:
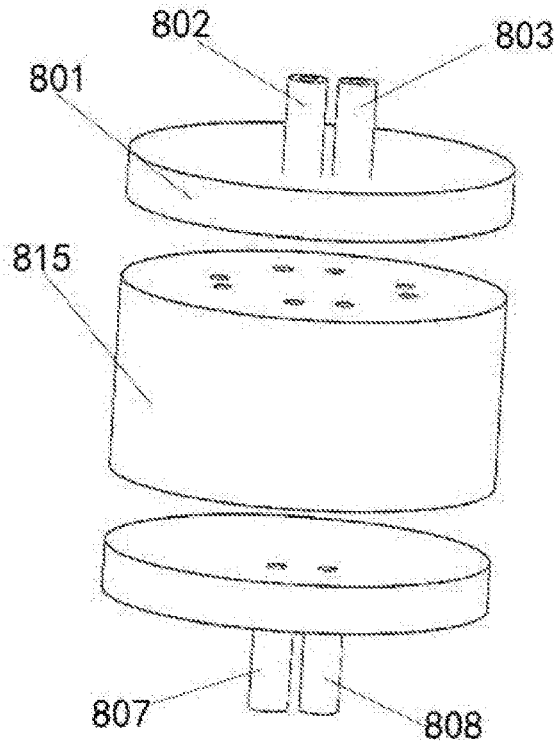
FIG. 8 is a structural schematic diagram of an eighth control valve.
Figure 8A:
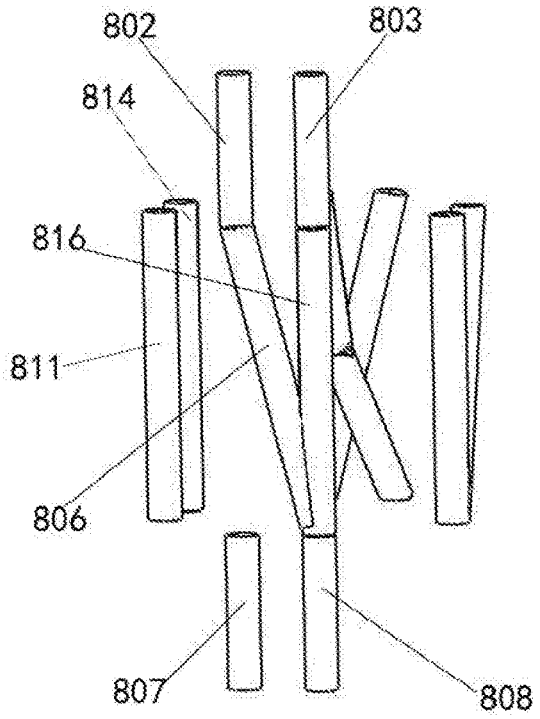
FIG. 8*a* is a working schematic diagram when an eighth valve core is located at an angular position 1.
Figure 8B:
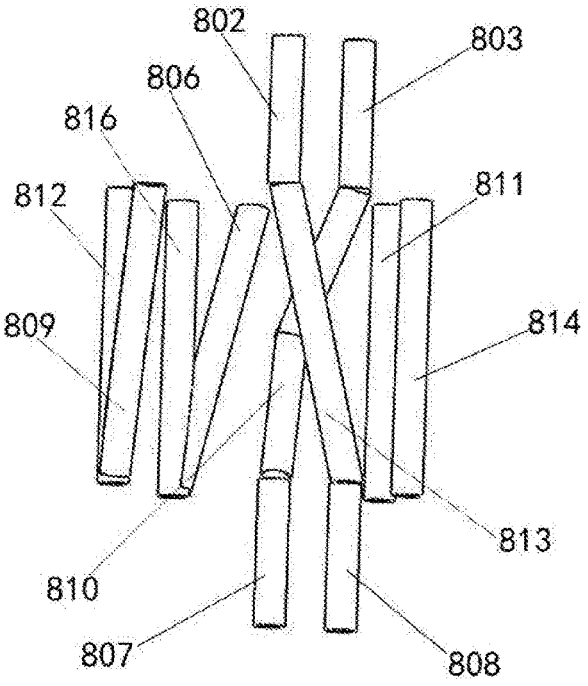
FIG. 8*b* is a working schematic diagram when the eighth valve core is located at an angular position 2.
Figure 8C:
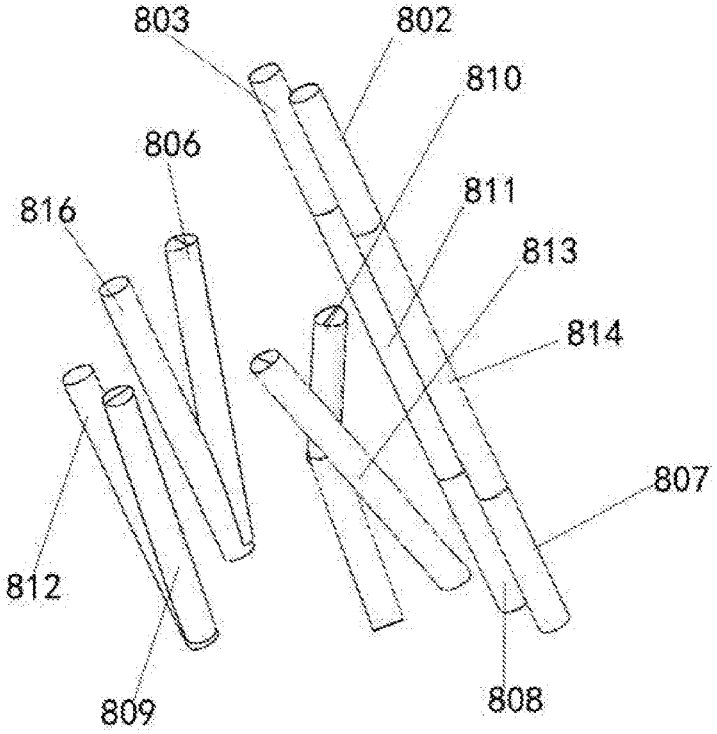
FIG. 8*c* is a working schematic diagram when the eighth valve core is located at an angular position 3.

As shown in FIG. 8, the control valve includes an eighth valve body 801 and an eighth valve core 815, the eighth valve body 801 includes an upper valve body and a lower valve body, the eighth valve core 815 is installed between the upper valve body and the lower valve body, the eighth valve body 801 is provided with an eighth rod containing cavity opening 802, an eighth rodless cavity opening 803, an eighth color paste bucket opening 807 and an eighth ejection opening 808, and the eighth valve core 815 is rotated to different angular positions to form the following communication structures: as shown in FIG. 8*a*, at an angular position 1, the eighth rod containing cavity opening 802 communicates with an eighth channel B 816 through an eighth channel A 806, and the eighth rodless cavity opening 803 communicates with the eighth ejection opening 808 through the eighth channel B 816; as shown in FIG. 8*b*, at an angular position 2, the eighth rodless cavity opening 803 communicates with the eighth color paste bucket opening 807 through an eighth channel E 814, and the eighth rod containing cavity opening 803 communicates with the eighth ejection opening through an eighth channel F; and at an angular position 3, the eighth rod containing cavity opening 802 communicates with the eighth color paste bucket opening 807 through an eighth channel G 814, and the eighth rodless cavity opening 803 communicates with the eighth ejection opening 808 through an eighth channel H 811.

An operation method of the three-stage variable color paste pump includes: (1) differentially ejecting a small amount of color paste, wherein at the angular position 1, the eighth rod containing cavity opening 802 communicates with the eighth channel B 816 through the eighth channel A 806, and the eighth rodless cavity opening 803 communicates with the eighth ejection opening 808 through the eighth channel B 816; (2) ejecting a medium amount of color paste, wherein at the angular position 2, during the ejection of the eighth rod containing cavity, the eighth rodless cavity opening 803 communicates with the eighth color paste bucket opening 807 through the eighth channel E 810, and the eighth rod containing cavity opening 802 communicates with the eighth ejection opening 808 through the eighth channel F 813; and (3) ejecting a large amount of color paste, wherein at the angular position 3, during the ejection of the eighth rodless cavity 805, the eighth rod containing cavity opening 802 communicates with the eighth color paste bucket opening 807 through the eighth channel G 814, and the eighth rodless cavity opening 803 communicates with the eighth ejection opening 808 through the eighth channel H 811.

Figure 8D:
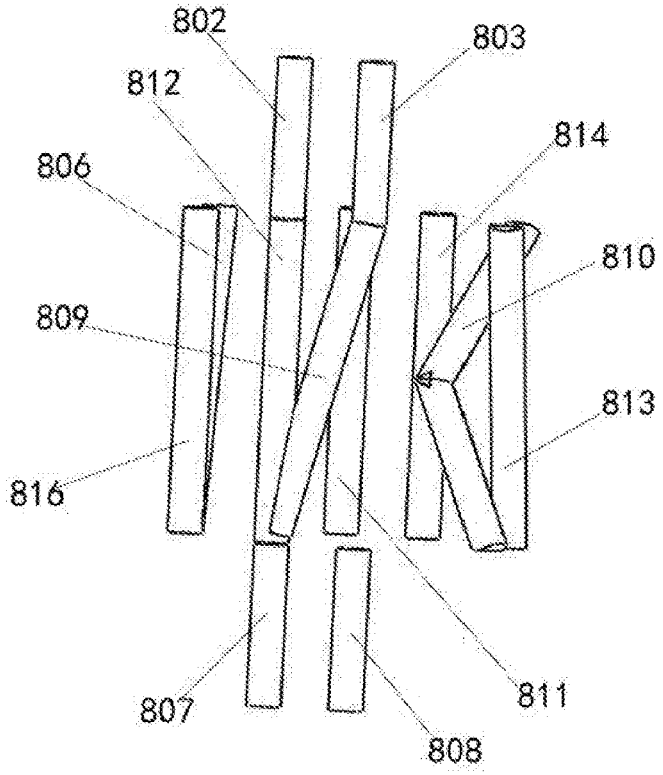
FIG. 8*d* is a working schematic diagram when the eighth valve core is located at an angular position 4.

As shown in FIG. 8*d*, an angular position 4 of the communication structure is additionally arranged, in which the eighth rod containing cavity opening 802 communicates with the eighth color paste bucket opening 807 through an eighth channel C 812, and the eighth rodless cavity opening 803 communicates with the eighth color paste bucket opening 807 through an eighth channel D 809.

An operation method of the three-stage variable color paste pump includes: (1) differentially ejecting a small amount of color paste, wherein at the angular position 4, when the eighth rodless cavity sucks in the color paste, the eighth rod containing cavity opening 802 communicates with the eighth color paste bucket opening 807 through the eighth channel C 812, and the eighth rodless cavity opening 803 communicates with the eighth color paste bucket opening 807 through the eighth channel D 809, at the angular position 1, the eighth rod containing cavity opening 802 communicates with the eighth channel B 816 through the eighth channel A 806, and the eighth rodless cavity opening 803 communicates with the eighth ejection opening 808 through the eighth channel B 816; (2) ejecting a medium amount of color paste, wherein at the angular position 4, when the eighth rod containing cavity sucks in the color paste, the eighth rod containing cavity opening 802 communicates with the eighth color paste bucket opening 807 through the eighth channel C 812, and the eighth rodless cavity opening 803 communicates with the eighth color paste bucket opening 807 through the eighth channel D 809, at the angular position 2, during the ejection of the eighth rod containing cavity, the eighth rodless cavity opening 803 communicates with the eighth color paste bucket opening 807 through the eighth channel E 810, and the eighth rod containing cavity opening 802 communicates with the eighth ejection opening 808 through the eighth channel F 813; and (3) ejecting a large amount of color paste, wherein at the angular position 4, when the eighth rodless cavity sucks in the color paste, the eighth rod containing cavity opening 802 communicates with the eighth color paste bucket opening 807 through the eighth channel C 812, and the eighth rodless cavity opening 803 communicates with the eighth color paste bucket opening 807 through the eighth channel D 809, at the angular position 3, during the ejection of the eighth rodless cavity, the eighth rod containing cavity opening 802 communicates with the eighth color paste bucket opening 807 through the eighth channel G 814, and the eighth rodless cavity opening 803 communicates with the eighth ejection opening 808 through the eighth channel H 811.

The invention claimed is:

1. A three-stage variable color paste pump, comprising a differential pump, the differential pump comprising a rodless cavity, a rod containing cavity and a piston rod, wherein a control valve is provided, the control valve comprises a valve body and a valve core, the valve body is provided with a rod containing cavity opening for communicating with the rod containing cavity, is provided with a rodless cavity opening for communicating with the rodless cavity, is provided with a color paste bucket opening for communicating with a color paste bucket, and is provided with an ejection opening, a channel is arranged on the valve core, and the valve core is moved to different positions to form the following communication structures: at a position 1, the rodless cavity communicates with the ejection opening, and the rodless cavity communicates with the rod containing cavity; at a position 2, the rod containing cavity opening communicates with the ejection opening, and the rodless cavity communicates with the color paste bucket; and at a position 3, the rodless cavity communicates with the ejection opening, and the rod containing cavity communicates with the color paste bucket.

2. The three-stage variable color paste pump according to claim 1, wherein a position 4 of the communication structure is additionally arranged, in which both of the rodless cavity opening and the rod containing cavity opening communicate with the color paste bucket, and the ejection opening is closed.

3. An operation method of the three-stage variable color paste pump according to claim 2, comprising: (1) differentially ejecting a small amount of color paste, wherein at the position 4, when the second rodless cavity sucks in the color paste, both of the rodless cavity opening and the rod containing cavity opening communicate with the color paste bucket, at the position 1, during the ejection of the rodless cavity, the rodless cavity communicates with the ejection opening, and the rodless cavity communicates with the rod containing cavity; (2) ejecting a medium amount of color paste, wherein at the position 4, when the rod containing cavity sucks in the color paste, both of the rod containing cavity opening and the rodless cavity opening communicate with the color paste bucket, and at the position 2, during the ejection of the rod containing cavity, the rod containing cavity opening communicates with the ejection opening, and the rodless cavity communicates with the color paste bucket; and (3) ejecting a large amount of color paste, wherein at the position 4, when the second rodless cavity sucks in the color paste, both of the rodless cavity opening and the rod containing cavity opening communicate with the color paste bucket, and at the position 3, during the ejection of the rodless cavity, the rodless cavity communicates with the ejection opening, and the rod containing cavity communicates with the color paste bucket.

4. An operation method of the three-stage variable color paste pump according to claim 1, comprising: (1) differentially ejecting a small amount of color paste, wherein at the position 1, during the ejection of the rodless cavity, the rodless cavity communicates with the ejection opening, and the rodless cavity communicates with the rod containing cavity; (2) ejecting a medium amount of color paste, wherein at the position 2, during the ejection of the rod containing cavity, the rod containing cavity opening communicates with the ejection opening, and the rodless cavity communicates with the color paste bucket; and (3) ejecting a large amount of color paste, wherein at the position 3, during the ejection of the rodless cavity, the rodless cavity communicates with the ejection opening, and the rod containing cavity communicates with the color paste bucket.

5. The three-stage variable color paste pump according to claim 1, wherein the control valve comprises a first valve body and a first valve core, a first baffle is arranged in the first valve body to divide the first valve body into a first left cavity and a first right cavity, the first valve core is mainly composed of a first left valve piece and a first right valve piece, which are installed on both ends of a first rotating shaft, a first rod containing cavity opening is formed in the first left cavity, a first rodless cavity opening is formed in the first right cavity, a first left valve cover and a first right valve cover are respectively installed on the outer sides of the first left valve piece and the first right valve piece, the first left valve cover is provided with a first ejection opening and a first color paste bucket opening, the first right valve cover is provided with a first channel E and a first channel F, the first valve core is rotated to different angular positions to form the following communication structures: at an angular position 1, the first rodless cavity opening communicates with a first channel C in the first right valve piece, the first channel C communicates with the first channel E, the first channel E communicates with the first ejection opening through a first channel I, the first ejection opening communicates with a first channel B, and the first channel B communicates with the first rod containing cavity opening; at an angular position 2, the first rod containing cavity opening communicates with the first ejection opening through a first channel A the first rodless cavity opening communicates with the first channel F through a first channel D, and the first channel F communicates with the first color paste bucket opening through a first channel II; at an angular position 3, the first rodless cavity opening communicates with the first channel D, the first channel D communicates with the first channel E, the first channel E communicates with the first ejection opening through the first channel I, and the first rod containing cavity opening communicates with the first color paste bucket opening through the first channel A; and the first channel I and the first channel II are arranged in parallel.

6. The three-stage variable color paste pump according to claim 5, wherein an angular position 4 of the communication structure is additionally arranged, in which the first rodless cavity opening communicates with the first channel C in the first right valve piece, the first channel C communicates with the first channel F, and the first channel F communicates with the first color paste bucket opening through the first channel II; and the first rod containing cavity opening communicates with the first channel B in the first left valve piece and the first color paste bucket opening, and the first ejection opening is closed.

7. An operation method of the three-stage variable color paste pump according to claim 6, comprising: (1) differentially ejecting a small amount of color paste, wherein at the angular position 4, when the first rodless cavity sucks in the color paste, the first rodless cavity opening communicates with the first channel C in the first right valve piece, the first channel C communicates with the first channel F, the first channel F communicates with the first color paste bucket opening through the first channel II, the first rod containing cavity opening communicates with the first channel B in the first left valve piece and the first color paste bucket opening, and the first ejection opening is closed, at the angular position 1, during the ejection of the first rodless cavity, the first rodless cavity opening communicates with the first channel C in the first right valve piece, the first channel C communicates with the first channel E, the first channel E communicates with the first ejection opening through the first channel I, the first ejection opening communicates with the first channel B, and the first channel B communicates with the first rod containing cavity opening; (2) ejecting a medium amount of color paste, wherein at the angular position 4, when the first rod containing cavity sucks in the color paste, the first rodless cavity opening communicates with the first channel C in the first right valve piece, the first channel C communicates with the first channel F, the first channel F communicates with the first color paste bucket opening through the first channel II, the first rod containing cavity opening communicates with the first channel B in the first left valve piece and the first color paste bucket opening, and the first ejection opening is closed, at the angular position 2, during the ejection of the first rod containing cavity, the first rod containing cavity opening communicates with the first ejection opening through the first channel A, the first rodless cavity opening communicates with the first channel F through the first channel D, and the first channel F communicates with the first color paste bucket opening through the first channel II; and (3) ejecting a large amount of color paste, wherein at the angular position 4, when the first rodless cavity sucks in the color paste, the first rodless cavity opening communicates with the first channel C in the first right valve piece, the first channel C communicates with the first channel F, the first channel F communicates with the first color paste bucket opening through the first channel II, the first rod containing cavity opening communicates with the first channel B in the first left valve piece and the first color paste bucket opening, and the first ejection opening is closed, at the angular position 3, during the ejection of the first rodless cavity, the first rodless cavity opening communicates with the first channel D, the first channel D communicates with the first channel E, the first channel E communicates with the first ejection opening through the first channel I, and the first rod containing cavity opening communicates with the first color paste bucket opening through the first channel A.

8. An operation method of the three-stage variable color paste pump according to claim 5, comprising: (1) differentially ejecting a small amount of color paste, wherein at the angular position 1, during the ejection of the first rodless cavity, the first rodless cavity opening communicates with the first channel C in the first right valve piece, the first channel C communicates with the first channel E, the first channel E communicates with the first ejection opening through the first channel I, the first ejection opening communicates with the first channel B, and the first channel B communicates with the first rod containing cavity opening; (2) ejecting a medium amount of color paste, wherein at the angular position 2, during the ejection of the first rod containing cavity, the first rod containing cavity opening communicates with the first ejection opening through the first channel A, the first rodless cavity opening communicates with the first channel F through the first channel D, and the first channel F communicates with the first color paste bucket opening through the first channel II; and (3) ejecting a large amount of color paste, wherein at the angular position 3, during the ejection of the first rodless cavity, the first rodless cavity opening communicates with the first channel D, the first channel D communicates with the first channel E, the first channel E communicates with the first ejection opening through the first channel I, and the first rod containing cavity opening communicates with the first color paste bucket opening through the first channel A.

9. The three-stage variable color paste pump according to claim 1, wherein the control valve comprises a second valve body and a second valve core, a second baffle is arranged in the second valve body to divide the second valve body into a second left cavity and a second right cavity, the second valve core is mainly composed of a second left valve piece and a second right valve piece, which are installed on both ends of a second rotating shaft, a second rod containing cavity opening is formed in the second left cavity, a second rodless cavity opening is formed in the second right cavity, a second left valve cover and a second right valve cover are respectively installed on the outer sides of the second left valve piece and the second right valve piece, the second left valve cover is provided with a second ejection opening and a second color paste bucket opening, the second right valve cover is provided with a second channel E and a second channel F, the second valve core is rotated to different angular positions to form the following communication structures: at an angular position 1, the second rodless cavity opening communicates with a second channel C in the second right valve piece, the second channel C communicates with the second channel E, the second channel E communicates with the second ejection opening through a second channel I, the second ejection opening communicates with a second channel B, and the second channel B communicates with the second rod containing cavity opening; at an angular position 2, the second rod containing cavity opening communicates with the second ejection opening through a second channel A, the second rodless cavity opening communicates with the second channel F through a second channel D, and the second channel F communicates with the second color paste bucket opening through a second channel II; at an angular position 3, the second rodless cavity opening communicates with the second channel D, the second channel D communicates with the second channel E, the second channel E communicates with the second ejection opening through the second channel I, and the second rod containing cavity opening communicates with the second color paste bucket opening through the second channel A; and the second channel I and the second channel II are arranged in a crossing manner.

10. The three-stage variable color paste pump according to claim 9, wherein an angular position 4 of the communication structure is additionally arranged, in which the second rodless cavity opening communicates with the second channel C in the second right valve piece, the second channel C communicates with the second channel F, and the second channel F communicates with the second color paste bucket opening through the second channel II; and the second rod containing cavity opening communicates with the second channel B in the second left valve piece and the second color paste bucket opening, and the second ejection opening is closed.

11. An operation method of the three-stage variable color paste pump according to claim 10, comprising: (1) differentially ejecting a small amount of color paste, wherein at the angular position 4, when the second rodless cavity sucks in the color paste, the second rodless cavity opening communicates with the second channel C in the second right valve piece, the second channel C communicates with the second channel F, the second channel F communicates with the second color paste bucket opening through the second channel II, the second rod containing cavity opening communicates with the second channel B in the second left valve piece and the second color paste bucket opening, and the second ejection opening is closed, at the angular position 1, during the ejection of the second rodless cavity, the second rodless cavity opening communicates with the second channel C in the second right valve piece, the second channel C communicates with the second channel E, the second channel E communicates with the second ejection opening through the second channel I, the second ejection opening communicates with the second channel B, and the second channel B communicates with the second rod containing cavity opening; (2) ejecting a medium amount of color paste, wherein at the angular position 4, when the second rod containing cavity sucks in the color paste, the second rodless cavity opening communicates with the second channel C in the second right valve piece, the second channel C communicates with the second channel F, the second channel F communicates with the second color paste bucket opening through the second channel II, the second rod containing cavity opening communicates with the second channel B in the second left valve piece and the second color paste bucket opening, and the second ejection opening is closed, at the angular position 2, during the ejection of the second rod containing cavity, the second rod containing cavity opening communicates with the second ejection opening through the second channel A, the second rodless cavity opening communicates with the second channel F through the second channel D, and the second channel F communicates with the second color paste bucket opening through the second channel II; and (3) ejecting a large amount of color paste, wherein at the angular position 4, when the second rodless cavity sucks in the color paste, the second rodless cavity opening communicates with the second channel C in the second right valve piece, the second channel C communicates with the second channel F, the second channel F communicates with the second color paste bucket opening through the second channel II, the second rod containing cavity opening communicates with the second channel B in the second left valve piece and the second color paste bucket opening, and the second ejection opening is closed, at the angular position 3, during the ejection of the second rodless cavity, the second rodless cavity opening communicates with the second channel D, the second channel D communicates with the second channel E, the second channel E communicates with the second ejection opening through the second channel I, and the second rod containing cavity opening communicates with the second color paste bucket opening through the second channel A.

12. An operation method of the three-stage variable color paste pump according to claim 9, comprising: (1) differentially ejecting a small amount of color paste, wherein at the angular position 1, during the ejection of the second rodless cavity, the second rodless cavity opening communicates with the second channel C in the second right valve piece, the second channel C communicates with the second channel E, the second channel E communicates with the second ejection opening through the second channel I, the second ejection opening communicates with the second channel B, and the second channel B communicates with the second rod containing cavity opening; (2) ejecting a medium amount of color paste, wherein at the angular position 2, during the ejection of the second rod containing cavity, the second rod containing cavity opening communicates with the second ejection opening through the second channel A, the second rodless cavity opening communicates with the second channel F through the second channel D, and the second channel F communicates with the second color paste bucket opening through the second channel II; and (3) ejecting a large amount of color paste, wherein at the angular position 3, during the ejection of the second rodless cavity, the second rodless cavity opening communicates with the second channel D, the second channel D communicates with the second channel E, the second channel E communicates with the second ejection opening through the second channel I, and the second rod containing cavity opening communicates with the second color paste bucket opening through the second channel A.

13. The three-stage variable color paste pump according to claim 1, wherein the control valve comprises a third valve body and a third valve core, the third valve body is provided with a third rodless cavity opening A, a third rod containing cavity opening A, a third rod containing cavity opening B, a third rodless cavity opening B and a third ejection opening, a third left cavity and a third right cavity are arranged in the third valve core, the third left cavity communicates with a third color paste bucket opening, and the third valve core is rotated to different angular positions to form the following communication structures: at an angular position 1, the third rodless cavity opening B communicates with a third channel F in the third valve core, the third channel F communicates with the third rod containing cavity opening B through a third channel H in the third valve core, and the third channel F communicates with the third ejection opening through a third channel I in the third valve core; at an angular position 2, the third rodless cavity opening A communicates with the third color paste bucket opening through a third channel D in the third valve core and the third rod containing cavity opening B communicates with the third ejection opening through a third channel G and a third channel K in the third valve core; and at an angular position 3, the third rod containing cavity opening A communicates with the third color paste bucket opening through a third channel B in the third valve core and the third rodless cavity opening B communicates with the third ejection opening through a third channel E and a third channel J in the third valve core.

14. The three-stage variable color paste pump according to claim 13, wherein an angular position 4 of the communication structure is additionally arranged, in which the third rod containing cavity opening A communicates with the third color paste bucket opening through a third channel A in the third valve core, the third rodless cavity opening A communicates with the third color paste bucket opening through a third channel C in the third valve core, and the third ejection opening is closed.

15. An operation method of the three-stage variable color paste pump according to claim 14, comprising: (1) differentially ejecting a small amount of color paste, wherein at the angular position 4, when the third rodless cavity sucks in the color paste, the third rod containing cavity opening A communicates with the third color paste bucket opening through the third channel A in the third valve core, the third rodless cavity opening A communicates with the third color paste bucket opening through the third channel C in the third valve core, and the third ejection opening is closed, at the angular position 1, during the ejection of the third rodless cavity, the third rodless cavity opening B communicates with the third channel F in the third valve core, the third channel F communicates with the third rod containing cavity opening B through the third channel H in the third valve core, and the third channel F communicates with the third ejection opening through the third channel I in the third valve core; (2) ejecting a medium amount of color paste, wherein at the angular position 4, when the third rod containing cavity sucks in the color paste, the third rod containing cavity opening A communicates with the third color paste bucket opening through the third channel A in the third valve core, the third rodless cavity opening A communicates with the third color paste bucket opening through the third channel C in the third valve core, and the third ejection opening is closed, at the angular position 2, during the ejection of the third rod containing cavity, the third rodless cavity opening A communicates with the third color paste bucket opening through the third channel D in the third valve core, and the third rod containing cavity opening B communicates with the third ejection opening through the third channel G and the third channel K in the third valve core; and (3) ejecting a large amount of color paste, wherein at the angular position 4, when the third rodless cavity sucks in the color paste, the third rod containing cavity opening A communicates with the third color paste bucket opening through the third channel A in the third valve core, the third rodless cavity opening A communicates with the third color paste bucket opening through the third channel C in the third valve core, and the third ejection opening is closed, at the angular position 3, during the ejection of the third rodless cavity, the third rod containing cavity opening A communicates with the third color paste bucket opening through the third channel B in the third valve core, and the third rodless cavity opening B communicates with the third ejection opening through the third channel E and the third channel J in the third valve core.

16. An operation method of the three-stage variable color paste pump according to claim 13, comprising: (1) differentially ejecting a small amount of color paste, wherein at the angular position 1, during the ejection of the third rodless cavity, the third rodless cavity opening B communicates with the third channel F in the third valve core, the third channel F communicates with the third rod containing cavity opening B through the third channel H in the third valve core and the third channel F communicates with the third ejection opening through the third channel I in the third valve core; (2) ejecting a medium amount of color paste, wherein at the angular position 2, during the ejection of the third rod containing cavity, the third rodless cavity opening A communicates with the third color paste bucket opening through the third channel D in the third valve core, and the third rod containing cavity opening B communicates with the third ejection opening through the third channel G and the third channel K in the third valve core; and (3) ejecting a large amount of color paste, wherein at the angular position 3, during the ejection of the third rodless cavity, the third rod containing cavity opening A communicates with the third color paste bucket opening through the third channel B in the third valve core, and the third rodless cavity opening B communicates with the third ejection opening through the third channel E and the third channel J in the third valve core.

17. The three-stage variable color paste pump according to claim 1, wherein the control valve comprises a fourth valve body and a fourth valve core, the fourth valve body is provided with a fourth rod containing cavity opening, a fourth rodless cavity opening A, a fourth rodless cavity opening B a fourth rodless cavity opening C and a fourth ejection opening, the fourth rod containing cavity opening communicates with a fourth channel II through a fourth channel I, a fourth left cavity and a fourth right cavity are arranged in the fourth valve core, the fourth left cavity communicates with a fourth color paste bucket opening, and the fourth valve core is rotated to different angular positions to form the following communication structures: at an angular position 1, the fourth rodless cavity opening B communicates with the fourth channel II through a fourth channel D in the fourth valve core, and the fourth rodless cavity opening C communicates with the fourth ejection opening through a fourth channel G and a fourth channel E in the fourth valve core; at an angular position 2, the fourth rodless cavity opening B communicates with the fourth color paste bucket opening through a fourth channel K in the fourth valve core, the fourth rod containing cavity opening communicates with the fourth channel I, the fourth channel I communicates with the fourth channel II, and the fourth channel II communicates with the fourth ejection opening through a fourth channel H; and at an angular position 3, the fourth rod containing cavity opening communicates with the fourth channel I, the fourth channel I communicates with the fourth channel II, the fourth channel II communicates with the fourth color paste bucket opening through a fourth channel C, and the fourth rodless cavity opening C communicates with the fourth ejection opening through a fourth channel F and a fourth channel I in the fourth valve core.

18. The three-stage variable color paste pump according to claim 17, wherein an angular position 4 of the communication structure is additionally arranged, in which the fourth rodless cavity opening A communicates with the fourth color paste bucket opening through a fourth channel A in the fourth valve core, the fourth rod containing cavity opening communicates with the fourth channel I, the fourth channel I communicates with the fourth channel II, the fourth channel II communicates with the fourth color paste bucket opening through a fourth channel B in the fourth valve core, and the fourth ejection opening is closed.

19. An operation method of the three-stage variable color paste pump according to claim 18, comprising: (1) differentially ejecting a small amount of color paste, wherein at the angular position 4, when the fourth rodless cavity sucks in the color paste, the fourth rodless cavity opening A communicates with the fourth color paste bucket opening through the fourth channel A in the fourth valve core, the fourth rod containing cavity opening communicates with the fourth channel I, the fourth channel I communicates with the fourth channel II, the fourth channel II communicates with the fourth color paste bucket opening through the fourth channel B in the fourth valve core, and the fourth ejection opening is closed, at the angular position 1, during the ejection of the fourth rodless cavity, the fourth rodless cavity opening B communicates with the fourth channel II through the fourth channel D in the fourth valve core, and the fourth rodless cavity opening C communicates with the fourth ejection opening through the fourth channel G and the fourth channel E in the fourth valve core; (2) ejecting a medium amount of color paste, wherein at the angular position 4, when the fourth rod containing cavity sucks in the color paste, the fourth rodless cavity opening A communicates with the fourth color paste bucket opening through the fourth channel A in the fourth valve core, the fourth rod containing cavity opening communicates with the fourth channel I, the fourth channel I communicates with the fourth channel II, the fourth channel II communicates with the fourth color paste bucket opening through the fourth channel B in the fourth valve core, and the fourth ejection opening is closed, at the angular position 2, during the ejection of the fourth rod containing cavity, the fourth rodless cavity opening B communicates with the fourth color paste bucket opening through the fourth channel K in the fourth valve core, the fourth rod containing cavity opening communicates with the fourth channel I, the fourth channel I communicates with the fourth channel II, and the fourth channel II communicates with the fourth ejection opening through the fourth channel H; and (3) ejecting a large amount of color paste, wherein at the angular position 4, when the fourth rodless cavity sucks in the color paste, the fourth rodless cavity opening A communicates with the fourth color paste bucket opening through the fourth channel A in the fourth valve core, the fourth rod containing cavity opening communicates with the fourth channel I, the fourth channel I communicates with the fourth channel II, the fourth channel II communicates with the fourth color paste bucket opening through the fourth channel B in the fourth valve core, and the fourth ejection opening is closed, at the angular position 3, during the ejection of the fourth rodless cavity, the fourth rod containing cavity opening communicates with the fourth channel, the fourth channel I communicates with the fourth channel II, the fourth channel II communicates with the fourth color paste bucket opening through the fourth channel C, and the fourth rodless cavity opening C communicates with the fourth ejection opening through the fourth channel F and the fourth channel I in the fourth valve core.

20. An operation method of the three-stage variable color paste pump according to claim 17, comprising: (1) differentially ejecting a small amount of color paste, wherein at the angular position 1, during the ejection of the fourth rodless cavity, the fourth rodless cavity opening B communicates with the fourth channel II through the fourth channel D in the fourth valve core, and the fourth rodless cavity opening C communicates with the fourth ejection opening through the fourth channel G and the fourth channel E in the fourth valve core; (2) ejecting a medium amount of color paste, wherein at the angular position 2, during the ejection of the fourth rod containing cavity, the fourth rodless cavity opening B communicates with the fourth color paste bucket opening through the fourth channel K in the fourth valve core, the fourth rod containing cavity opening communicates with the fourth channel I, the fourth channel I communicates with the fourth channel, and the fourth channel II communicates with the fourth ejection opening through the fourth channel H; and (3) ejecting a large amount of color paste, wherein at the angular position 3, during the ejection of the fourth rodless cavity, the fourth rod containing cavity opening communicates with the fourth channel I, the fourth channel I communicates with the fourth channel II, the fourth channel II communicates with the fourth color paste bucket opening through the fourth channel C, and the fourth rodless cavity opening C communicates with the fourth ejection opening through the fourth channel F and the fourth channel I in the fourth valve core.

21. The three-stage variable color paste pump according to claim 1, wherein the control valve comprises a fifth valve body, a fifth bonnet and a fifth valve core, the fifth bonnet is fixed on the fifth valve body, the fifth valve core is connected through a rotating shaft, a fifth cavity is formed between the fifth valve core and the fifth bonnet, the fifth valve body is provided with a fifth color paste bucket branch opening a, a fifth color paste bucket branch opening b, a fifth rod containing cavity branch opening b, a fifth rod containing cavity branch opening a and a fifth rodless cavity opening, the fifth color paste bucket branch opening a and the fifth color paste bucket branch opening b communicate with the fifth color paste bucket opening, the fifth rod containing cavity branch opening b communicates with the fifth rod containing cavity through a fifth channel I, the fifth rod containing cavity branch opening a communicates with the fifth rod containing cavity through a fifth channel II, a fifth ejection opening is formed in the fifth bonnet, the fifth cavity communicates with the fifth ejection opening, a channel is arranged on the fifth valve core, and the fifth valve core is rotated to different angular positions to form the following communication structures: at an angular position 1, the fifth rodless cavity opening communicates with the fifth cavity through a fifth channel E in the fifth valve core, the fifth rod containing cavity branch opening b communicates with the fifth cavity through a fifth channel F in the fifth valve core, and the fifth cavity communicates with the fifth ejection opening; at an angular position 2, the fifth rodless cavity opening communicates with the fifth color paste bucket branch opening b through a groove in the fifth valve core, and the fifth rod containing cavity branch opening b communicates with the fifth ejection opening through a fifth channel E in the fifth valve core; and at an angular position 3, the fifth rod containing cavity branch opening a communicates with the fifth color paste bucket branch opening a through the groove in the fifth valve core, and the fifth rodless cavity opening communicates with the fifth ejection opening through the fifth channel F.

22. The three-stage variable color paste pump according to claim 21, wherein a static valve piece is arranged between the fifth valve body and the fifth valve core, a fifth channel a, a fifth channel b, a fifth channel c and a fifth channel d are arranged in the static valve piece, the fifth channel a communicates with the fifth rodless cavity opening, the fifth channel b communicates with the fifth color paste bucket branch opening a and the fifth color paste bucket branch opening b, the fifth channel c communicates with the fifth rod containing cavity branch opening a, and the fifth channel d communicates with the fifth rod containing cavity branch opening b.

23. An operation method of the three-stage variable color paste pump according to claim 21, comprising: (1) differentially ejecting a small amount of color paste, wherein at the angular position 1, during the ejection of the fifth rodless cavity, the fifth rodless cavity opening communicates with the fifth cavity through the fifth channel E in the fifth valve core, the fifth rod containing cavity branch opening b communicates with the fifth cavity through the fifth channel F in the fifth valve core, and the fifth cavity communicates with the fifth ejection opening; (2) ejecting a medium amount of color paste, wherein at the angular position 2, during the ejection of the fifth rod containing cavity, the fifth rodless cavity opening communicates with the fifth color paste bucket branch opening b through the groove in the fifth valve core, and the fifth rod containing cavity branch opening b communicates with the fifth ejection opening through the fifth channel E in the fifth valve core; and (3) ejecting a large amount of color paste, wherein at the angular position 3, during the ejection of the fifth rodless cavity, the fifth rod containing cavity branch opening a communicates with the fifth color paste bucket branch opening a through the groove in the fifth valve core, and the fifth rodless cavity opening communicates with the fifth ejection opening through the fifth channel F.

24. The three-stage variable color paste pump according to claim 1, wherein the control valve comprises a sixth valve body and a sixth valve core, the sixth valve body is provided with a sixth color paste bucket opening, a sixth ejection opening, a sixth rod containing cavity opening and a sixth rodless cavity opening and the sixth valve core is rotated to different angular positions to form the following communication structures: at an angular position 1, the sixth rod containing cavity opening communicates with a sixth channel A, the sixth channel A communicates with a sixth channel B, the sixth channel B communicates with the sixth ejection opening, the sixth rodless cavity opening communicates with the sixth rod containing cavity opening through the sixth channel A, and the sixth rod containing cavity opening communicates with the sixth channel B; at an angular position 2, the sixth rod containing cavity opening communicates with the sixth ejection opening through a sixth channel C, and the sixth rodless cavity opening communicates with the sixth color paste bucket opening through a sixth channel D; and at an angular position 3, the sixth rodless cavity opening communicates with the sixth ejection opening through a sixth channel E, and the sixth rod containing cavity opening communicates with the sixth color paste bucket opening through a sixth channel F.

25. The three-stage variable color paste pump according to claim 24, wherein an angular position 4 of the communication structure is additionally arranged, in which the sixth rodless cavity opening communicates with a sixth channel H, the sixth channel H communicates with the sixth color paste bucket opening through a sixth channel I, and the sixth rod containing cavity opening communicates with the sixth color paste bucket opening through the sixth channel I.

26. An operation method of the three-stage variable color paste pump according to claim 25, comprising: (1) differentially ejecting a small amount of color paste, wherein at the angular position 4, when the sixth rodless cavity sucks in the color paste, the sixth rodless cavity opening communicates with the sixth channel H, the sixth channel H communicates with the sixth color paste bucket opening through the sixth channel, and the sixth rod containing cavity opening communicates with the sixth color paste bucket opening through the sixth channel I, at the angular position 1, during the ejection of the sixth rodless cavity, the sixth rod containing cavity opening communicates with the sixth channel A, the sixth channel A communicates with the sixth channel B, the sixth channel B communicates with the sixth ejection opening, the sixth rodless cavity opening communicates with the sixth rod containing cavity opening through the sixth channel A, and the sixth rod containing cavity opening communicates with the sixth channel B; (2) ejecting a medium amount of color paste, wherein at the angular position 4, when the sixth rod containing cavity sucks in the color paste, and when the sixth rodless cavity sucks in the color paste, the sixth rodless cavity opening communicates with the sixth channel H, the sixth channel H communicates with the sixth color paste bucket opening through the sixth channel I, and the sixth rod containing cavity opening communicates with the sixth color paste bucket opening through the sixth channel I, at the angular position 2, during the ejection of the sixth rod containing cavity, the sixth rod containing cavity opening communicates with the sixth ejection opening through the sixth channel C, and the sixth rodless cavity opening communicates with the sixth color paste bucket opening through the sixth channel D; and (3) ejecting a large amount of color paste, wherein at the angular position 4, when the sixth rodless cavity sucks in the color paste, the sixth rodless cavity opening communicates with the sixth channel H, the sixth channel H communicates with the sixth color paste bucket opening through the sixth channel I, and the sixth rod containing cavity opening communicates with the sixth color paste bucket opening through the sixth channel I, at the angular position 3, during the ejection of the sixth rodless cavity the sixth rodless cavity opening communicates with the sixth ejection opening through the sixth channel E, and the sixth rod containing cavity opening communicates with the sixth color paste bucket opening through the sixth channel F.

27. An operation method of the three-stage variable color paste pump according to claim 24, comprising: (1) differentially ejecting a small amount of color paste, wherein at the angular position 1, during the ejection of the sixth rodless cavity, the sixth rod containing cavity opening communicates with the sixth channel A, the sixth channel A communicates with the sixth channel B, the sixth channel B communicates with the sixth ejection opening, the sixth rodless cavity opening communicates with the sixth rod containing cavity opening through the sixth channel A, and the sixth rod containing cavity opening communicates with the sixth channel B; (2) ejecting a medium amount of color paste, wherein at the angular position 2, during the ejection of the sixth rod containing cavity, the sixth rod containing cavity opening communicates with the sixth ejection opening through the sixth channel C, and the sixth rodless cavity opening communicates with the sixth color paste bucket opening through the sixth channel D; and (3) ejecting a large amount of color paste, wherein at the angular position 3, during the ejection of the sixth rodless cavity, the sixth rodless cavity opening communicates with the sixth ejection opening through the sixth channel E, and the sixth rod containing cavity opening communicates with the sixth color paste bucket opening through the sixth channel F.

28. The three-stage variable color paste pump according to claim 1, wherein the control valve comprises a seventh valve body and a seventh valve core, the seventh valve body is provided with a seventh rod containing cavity opening, a seventh rodless cavity opening, a seventh color paste bucket opening and a seventh ejection opening, and the seventh valve core is rotated to different positions to form the following communication structures: at the position 1, the seventh rod containing cavity opening communicates with a seventh channel B through a seventh channel A, and the seventh rodless cavity opening communicates with the seventh ejection opening through the seventh channel B; at the position 2, the seventh rodless cavity opening communicates with the seventh color paste bucket opening through a seventh channel E, and the seventh rod containing cavity opening communicates with the seventh ejection opening through a seventh channel F; and at the position 3, the seventh rod containing cavity opening communicates with the seventh color paste bucket opening through a seventh channel G, and the seventh rodless cavity opening communicates with the seventh ejection opening through a seventh channel H.

29. The three-stage variable color paste pump according to claim 28, wherein a position 4 of the communication structure is additionally arranged, in which the seventh rod containing cavity opening communicates with the seventh color paste bucket opening through a seventh channel C, and the seventh rodless cavity opening communicates with the seventh color paste bucket opening through a seventh channel D.

30. An operation method of the three-stage variable color paste pump according to claim 29, comprising: (1) differentially ejecting a small amount of color paste, wherein at the position 4, when the seventh rodless cavity sucks in the color paste, the seventh rod containing cavity opening communicates with the seventh color paste bucket opening through the seventh channel C, and the seventh rodless cavity opening communicates with the seventh color paste bucket opening through the seventh channel D, at the position 1, during the ejection of the seventh rodless cavity, the seventh rod containing cavity opening communicates with the seventh channel B through the seventh channel A, and the seventh rodless cavity opening communicates with the seventh ejection opening through the seventh channel B; (2) ejecting a medium amount of color paste, wherein at the position 4, when the seventh rod containing cavity sucks in the color paste, the seventh rod containing cavity opening communicates with the seventh color paste bucket opening through the seventh channel C, and the seventh rodless cavity opening communicates with the seventh color paste bucket opening through the seventh channel D, at the position 2, during the ejection of the seventh rod containing cavity, the seventh rodless cavity opening communicates with the seventh color paste bucket opening through the seventh channel E, and the seventh rod containing cavity opening communicates with the seventh ejection opening through the seventh channel F; and (3) ejecting a large amount of color paste, wherein at the position 4, when the seventh rodless cavity sucks in the color paste, the seventh rod containing cavity opening communicates with the seventh color paste bucket opening through the seventh channel C, and the seventh rodless cavity opening communicates with the seventh color paste bucket opening through the seventh channel D, at the position 3, during the ejection of the seventh rodless cavity, the seventh rod containing cavity opening communicates with the seventh color paste bucket opening through the seventh channel G, and the seventh rodless cavity opening communicates with the seventh ejection opening through the seventh channel H.

31. An operation method of the three-stage variable color paste pump according to claim 28, comprising: (1) differentially ejecting a small amount of color paste, wherein at the position 1, during the ejection of the seventh rodless cavity, the seventh rod containing cavity opening communicates with the seventh channel B through the seventh channel A, and the seventh rodless cavity opening communicates with the seventh ejection opening through the seventh channel B; (2) ejecting a medium amount of color paste, wherein at the position 2, during the ejection of the seventh rod containing cavity, the seventh rodless cavity opening communicates with the seventh color paste bucket opening through the seventh channel E, and the seventh rod containing cavity opening communicates with the seventh ejection opening through the seventh channel F; and (3) ejecting a large amount of color paste, wherein at the position 3, during the ejection of the seventh rodless cavity the seventh rod containing cavity opening communicates with the seventh color paste bucket opening through the seventh channel G, and the seventh rodless cavity opening communicates with the seventh ejection opening through the seventh channel H.

32. The three-stage variable color paste pump according to claim 1, wherein the control valve comprises an eighth valve body and an eighth valve core, the eighth valve body is provided with an eighth rod containing cavity opening, an eighth rodless cavity opening, an eighth color paste bucket opening and an eighth ejection opening, and the eighth valve core is rotated to different angular positions to form the following communication structures: at an angular position 1, the eighth rod containing cavity opening communicates with an eighth channel B through an eighth channel A, and the eighth rodless cavity opening communicates with the eighth ejection opening through the eighth channel B; at an angular position 2, the eighth rodless cavity opening communicates with the eighth color paste bucket opening through an eighth channel E, and the eighth rod containing cavity opening communicates with the eighth ejection opening through an eighth channel F; and at an angular position 3, the eighth rod containing cavity opening communicates with the eighth color paste bucket opening through an eighth channel G, and the eighth rodless cavity opening communicates with the eighth ejection opening through an eighth channel H.

33. The three-stage variable color paste pump according to claim 32, wherein an angular position 4 of the communication structure is additionally arranged, in which the eighth rod containing cavity opening communicates with the eighth color paste bucket opening through an eighth channel C, and the eighth rodless cavity opening communicates with the eighth color paste bucket opening through an eighth channel D.

34. An operation method of the three-stage variable color paste pump according to claim 33, comprising: (1) differentially ejecting a small amount of color paste, wherein at the angular position 4, when the eighth rodless cavity sucks in the color paste, the eighth rod containing cavity opening communicates with the eighth color paste bucket opening through the eighth channel C, and the eighth rodless cavity opening communicates with the eighth color paste bucket opening through the eighth channel D, at the angular position 1, the eighth rod containing cavity opening communicates with the eighth channel B through the eighth channel A, and the eighth rodless cavity opening communicates with the eighth ejection opening through the eighth channel B; (2) ejecting a medium amount of color paste, wherein at the angular position 4, when the eighth rod containing cavity sucks in the color paste, the eighth rod containing cavity opening communicates with the eighth color paste bucket opening through the eighth channel C, and the eighth rodless cavity opening communicates with the eighth color paste bucket opening through the eighth channel D, at the angular position 2, during the ejection of the eighth rod containing cavity, the eighth rodless cavity opening communicates with the eighth color paste bucket opening through the eighth channel E, and the eighth rod containing cavity opening communicates with the eighth ejection opening through the eighth channel F; and (3) ejecting a large amount of color paste, wherein at the angular position 4, when the eighth rodless cavity sucks in the color paste, the eighth rod containing cavity opening communicates with the eighth color paste bucket opening through the eighth channel C, and the eighth rodless cavity opening communicates with the eighth color paste bucket opening through the eighth channel D, at the angular position 3, during the ejection of the eighth rodless cavity, the eighth rod containing cavity opening communicates with the eighth color paste bucket opening through the eighth channel G, and the eighth rodless cavity opening communicates with the eighth ejection opening through the eighth channel H.

35. An operation method of the three-stage variable color paste pump according to claim 32, comprising: (1) differentially ejecting a small amount of color paste, wherein at the angular position 1, the eighth rod containing cavity opening communicates with the eighth channel B through the eighth channel A, and the eighth rodless cavity opening communicates with the eighth ejection opening through the eighth channel B; (2) ejecting a medium amount of color paste, wherein at the angular position 2, during the ejection of the eighth rod containing cavity, the eighth rodless cavity opening communicates with the eighth color paste bucket opening through the eighth channel E, and the eighth rod containing cavity opening communicates with the eighth ejection opening through the eighth channel F; and (3) ejecting a large amount of color paste, wherein at the angular position 3, during the ejection of the eighth rodless cavity, the eighth rod containing cavity opening communicates with the eighth color paste bucket opening through the eighth channel G, and the eighth rodless cavity opening communicates with the eighth ejection opening through the eighth channel H.

* * * * *